US011655611B2

(12) United States Patent
Sano et al.

(10) Patent No.: US 11,655,611 B2
(45) Date of Patent: May 23, 2023

(54) SHOVEL

(71) Applicant: SUMITOMO HEAVY INDUSTRIES, LTD., Tokyo (JP)

(72) Inventors: Yusuke Sano, Kanagawa (JP); Junichi Okada, Kanagawa (JP); Kazunori Hiranuma, Kanagawa (JP); Yoshiyasu Itsuji, Kanagawa (JP); Koichiro Tsukane, Kanagawa (JP); Keiji Honda, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 405 days.

(21) Appl. No.: 16/716,743

(22) Filed: Dec. 17, 2019

(65) Prior Publication Data

US 2020/0115882 A1 Apr. 16, 2020

Related U.S. Application Data

(63) Continuation of application No. PCT/JP2018/023151, filed on Jun. 18, 2018.

(30) Foreign Application Priority Data

Jun. 21, 2017 (JP) ..... JP2017-121776
Jun. 21, 2017 (JP) ..... JP2017-121777
Jun. 21, 2017 (JP) ..... JP2017-121778
Jul. 25, 2017 (JP) ..... JP2017-143522

(51) Int. Cl.
*E02F 3/43* (2006.01)
*E02F 3/32* (2006.01)
(Continued)

(52) U.S. Cl.
CPC ..... *E02F 3/435* (2013.01); *E02F 3/32* (2013.01); *E02F 9/2004* (2013.01);
(Continued)

(58) Field of Classification Search
CPC ..... E02F 3/435; E02F 9/2207; F15B 11/0445; F15B 21/008; F15B 2211/8613
See application file for complete search history.

(56) References Cited

U.S. PATENT DOCUMENTS 5,048,296 A * 9/1991 Sunamura ..... E02F 3/43 60/468
7,278,262 B2 * 10/2007 Moon ..... F15B 21/087 60/426
(Continued)

FOREIGN PATENT DOCUMENTS

JP H07-014203 U 3/1995
JP H08-13546 1/1996
(Continued)

OTHER PUBLICATIONS

European Search Report for 18821558.6 dated Jun. 15, 2020.
International Search Report for PCT/JP2018/023151 dated Aug. 7, 2018.

*Primary Examiner* — Abiy Teka
(74) *Attorney, Agent, or Firm* — IPUSA, PLLC

(57) ABSTRACT

A shovel that corrects the movement of an attachment regardless of the operating state of the attachment by an operator is provided. The shovel includes a traveling body, a turning body turnably mounted on the traveling body, an attachment attached to the turning body, a hydraulic actuator configured to drive the attachment, and a controller. The controller is configured to control the hydraulic actuator to minimize a change in orientation of the traveling body or of the turning body, in response to a change in moment caused by an aerial movement of the attachment.

11 Claims, 59 Drawing Sheets

(51) Int. Cl.
*E02F 9/20* (2006.01)
*E02F 9/22* (2006.01)
*E02F 9/26* (2006.01)

(52) U.S. Cl.
CPC ..... *E02F 9/2221* (2013.01); *E02F 9/2228* (2013.01); *E02F 9/2267* (2013.01); *E02F 9/2271* (2013.01); *E02F 9/2275* (2013.01); *E02F 9/26* (2013.01); *E02F 9/2285* (2013.01); *E02F 9/2292* (2013.01); *E02F 9/2296* (2013.01)

(56) References Cited

U.S. PATENT DOCUMENTS 10,344,783 B2 * 7/2019 Wang ..... E04G 21/0454
2005/0177292 A1 * 8/2005 Okamura ..... E02F 9/2207 701/50
2007/0130933 A1 * 6/2007 Yoshino ..... F15B 21/008 60/469
2014/0088839 A1 * 3/2014 Magaki ..... E02F 9/2033 701/50
2015/0284930 A1 10/2015 Tsukamoto
2017/0204887 A1 7/2017 Matsuzaki et al.
2018/0298584 A1 10/2018 Okada

FOREIGN PATENT DOCUMENTS

JP 2008-002172 1/2008
JP 2008-169981 7/2008
JP 2014-122510 7/2014
JP 2016-166504 9/2016
JP 2016-183499 10/2016
WO 2012/121253 9/2012
WO 2016/056442 4/2016
WO 2017/090465 6/2017

* cited by examiner

WHEN SHOVEL IS BEING LIFTED

WHILE ARM IS MOVED, BUCKET DOES NOT READILY MOVE BECAUSE BUCKET IS IN CONTACT WITH GROUND
⇒ ACCELERATION AND ANGULAR ACCELERATION OF BUCKET DECREASE IN PROPORTION TO ACCELERATION AND ANGULAR ACCELERATION OF ARM

SHOVEL

CROSS-REFERENCE TO RELATED APPLICATION

The present application is a continuation of International Application No. PCT/JP2018/023151, filed on Jun. 18, 2018, which claims priority to Japanese Application No. 2017-121776, filed on Jun. 21, 2017, Japanese Application No. 2017-121777, filed on Jun. 21, 2017, Japanese Application No. 2017-121778, filed on Jun. 21, 2017, and Japanese Application No. 2017-143522, filed on Jul. 25, 2017, the entire content of each of which is incorporated herein by reference.

BACKGROUND

Technical Field

The disclosures herein relate to a shovel.

Description of Related Art

Conventionally, in order to prevent the movement of a shovel not intended by an operator (hereinafter simply referred to as an "unintended movement"), a technique that corrects the movement of an attachment of the shovel is known.

Patent Document 1 describes the technique that controls the pressure of a hydraulic cylinder, which drives the attachment of the shovel, not to exceed a predetermined maximum allowable pressure, thereby minimizing an unintended movement such as the dragging or lifting of the shovel.

However, it is desirable to minimize an unintended movement whatever the operating state of the attachment. Therefore, the movement of the attachment is required to be corrected regardless of the operating state of the attachment.

SUMMARY

According to an embodiment of the present invention, a shovel includes a traveling body, a turning body turnably mounted on the traveling body; an attachment attached to the turning body, a hydraulic actuator configured to drive the attachment, and a controller. The controller is configured to control the hydraulic actuator to minimize a change in orientation of the traveling body or of the turning body, in response to a change in moment caused by an aerial movement of the attachment.

BRIEF DESCRIPTION OF THE DRAWINGS

Other objects and further features of the present invention will be apparent from the following detailed description when read in conjunction with the accompanying drawings, in which.

MODE FOR CARRYING OUT THE INVENTION

Figure 1:
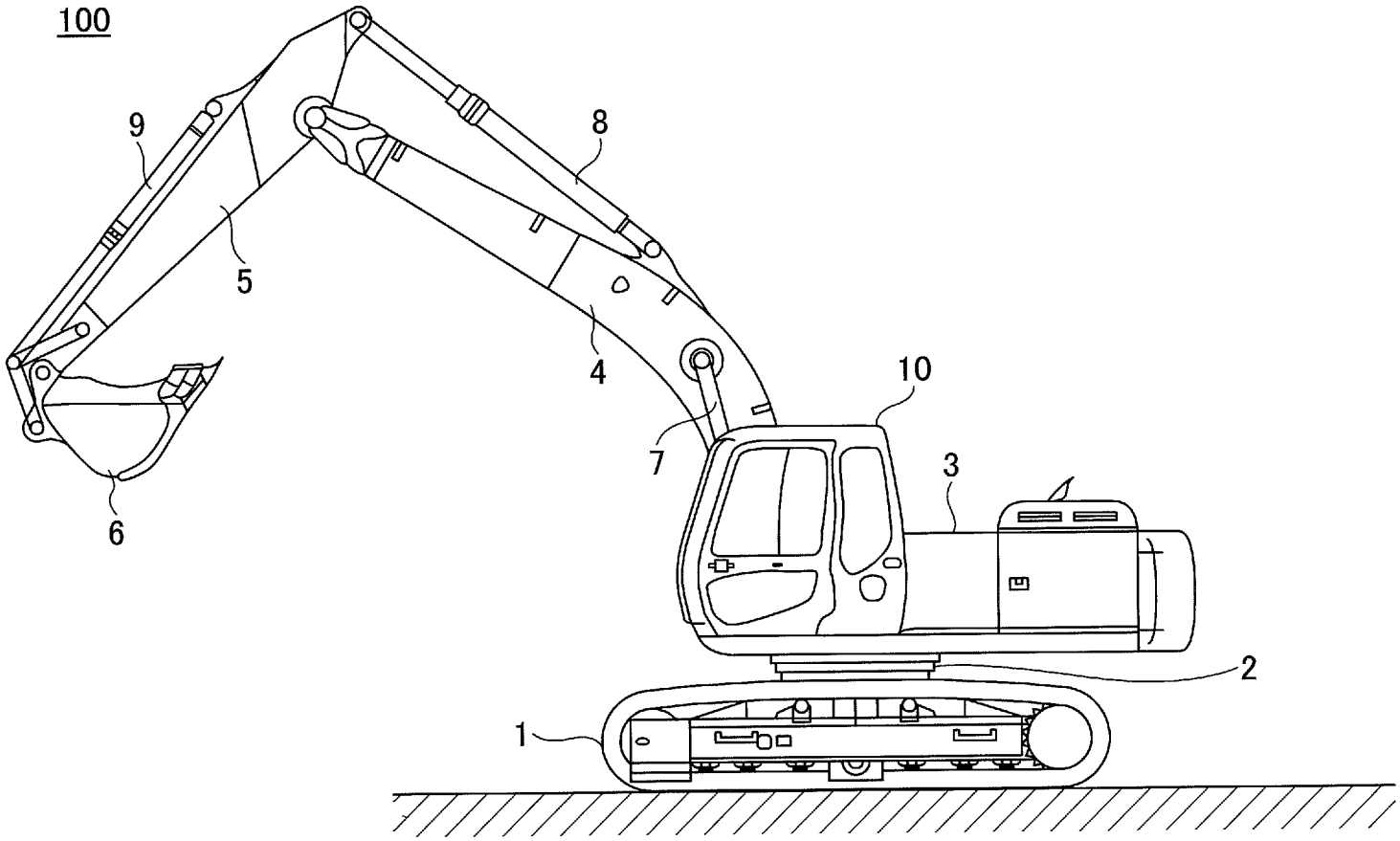
FIG. 1 is a drawing illustrating a shovel according to an embodiment of the present invention.

It is desirable to provide a shovel that corrects the movement of an attachment regardless of the operating state of the attachment by an operator.

In the following, embodiments of the present invention will be described with reference to the accompanying drawings.

In the drawings, the same or corresponding elements are denoted by the same reference numerals and a duplicate description thereof may be omitted.

[Overview of Shovel]

First, referring to FIG. 1, an overview of a shovel 100 will be described.

FIG. 1 is a side view of the shovel 100 according to an embodiment of the present invention.

The shovel 100 according to the present embodiment includes a lower traveling body 1, an upper turning body 3 turnably mounted on the lower traveling body 1 via a turning mechanism 2, a boom 4, an arm 5, a bucket 6, and a cabin 10 in which an operator is located. The boom 4, the arm 5, and the bucket 6 serve as an attachment.

The lower traveling body 1 (an example of a traveling body) includes a pair of left and right crawlers. The crawlers are hydraulically driven by respective traveling hydraulic motors 1L and 1R (see FIG. 2, for example) to move the shovel 100.

The upper turning body 3 (an example of a turning body) is driven by a turning hydraulic motor 21 (see FIG. 2), which will be described below, and is rotated with respect to the lower traveling body 1.

The boom 4 is pivotally attached to the front center of the upper turning body 3, the arm 5 is pivotally attached to the end of the boom 4, and the bucket 6 is pivotally attached to the end of the arm 5, in such a manner that the boom 4, the arm 5, and the bucket 6 are raised and lowered. The boom 4, the arm 5, and the bucket 6 are hydraulically driven by a boom cylinder 7, an arm cylinder 8, and a bucket cylinder 9, respectively. The boom cylinder 7, the arm cylinder 8, and the bucket cylinder 9 serve as hydraulic actuators.

The cabin 10 is mounted on the front left of the upper turning body 3, and the operator is located in the cabin 10.

[Basic Configuration of Shovel]

Next, referring to FIG. 2, a configuration of the shovel 100 according to the present embodiment will be described.

Figure 2:
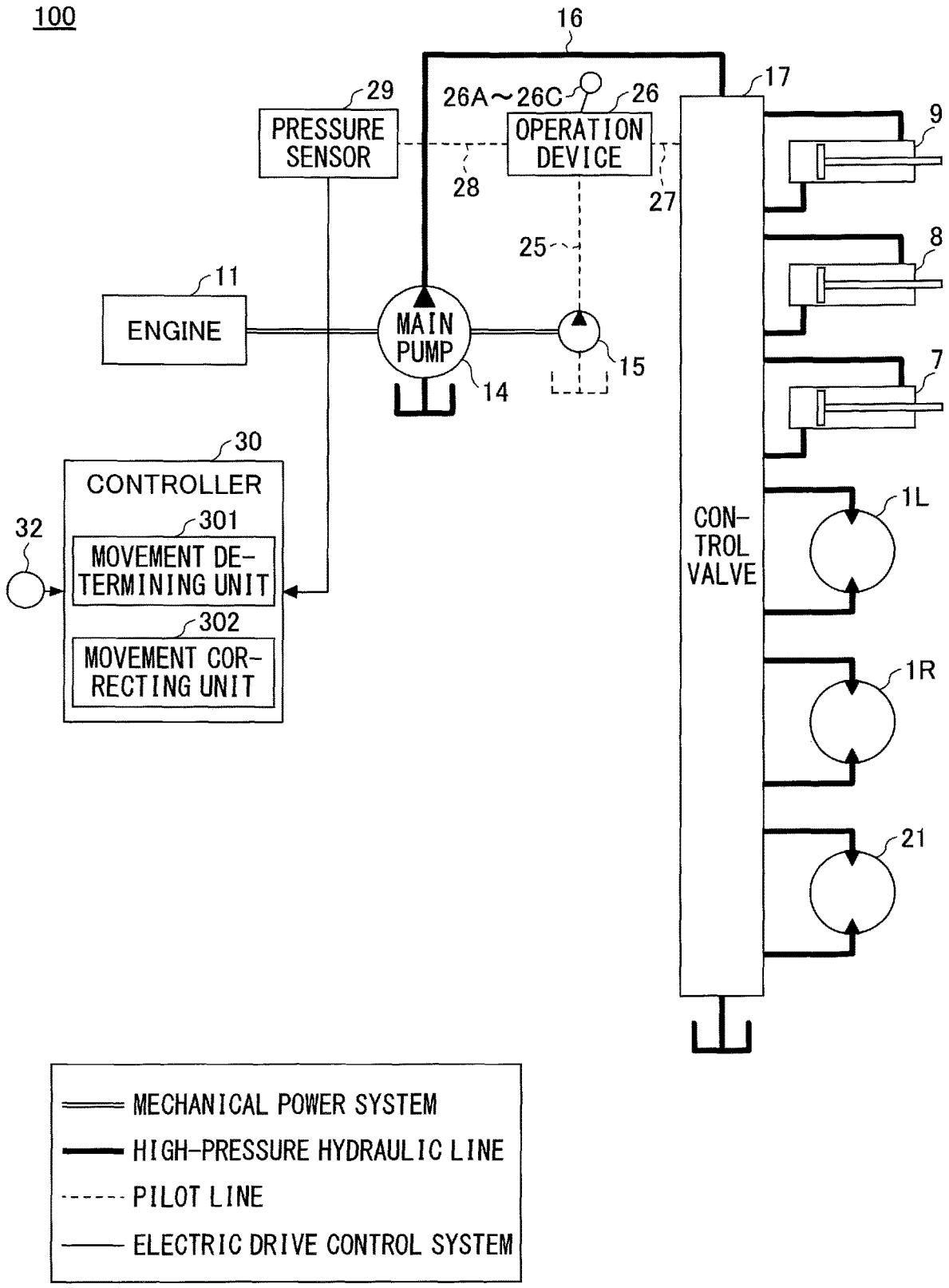
FIG. 2 is a block diagram illustrating an example configuration of a drive system of the shovel according to the embodiment of the present invention.

FIG. 2 is a block diagram illustrating an example configuration of a drive system of the shovel 100 according to the present embodiment.

In FIG. 2, a mechanical power system is indicated by a double line, a hydraulic oil line (high-pressure hydraulic line) is indicated by a thick continuous line, a pilot line is indicated by a dashed line, and an electric drive control system is indicated by a thin continuous line.

A hydraulic drive system of the shovel 100 according to the present embodiment includes an engine 11, a main pump 14, and a control valve 17. As described above, the hydraulic drive system according to the present embodiment includes the traveling hydraulic motors 1L and 1R, the turning hydraulic motor 21, the boom cylinder 7, the arm cylinder 8, the bucket cylinder 9, which hydraulically drive the lower traveling body 1, the upper turning body 3, the boom 4, the arm 5, and the bucket 6, respectively.

The engine 11 is a drive power source of the shovel 100, and is mounted on the rear of the upper turning body 3, for example. The engine 11 is a diesel engine using diesel fuel as fuel. The main pump 14 and a pilot pump 15 are connected to the output shaft of the engine 11.

The main pump 14 is installed at the rear of the upper turning body 3, for example, and supplies hydraulic oil to the control valve 17 via a hydraulic oil line 16. The main pump 14 is driven by the engine 11 as described above. The main pump 14 is, for example, a variable displacement hydraulic pump, and the inclination angle of a swash plate is controlled by a regulator 14A (see FIG. 29), which will be described below, thereby adjusting the length of stroke of a piston and controlling a discharge flow rate (discharge pressure).

The control valve 17 is a hydraulic control unit that is installed, for example, at the center of the upper turning body 3, and that controls the hydraulic drive system of the shovel 100 in accordance with the operation performed by the operator with an operation device 26. Hydraulic actuators such as a left-side traveling hydraulic motor 1L, a right-side traveling hydraulic motor 1R, the boom cylinder 7, the arm cylinder 8, the bucket cylinder 9, and the turning hydraulic motor 21 are connected to the control valve 17 via hydraulic oil lines. The control valve 17 is provided between the main pump 14 and the hydraulic actuators. The control valve 17 is a valve unit that includes a plurality of hydraulic control valves, namely direction control valves (such as a boom direction control valve 17A as will be described below) that control the flow rate and the direction of hydraulic oil supplied to each of the hydraulic actuators.

Next, an operation system of the shovel 100 according to the present embodiment includes the pilot pump 15, the operation device 26, and a pressure sensor 29.

The pilot pump 15 is installed, for example, at the rear of the upper turning body 3, and applies a pilot pressure to a mechanical brake 23 and the operation device 26 via a pilot line 25. For example, the pilot pump 15 is a fixed displacement hydraulic pump, and is driven by the above-described engine 11.

The operation device 26 includes levers 26A and 26B, and a pedal 26C. The operation device 26 is provided near an operator's seat of the cabin 10, and allows the operator to perform operations of operational elements (such as the lower traveling body 1, the upper turning body 3, the boom 4, the arm 5, and the bucket 6). In other words, the operation device 2 enables operations of the hydraulic actuators (such as the traveling hydraulic motors 1L and 1R, the boom cylinder 7, the arm cylinder 8, the bucket cylinder 9, and the turning hydraulic motor 21), which drive the respective operational elements. The operation device 26 (the levers 26A and 26B, and the pedal 26C) is connected to the control valve 17 via a pilot line 27. The control valve 17 receives a pilot signal (pilot pressure) corresponding to the state of an operation of each of the lower traveling body 1, the upper turning body 3, the boom 4, the arm 5, and the bucket 6 performed with the operation device 26. Accordingly, the control valve 17 can drive each of the hydraulic actuators in accordance with the state of an operation performed with the operation device 26. The operation device 26 is connected to the pressure sensor 29 via a pilot line 28.

The levers 26A and 26B are respectively provided on the left side and on the right side of the operator seated on the operator's seat within the cabin 10. The levers 26A and 26B are configured to be tilted forward and backward and to the left and right from the neutral position (a state in which no operation is performed by the operator). Operations of tilting the lever 26A forward, backward, to the left, and to the right, and operations of tilting the lever 26B forward, backward, to the left, and to the right are set as appropriate so as to operate the upper turning body (turning hydraulic motor 21), the boom 4 (boom cylinder 7), the arm 5 (arm cylinder 8), and the bucket 6 (bucket cylinder 9).

Further, the pedal 26C is provided on the floor ahead of the operator seated on the operator's seat within the cabin 10. The pedal 26C is configured to be stepped by the operator to operate the lower traveling body 1 (traveling hydraulic motors 1L and 1R).

As described above, the pressure sensor 29 is connected to the operation device 26 via the pilot line 28, detects the secondary-side pilot pressure of the operation device 26, namely the pilot pressure corresponding to the state of an operation of each of the operational elements performed with the operation device 26. The pressure sensor 29 is connected to the controller 30. The controller 30 receives a pressure signal (a detected pressure value) corresponding to the state of an operation of each of the lower traveling body 1, the upper turning body 3, the boom 4, the arm 5, and the bucket 6 performed with the operation device 26. Accordingly, the controller 30 can identify the state of an operation of each of the lower traveling body 1, the upper turning body 3, and the attachment of the shovel.

Next, a control system of the shovel 100 according to the present embodiment includes various types of sensors 32.

The controller 30 is a main controller that controls the driving of the shovel 100. The controller 30 may be implemented by any hardware, software, or a combination thereof. The controller 30 may be configured mainly by a microcomputer including a central processing unit (CPU), a random-access memory (RAM), a read-only memory (ROM), an auxiliary storage device, and an input-output (I/O) interface. The controller 30 controls the driving by causing the CPU to execute various types of programs stored in the ROM, the auxiliary storage device, and the like.

In the present embodiment, the controller 30 determines the occurrence of a predetermined movement of the shovel 100 not intended by the operator (hereinafter simply referred to as an unintended movement). Namely, the controller 30 determines the occurrence of a movement of the shovel 100 not desired by the operator. If the controller 30 determines that an unintended movement has occurred, the controller 30 corrects the movement of the attachment of the shovel 100 to minimize the movement of the attachment. Accordingly, the unintended movement of the shovel 100 is minimized.

Examples of the unintended movement include a forward dragging movement in which the shovel 100 is dragged forward by an excavation reaction force, a backward dragging movement in which the shovel 100 is dragged backward by a reaction force from the ground when leveling the ground. The unintended movement occurs without the lower traveling body 1 being operated by the operator. In the following, the term "forward dragging movement" and the term "backward dragging movement" may be correctively referred to as a "dragging movement" without being distinguished. The examples of the unintended movement further include a lifting movement in which the front or the rear of the shovel 100 is lifted by an excavation reaction force. In the following, the lifting movement may be distinguished between a front lifting movement in which the front of the shovel 100 is lifted and a rear lifting movement in which the rear of the shovel 100 is lifted. The examples of the unintended movement further include vibration of the body (the lower traveling body 1, the turning mechanism 2, or the upper turning body 3) of the shovel 100 caused by a change in the moment of inertia during in-air movement of the attachment of the shovel 100 (namely, during the movement of the attachment without the bucket 6 contacting the ground). Details of the unintended movement will be described below.

The controller 30 includes a movement determining unit 301 and a movement correcting unit 302 as functional units implemented by causing the CPU to execute one or more of the programs stored in the ROM and the auxiliary storage device.

The movement determining unit 301 determines the occurrence of an unintended movement, based on sensor information on various states of the shovel 100. The sensor information is input from the pressure sensor 29 and the various types of sensors 32. Details of determination methods will be described below.

When the movement determining unit 301 determines that an unintended movement has occurred, the movement correcting unit 302 corrects the movement of the attachment to minimize the unintended movement. Details of a correction method will be described below.

The various types of sensors 32 are known detectors for detecting various states of the shovel 100 and various states in the vicinity of the shovel 100. The various types of sensors 32 may include an angle sensor that detects an angle at a joint between the upper turning body 3 and the boom 4 relative to a reference plane of the boom 4 (a boom angle), an angle sensor that detects an angle of the arm 5 relative to the arm 5 (an arm angle), and an angle sensor that detects an angle of the bucket 6 relative to the arm 5 (a bucket angle). Further, the various types of sensors 32 may include pressure sensors that detect the pressure of hydraulic oil in hydraulic actuators. More specifically, the pressure sensors detect the pressure in a rod-side oil chamber and the pressure in a bottom-side oil chamber of a hydraulic cylinder. Further, the various types of sensors 32 may include sensors that detect movement states of the lower traveling body 1, the upper turning body 3, and the attachment. For example, the various types of sensors 32 may include an acceleration sensor, an angular acceleration sensor, and an inertial measurement unit (IMU) capable of outputting three-axis acceleration and three-axis angular acceleration. Further, the various types of sensors 32 may also include a distance sensor or an image sensor that detects a relative position of the ground surface or an obstacle in the vicinity of the shovel 100.

[Movement of Shovel Unintended by Operator]

Next, referring to FIG. 3 through FIG. 8B, details of the movement of the shovel 100 unintended by the operator will be described.

<Forward Dragging Movement>

Figure 3:
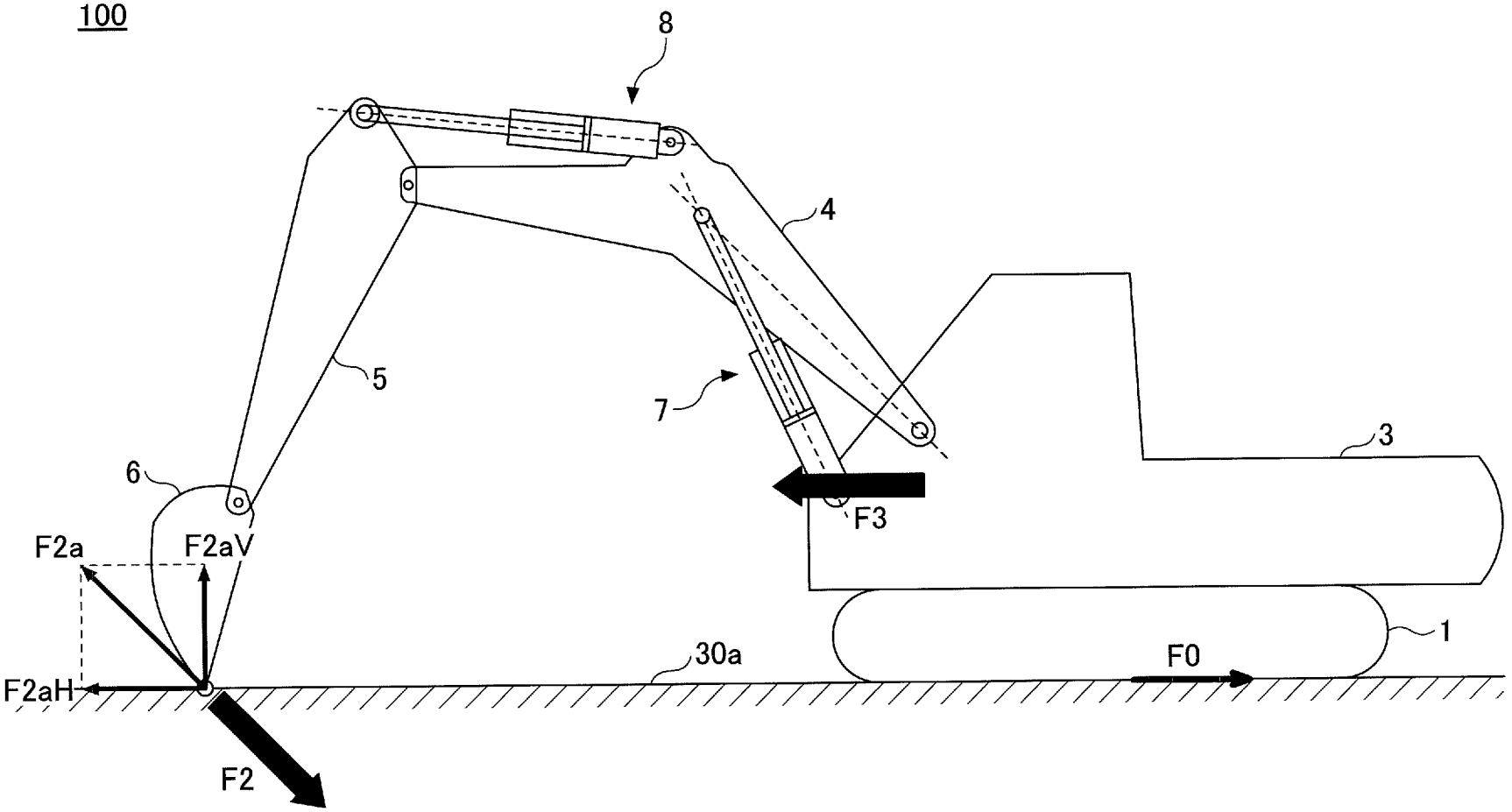
FIG. 3 is a drawing illustrating an example of a forward dragging movement of the shovel.

FIG. 3 is a drawing illustrating an example of the forward dragging movement of the shovel 100. More specifically, FIG. 3 is a drawing illustrating a work situation in which the shovel 100 is dragged forward.

As illustrated in FIG. 3, the shovel 100 is excavating a ground surface 30*a*. Mainly because of the closing movement of the arm 5 and the bucket 6, a force F2 is exerted on the ground surface 30*a* by the bucket 6 in an obliquely downward direction toward the body (the lower traveling body 1, the turning mechanism 2, and the upper turning body 3) of the shovel 100. At this time, a reaction force F3 of the force F2 against the bucket 6 acts on the body (the lower traveling body 1, the turning mechanism 2, and the upper turning body 3) of the shovel 100 through the attachment. Namely, the reaction force F3 corresponding to a horizontal component F2*a*H of an excavation reaction force F2*a* acts on the body of the shovel 100 through the attachment. If the reaction force F3 exceeds the maximum static friction force F0 between the shovel 100 and the ground surface 30*a*, the body of the shovel 100 would be dragged forward.

<Backward Dragging Movement>

Figure 4A:
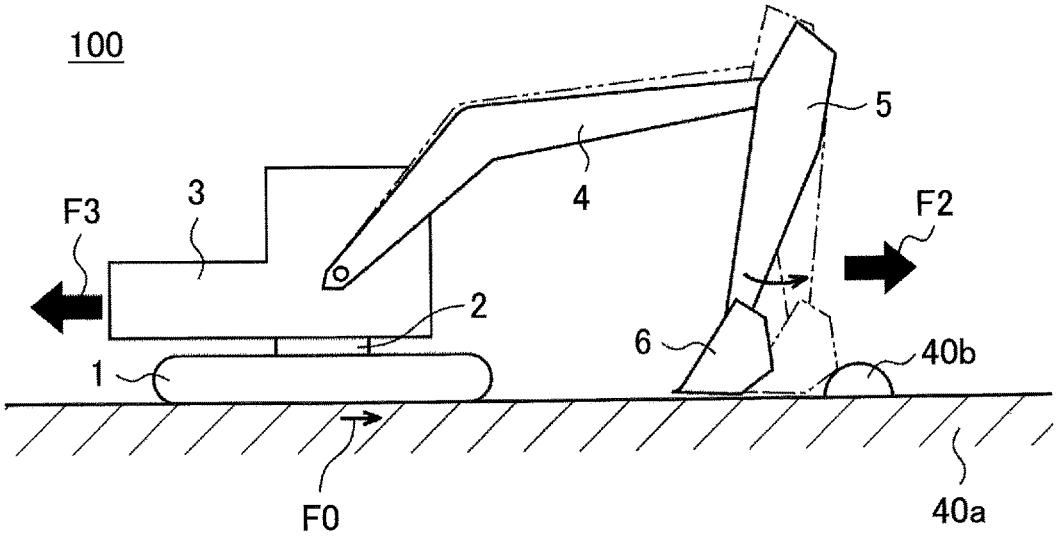
FIG. 4A is a drawing illustrating an example of an backward dragging movement of the shovel.
Figure 4B:
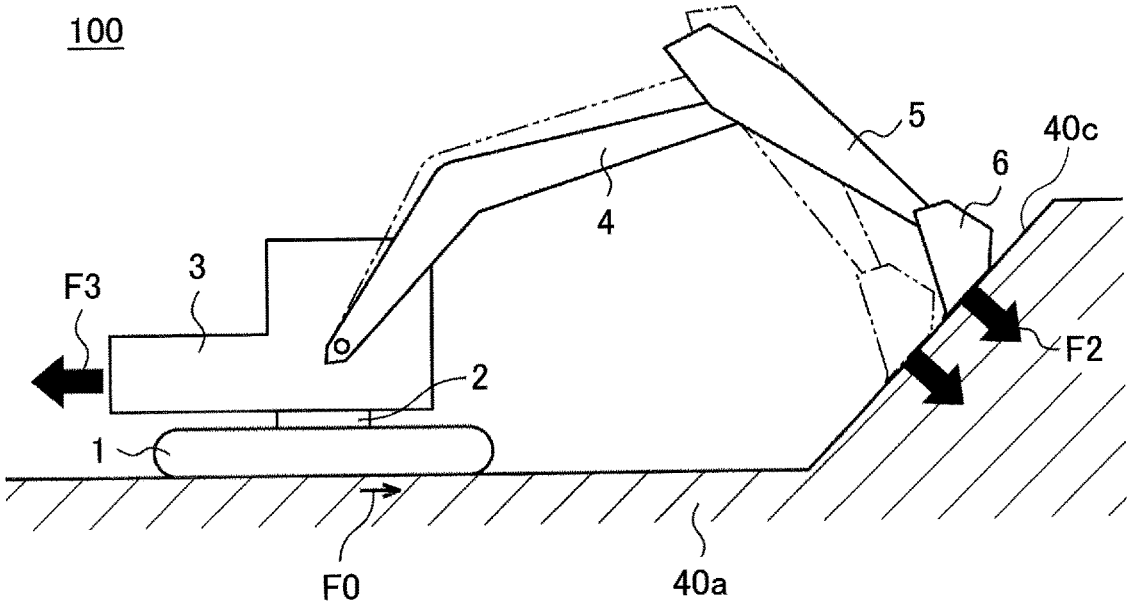
FIG. 4B is a drawing illustrating an example of the backward dragging movement of the shovel.

Next, FIG. 4A and FIG. 4B are drawings illustrating an example of the backward dragging movement of the shovel 100. More specifically, FIG. 4A and FIG. 4B are drawings illustrating work situations in which the shovel 100 is dragged backward.

As illustrated in FIG. 4A, the shovel 100 is leveling a ground surface 40*a*. A force F2 is generated mainly by opening the arm 5 so that the bucket 6 pushes sediment 40*b* forward. At this time, a reaction force F3 of the force F2 against the bucket 6 acts on the body of the shovel 100 through the attachment. If the reaction force F3 exceeds the maximum static friction force F0 between the shovel 100 and the ground surface 40*a*, the body of the shovel 100 would be dragged backward.

Further, as illustrated in FIG. 4B, the shovel 100 is performing river construction work. More specifically, in order to solidify sediment, the shovel 100 is pushing the bucket 6 against the surface 40*c* of a sloped bank by opening the arm 5. In such a construction work, a reaction force F3 of a force F2 against the bucket 6 acts on the body of the shovel 100 through the attachment. As a result, the body of the shovel 100 may be dragged backward.

<Front Lifting Movement>

Figure 5:
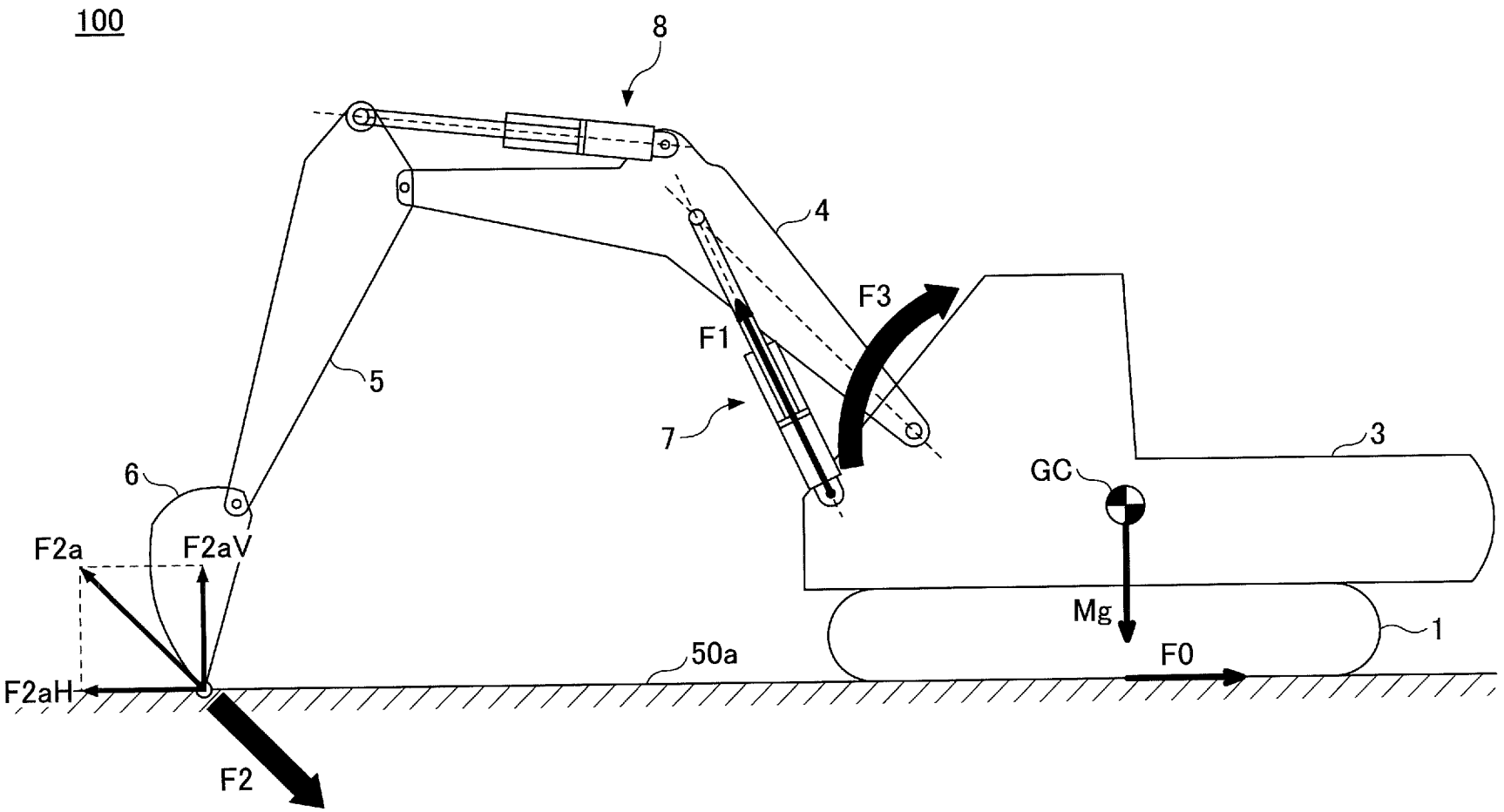
FIG. 5 is a drawing illustrating an example of a front lifting movement of the shovel.

Next, FIG. 5 is a drawing illustrating an example of the front lifting movement of the shovel 100. More specifically, FIG. 5 is a drawing illustrating a work situation in which the front of the shovel 100 is lifted.

As illustrated in FIG. 5, the shovel 100 is excavating a ground surface 50*a*. Mainly because of the closing movement of the arm 5 and the bucket 6, a force F2 is exerted on the ground surface 50*a* by the bucket 6 in an obliquely downward direction toward the body of the shovel 100. At this time, a reaction force F3 (a moment of force, which is hereinafter simply referred to as a "moment") of the force F2 against the bucket 6 acts on the body of the shovel 100 through the attachment which causes the body of the shovel 100 to be tiled backward. Namely, the reaction force F3 corresponding to a vertical component F2*a*V of an excavation reaction force F2*a* acts on the body of the shovel 100 through the attachment. Specifically, the reaction force F3 acts on the body of the shovel 100 as a force F1 that lifts the boom cylinder 7. If the moment caused by the force F1 exceeds a force (a moment) that pushes the body of the shovel 100 to the ground by gravity, the body of the shovel 100 would be lifted.

<Rear Lifting Movement>

Figure 6:
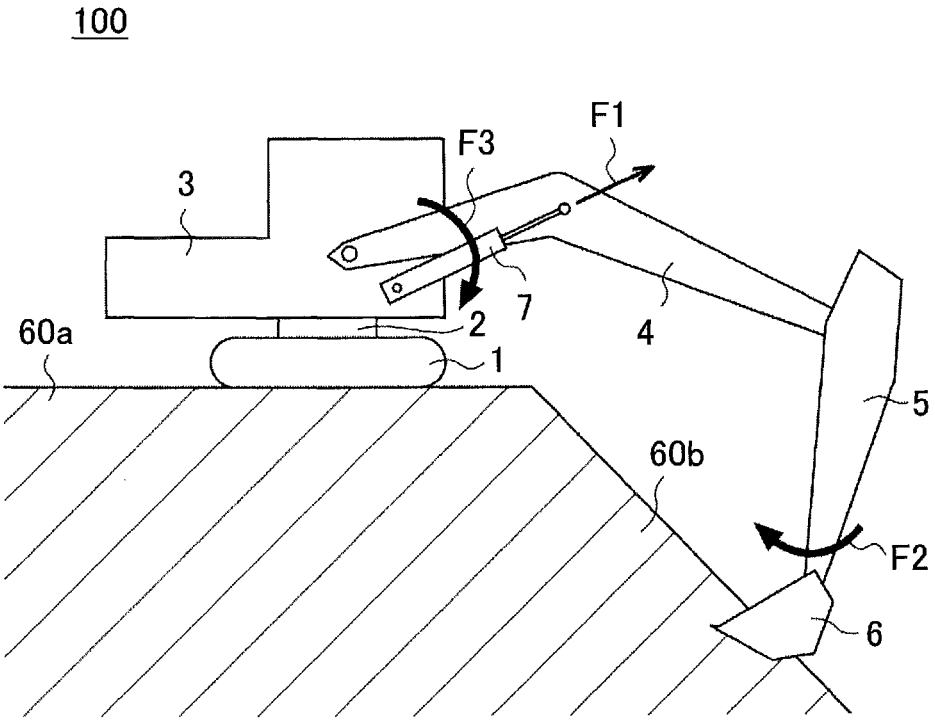
FIG. 6 is a drawing illustrating an example of a rear lifting movement of the shovel.

Next, FIG. 6 is a drawing illustrating an example of the rear lifting movement of the shovel 100. More specifically, FIG. 6 is a drawing illustrating a work situation in which the rear of the shovel 100 is lifted.

As illustrated in FIG. 6, the shovel 100 is excavating a ground surface 60*a*. A force F2 (a moment) that causes the bucket 6 to excavate a sloped surface 60*b* is generated. In addition, a force F3 (a moment) that causes the boom 4 to push the bucket 6 against the sloped surface 60*b* is generated. In other words, the force F3 (the moment) that causes the body of the shovel 100 to be tilted forward is generated. At this time, a force F1 that lifts the rod of the boom cylinder 7 is generated, and the force F1 acts to tilt the body of the shovel 100. If the moment, caused by the force F1, that tilts the body of the shovel 100 forward exceeds a force (a moment) that pushes the body of the shovel 100 to the ground by gravity, the rear of the shovel 100 would be lifted.

If the bucket 6 is in contact with the ground surface or an object, and is caught by or partially embedded into the ground surface or the object, the boom 4 does not move even if a force is exerted on the boom 4. Thus, the rod of the boom cylinder 7 would not be displaced. If the pressure in a contraction-side (in the present embodiment, rod-side) oil chamber of the boom cylinder 7 increases, the force F1 that lifts the boom cylinder 7 would increase, that is, the force that tilts the body of the shovel 100 forward would increase.

The above-described situation may occur when the bucket 6 is located below the body (lower traveling body 1) of the shovel 100 during deep excavation work, in addition to the leveling work of the front sloped surface as illustrated in FIG. 6. Further, the above-described situation may occur not only when the boom 4 is operated, but also when the arm 5 or the bucket 6 is operated.

<Vibration Movement>

Figure 7A:
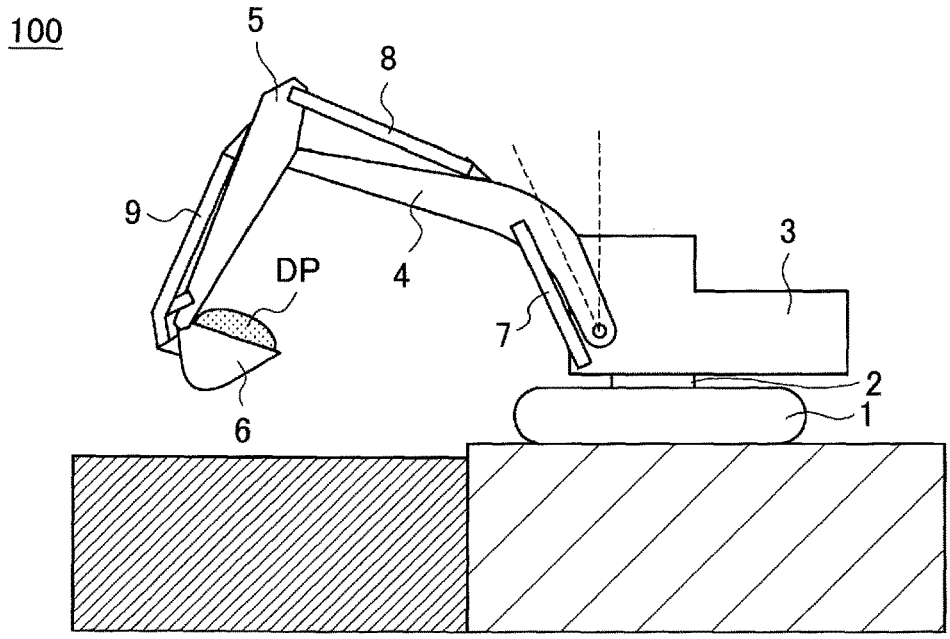
FIG. 7A is a drawing illustrating an example of a vibration movement of the shovel.
Figure 7B:
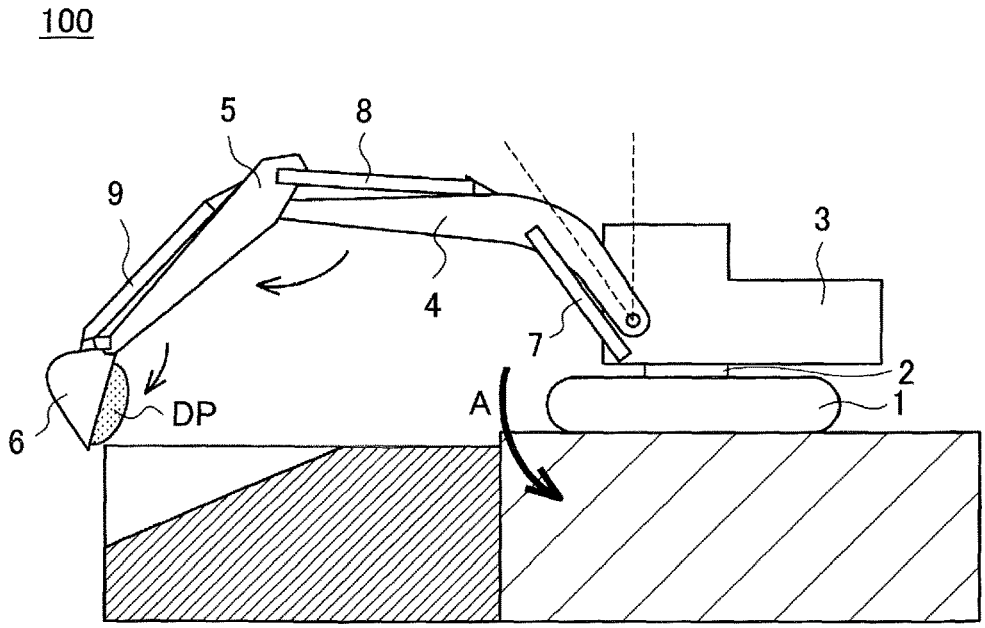
FIG. 7B is a drawing illustrating the example of the vibration movement of the shovel.
Figure 8A:
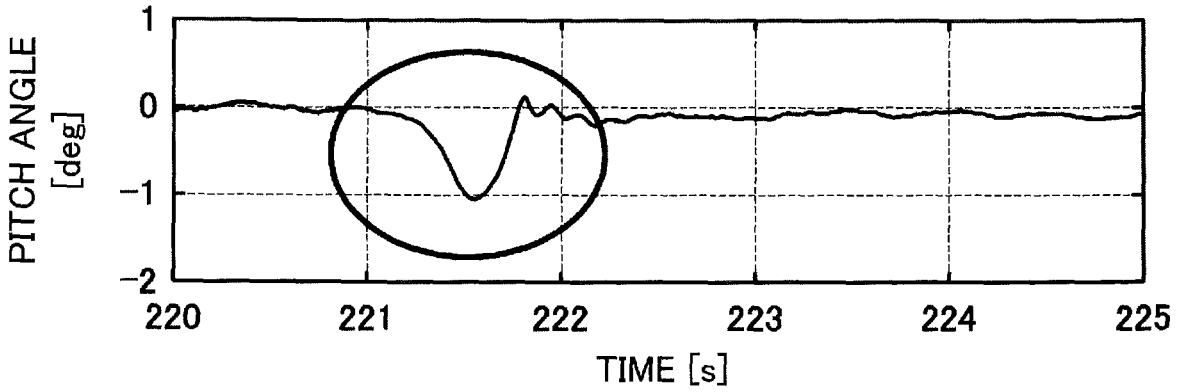
FIGS. 8A and 8B are graphs illustrating the example of vibration movement of the shovel.
Figure 8B:
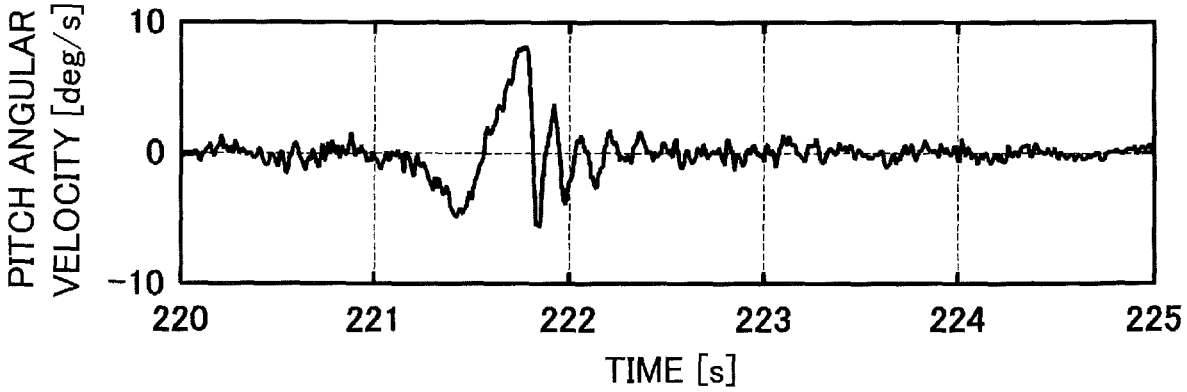
Figure 9A:
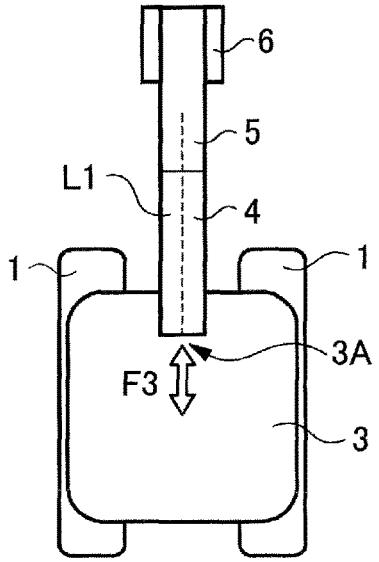
FIG. 9A is a drawing schematically illustrating a method for preventing an unintended movement of the shovel.
Figure 9B:
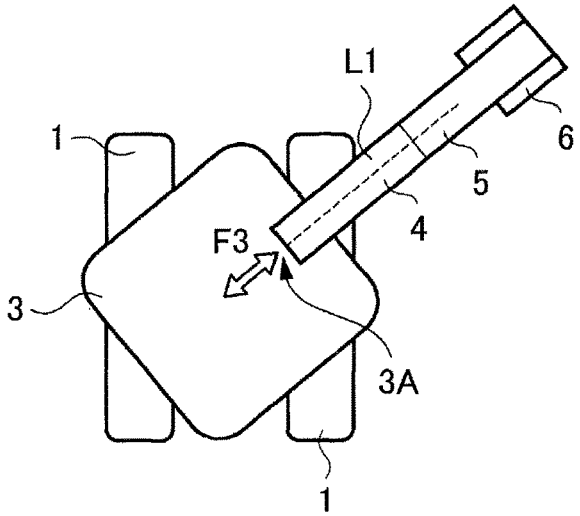
FIG. 9B is a drawing schematically illustrating the method for preventing the unintended movement of the shovel.
Figure 9C:
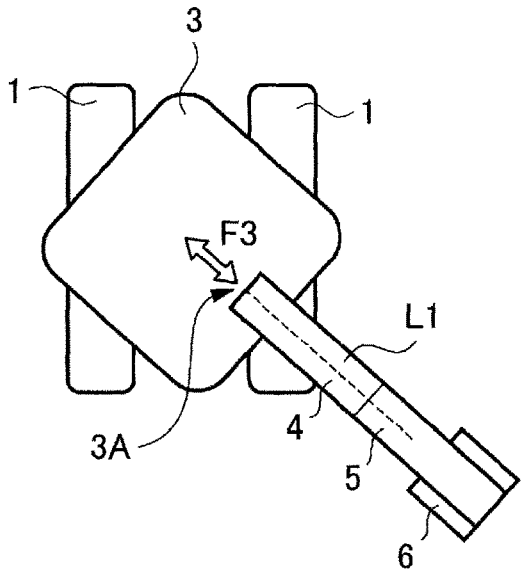
FIG. 9C is a drawing schematically illustrating the method for preventing the unintended movement of the shovel.
Figure 9D:
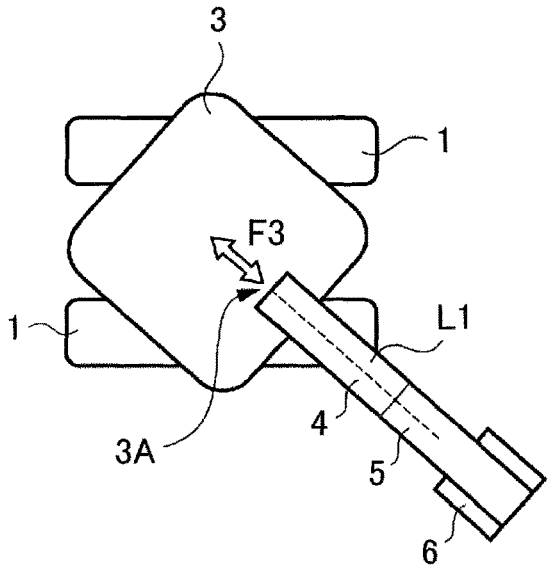
FIG. 9D is a drawing schematically illustrating the method for preventing the unintended movement of the shovel.

Next, FIG. 7A and FIG. 7B and FIG. 8A and FIG. 8B are drawings illustrating examples of vibration of the shovel 100. More specifically, FIG. 7A and FIG. 7B are diagrams illustrating an example situation in which the shovel 100 is vibrated when the attachment is being moved in the air. FIG. 8A is a graph illustrating a waveform of an angle about the pitch axis (a pitch angle) over time, and FIG. 8B is a graph illustrating a waveform of angular velocity (pitch angular velocity) over time during an discharge operation of the shovel 100 illustrated in FIG. 7A and FIG. 7B. In the present embodiment, as an example of the in-air movement of the attachment, a discharge movement for discharging a load placed in the bucket 6 will be described.

As illustrated in FIG. 7A, in the shovel 100, the bucket 6 and the arm 5 are closed, the boom 4 is raised, and load DP such as sediment is placed in the bucket 6.

When the shovel 100 performs a discharge operation from the state illustrated in FIG. 7A, the bucket 6 and the arm 5 are largely opened, the boom 4 is lowered, and the load DP is discharged from the bucket 6 to the outside, as illustrated in FIG. 7B. At this time, a change in the moment of inertia of the attachment causes the body of the shovel 100 to be vibrated in the pitch direction indicated by an arrow A in FIG. 7B.

As is seen from FIG. 8A and FIG. 8B, an overturning moment that causes the shovel 100 to turn over is generated during the aerial movement of the attachment, specifically during the discharge operation, thereby causing the body of the shovel 100 to be vibrated about the pitch axis.

[Method for Minimizing Unintended Movement of Shovel]

Next, referring to FIG. 9A through FIG. 18, a method for minimizing the above-described unintended movements of the shovel 100 will be described.

<Overview of Method for Minimizing Unintended Movement of Shovel>

First, FIG. 9A through FIG. 9D are drawings schematically illustrating methods for minimizing unintended movements of the shovel 100. More specifically, FIG. 9A through FIG. 9D are plan views of the shovel 100 viewed from above, in which combinations of the direction of the lower traveling body 1 and the turning angle of the upper turning body 3 are different from each other.

In plan view, the attachment, configured by the boom 4, the arm 5, and the bucket 6, is always operated on a line L1 that corresponds to the extending direction of the attachment, namely operated in the same vertical plane, regardless of the orientation and the operation of the attachment. Thus, it can be said that, when the attachment is in motion, a reaction force F3 is exerted on the body of the shovel 100 by the attachment in the vertical plane. This does not depend on the positional relationship (turning angle) between the lower traveling body 1 and the upper turning body 3. As illustrated in FIG. 3 through FIG. 7B, the direction of the reaction force F3 in plan view may differ depending on the operation content. That is, when the shovel 100 is subjected to an unintended movement such as dragging, lifting, or vibration, the unintended movement is caused by the movement of the attachment. Accordingly, the above-described unintended movements can be minimized by controlling the attachment.

<Method for Minimizing Dragging Movements>

Figure 10:
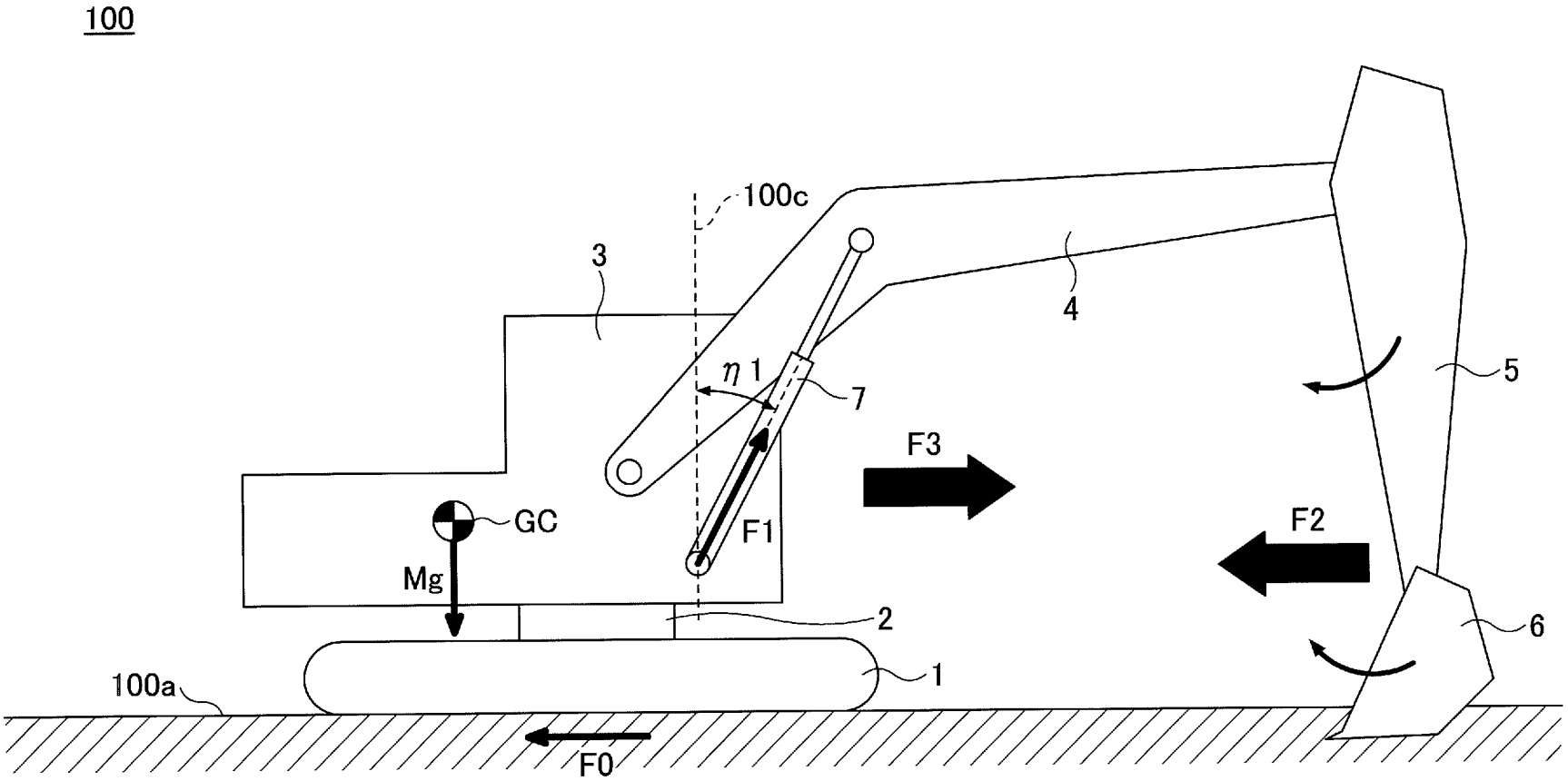
FIG. 10 is a drawing illustrating an example mechanical model of forward dragging.
Figure 11:
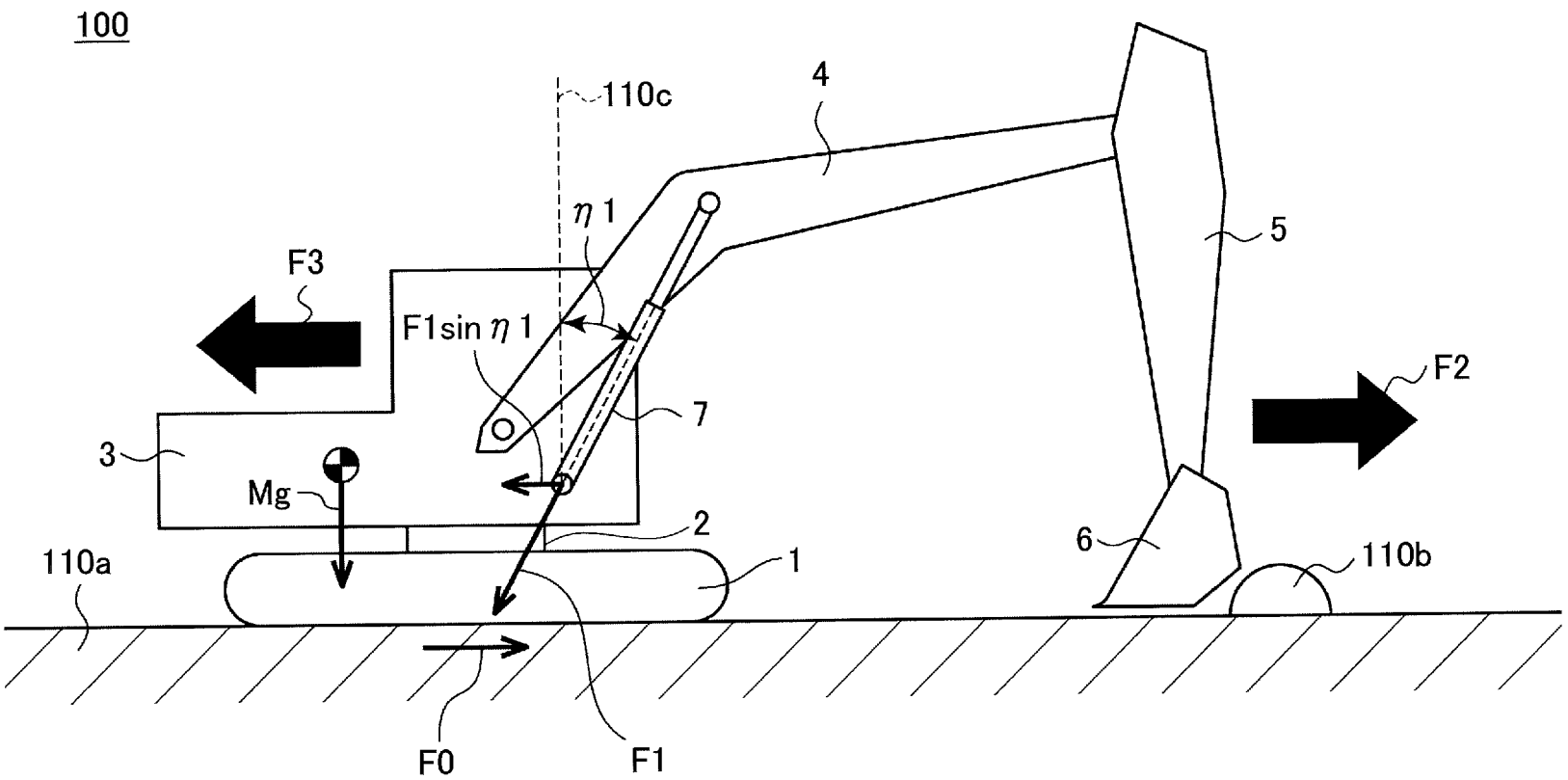
FIG. 11 is a drawing illustrating an example mechanical model of backward dragging.

FIG. 10 is a drawing schematically illustrating an example method for minimizing the forward dragging movement of the shovel 100. More specifically, FIG. 10 is a drawing illustrating an example mechanical model of the shovel 100 dragged forward. Similar to FIG. 3, FIG. 10 depicts a force acting on the shovel 100 when the shovel 100 is excavating a ground surface 100*a*. FIG. 11 is a drawing schematically illustrating an example method for minimizing the backward dragging movement of the shovel 100. More specifically, FIG. 11 is a drawing illustrating an example mechanical model of the shovel 100 dragged backward. Similar to FIG. 4A, FIG. 11 depicts a force acting on the shovel 100 when the shovel 100 is leveling a ground surface 110*a* by pushing sediment 110*b* forward.

As illustrated in FIG. 10 and FIG. 11, a force F3 that pushes the body (upper turning body 3) of the shovel 100 in the horizontal direction (either forward or backward) is expressed by the following equation (1).

$$F3=F1\sin\eta1 \tag{1}$$

In the above equation, η1 represents an angle formed by the boom cylinder 7 and a vertical axis 100*c* or 110*c*, F1 represents a force exerted on the upper turning body 3 by the boom cylinder 7, namely exerted on the body of the shovel 100 by the attachment.

The maximum static friction force F0 is expressed by the following equation (2).

$$F0=\mu Mg \tag{2}$$

In the above equation, μ represents a static friction coefficient between the lower traveling body 1 and each of the ground surfaces 100*a* and 110*a*, M represents a body mass, and g represents gravitational acceleration.

A condition in which the shovel 100 is not dragged by the reaction force F3 is expressed by the following inequality (3).

$$F3<F0 \tag{3}$$

By substituting the equations (1) and (2) into the inequality (3), the following inequality (4) is obtained.

$$F1\sin\eta1<\mu Mg \tag{4}$$

That is, the movement correcting unit 302 may correct the movement of the boom cylinder 7 such that the inequality (4) is established. As a result, it is possible to prevent the shovel 100 from being dragged backward.

For example, as indicated by the following equation (5), the force F1 is expressed by a function f with an argument PR that represents the pressure in the rod-side oil chamber (rod pressure) and an argument $P_B$ that represents the pressure in the bottom-side oil chamber (bottom pressure).

$$F1=f(PR,P_B) \tag{5}$$

The movement correcting unit 302 (force estimating unit) calculates (estimates) the force F1 by using the equation (5) based on the rod pressure $P_R$ and the bottom pressure $P_B$. At this time, the movement correcting unit 302 may obtain the rod pressure $P_R$ and the bottom pressure $P_B$, based on output signals of pressure sensors that detect the rod pressure and the bottom pressure of the boom cylinder 7. The pressure sensors may be included in the various types of sensors 32.

By way of example, the force F1 may be expressed by the following equation (6).

$$F1=AR\cdot P_R-AB\cdot P_B \quad (6)$$

In the above equation, AR represents a rod-side pressure receiving area, and AB represents a bottom-side pressure receiving area.

Accordingly, the movement correcting unit 302 (force estimating unit) may calculate (estimate) the force F1 based on the equation (6).

Further, the movement correcting unit 302 (angle calculating unit) calculates the angle η1 formed by the boom cylinder 7 and the vertical axis 100*c* or 110*c*. The angle η1 may be geometrically calculated based on the extension length of the boom cylinder 7, the size of the shovel 100, and the tilt of the body of the shovel 100. For example, the movement correcting unit 302 may calculate the angle η1 based on the output of a sensor that detects the boom angle. The sensor that detects the boom angle may be included in the various types of sensors 32.

Note that the angle η1 may be obtained from the output of a sensor that directly measures the angle η1. The sensor that directly measures the angle η1 may be included in the various types of sensors 32.

The movement correcting unit 302 (pressure controlling unit) controls the pressure of the boom cylinder 7, based on the obtained (calculated) force F1 and the angle η1, such that the inequality (4) is established. More specifically, the movement correcting unit 302 controls excessive one of either the pressure of the rod-side oil chamber or the pressure of the bottom-side oil chamber. That is, the movement correcting unit 302 (pressure controlling unit) controls either the rod pressure $P_R$ or the bottom pressure $P_B$, such that the inequality (4) is established. More specifically, by employing various configurations (see FIG. 26A through FIG. 34), which will be described below, it becomes possible for the movement correcting unit 302 to control the pressure of the boom cylinder 7 by outputting a control command to a control target. Accordingly, the dragging of the shovel 100 is minimized.

Note that the static friction coefficient μ in the inequality (4) may be a given typical value, or may be input by the operator in accordance with the conditions of the ground surface at the work site. Alternatively, the shovel 100 may further include an estimation device for estimating the static friction coefficient μ. Specifically, the estimation device may calculate the static friction coefficient μ, based on the force F1 exerted by the attachment and causing the stationary shovel 100 to slide (to be dragged). As will be described below, the occurrence of dragging can be determined by mounting an acceleration sensor or any other sensor on the upper turning body 3, as necessary.

<Method for Minimizing Lifting Movement>

Figure 12:
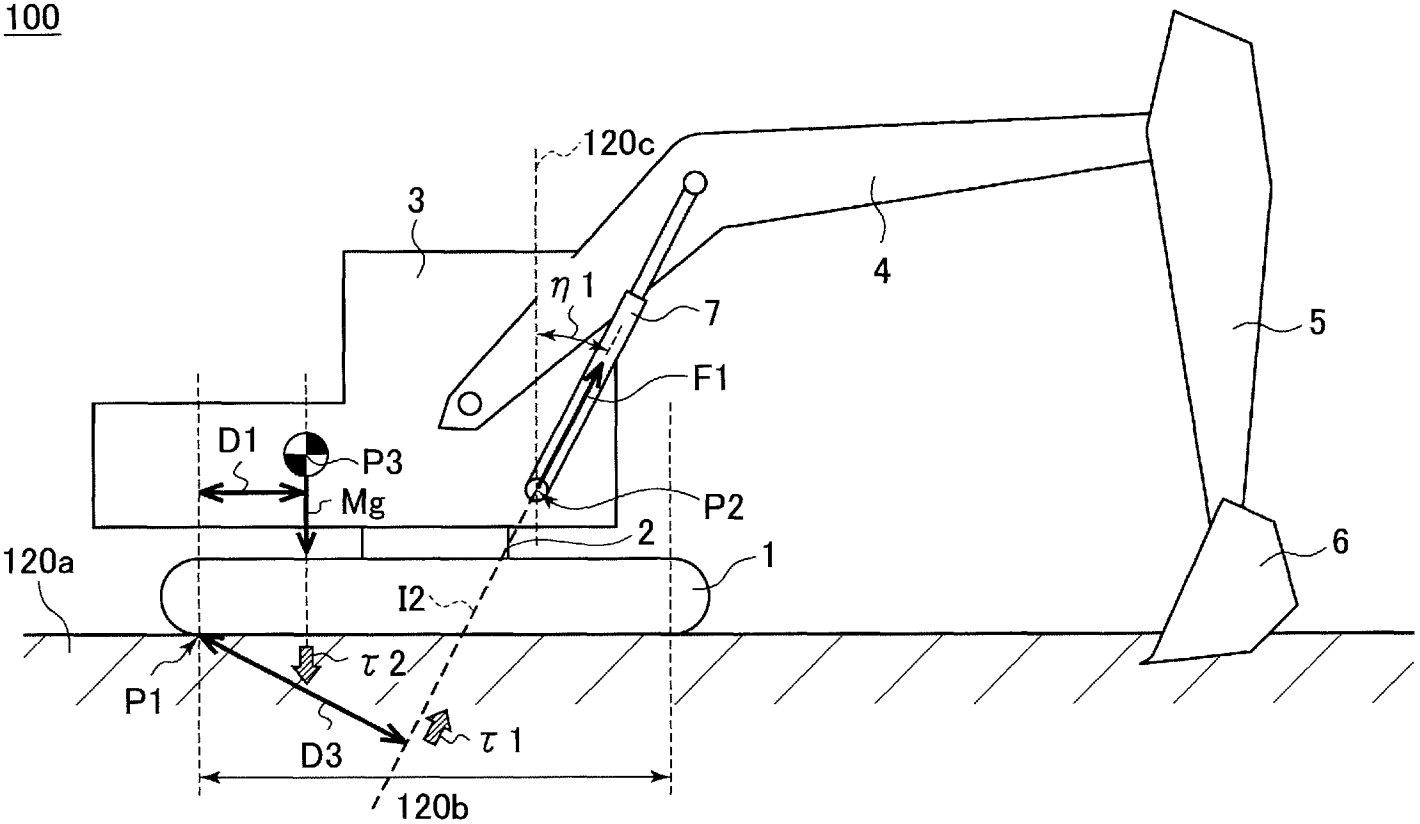
FIG. 12 is a drawing schematically illustrating an example mechanical model of the lifting of the front of the shovel.

Next, FIG. 12 is a drawing schematically illustrating an example method for minimizing the lifting movement in which the front of the shovel 100 is lifted. More specifically, FIG. 12 is a drawing illustrating a mechanical model of the lifting movement in which the front of the shovel 100 is lifted. Similar to FIG. 5, FIG. 12 depicts a force acting on the shovel 100 when the shovel 100 is excavating a ground surface 120*a*.

As illustrated in FIG. 12, a tipping fulcrum P1 of the shovel 100 may be regarded as the rearmost end of an effective grounding area 120*b* of the lower traveling body 1 in the extending direction of the attachment (the direction of the upper turning body 3). Accordingly, a moment τ1 that lifts the front of the shovel 100 about the tipping fulcrum P1 is expressed by the following equation (7), based on the force F1 and also the distance D3 between an extension line 12 of the boom cylinder 7 and the tipping fulcrum P1.

$$\tau1=D3\cdot F1 \quad (7)$$

A moment τ2 that pushes the body of the shovel 100 to the ground about the tipping fulcrum P1 is expressed by the following equation (8), based on the distance D1 between the center of gravity P3 and the rear tipping fulcrum P1 of the lower traveling body 1, the body mass M, and the gravitational acceleration g.

$$\tau2=D1\cdot Mg \quad (8)$$

A condition for stabilizing the body of the shovel 100 without lifting the front of the shovel 100 is expressed by the following inequality (9).

$$\tau1<\tau2 \quad (9)$$

By substituting the equations (7) and (8) into the inequality (9), the following inequality (10) is obtained as a stability condition.

$$D3\cdot F1<D1\cdot Mg \quad (10)$$

That is, the movement correcting unit 302 may correct the movement of the attachment such that the inequality (10) serving as the stability condition is established. As a result, the lifting of the front of the shovel 100 is prevented.

Figure 13:
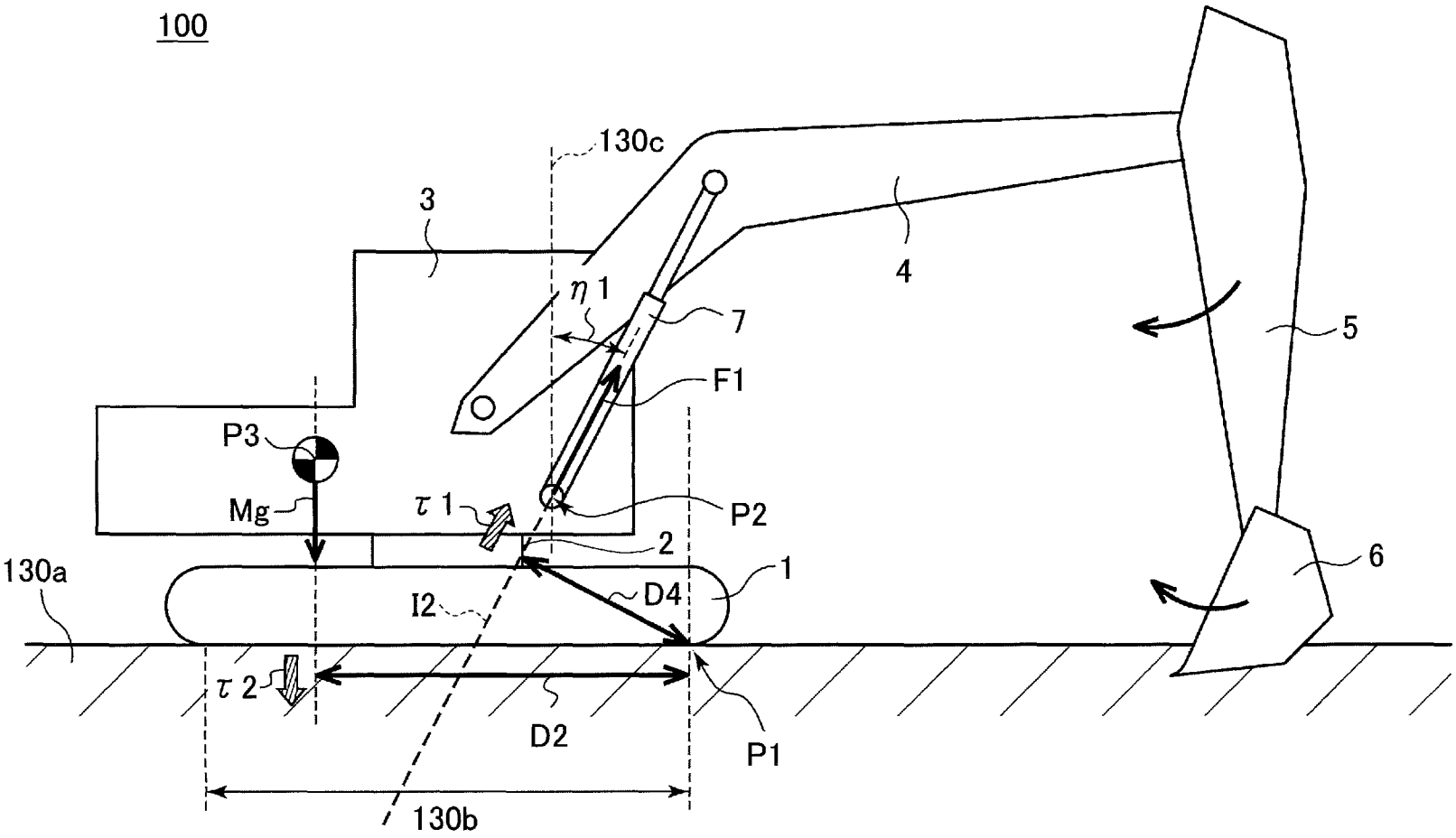
FIG. 13 is a drawing schematically illustrating an example mechanical model of the lifting of the rear of the shovel.

Further, FIG. 13 is a drawing illustrating a mechanical model of the movement in which the rear of the shovel 100 is lifted. Similar to FIG. 6, FIG. 13 depicts a force acting on the shovel 100 when the shovel 100 is excavating a ground surface 130*a*.

A tipping fulcrum P1 of the shovel 100 may be regarded as the frontmost end of an effective grounding area 130*b* of the lower traveling body 1 in the extending direction of the attachment (the direction of the upper turning body 3). Accordingly, a moment τ1 that lifts the rear of the shovel 100 about the tipping fulcrum P1 is expressed by the following equation (11), based on the force F1 and the distance D4 between an extension line 12 of the boom cylinder 7 and the tipping fulcrum P1.

$$\tau1=D4\cdot F1 \quad (11)$$

A moment τ2 that pushes the body of the shovel 100 to the ground about the tipping fulcrum P1 is expressed by the following equation (12), based on the distance D2 between the center of gravity P3 and the front tipping fulcrum P1 of the lower traveling body 1, the body mass M, and the gravitational acceleration g.

$$\tau2=D2\cdot Mg \quad (12)$$

Similar to the inequality (9), a condition for stabilizing the body of the shovel 100 without lifting the rear of the shovel 100 is expressed by the following inequality (13).

$$\tau1<\tau2 \quad (13)$$

By substituting the equations (11) and (12) into the inequality (13), the following inequality (14) is obtained as a stability condition.

$$D4\cdot F1<D2\cdot Mg \quad (14)$$

That is, the movement correcting unit 302 may correct the movement of the attachment such that the inequality (14) serving as the stability condition is established. As a result, the lifting of the rear of the shovel 100 is prevented.

Further, by replacing the distances D1 and D3 with DA, replacing the distances D2 and D4 with DB, and using the front tipping fulcrum P1 and the rear tipping fulcrum P1, a condition for controlling (stabilizing) the front lifting and the rear lifting are expressed by the following expression (15).

$$DB \cdot F1 < DA \cdot Mg \quad (15)$$

For example, similar to the above-described equation (5), as indicated by the following equation (16), the force F1 is expressed by a function f with the arguments of the rod pressure $P_R$ and the bottom pressure $P_B$ of the boom cylinder 7.

$$F1 = f(P_R, P_B) \quad (16)$$

The movement correcting unit 302 (force estimating unit) calculates (estimates) the force F1 exerted on the upper turning body 3 by the boom cylinder 7, based on the rod pressure $P_R$ and the bottom pressure $P_B$. At this time, the movement correcting unit 302 may obtain the rod pressure $P_R$ and the bottom pressure $P_B$, based on output signals of pressure sensors that detect the rod pressure and the bottom pressure of the boom cylinder 7. The pressure sensors may be included in the various types of sensors 32.

By way of example, similar to the above-described equation (6), the force F1 may be expressed by the following equation (17).

$$F1 = AR \cdot P_R - AB \cdot P_B \quad (17)$$

In the above equation, AR represents a rod-side pressure receiving area, and AB represents a bottom-side pressure receiving area.

Accordingly, the movement correcting unit 302 (force estimating unit) may calculate (estimate) the force F1 based on the equation (17).

Further, the movement correcting unit 302 (distance obtaining unit) obtains the distances D2 and D4. Alternatively, the movement correcting unit 302 (distance obtaining unit) may obtain the ratio of D1 to D3 or the ratio of D2 to D4.

The position of the center of gravity P3 of the body of the shovel 100 excluding the attachment is fixed, irrespective of the turning angle θ of the upper turning body 3, while the position of the tipping fulcrum P1 changes in accordance with the turning angle θ. Accordingly, the distances D1 and D2 may actually vary in accordance with the turning angle θ of the upper turning body 3. However, in the simplest manner, the distances D1 and D2 may be treated as constants.

The distances D3 and D4 may be geometrically calculated based on the position of the tipping fulcrum P1 and the angle of the boom cylinder 7 (for example, an angle η1 formed by the boom cylinder 7 and a vertical axis 130*c*).

The angle η1 may be geometrically calculated based on the extension length of the boom cylinder 7, the size of the shovel 100, and the tilt of the body of the shovel 100. For example, the movement correcting unit 302 may calculate the angle η1 based on the output of a sensor that detects the boom angle. The sensor that detects the boom angle may be included in the various types of sensors 32.

Note that the angle η1 may be obtained from the output of a sensor that directly measures the angle η1. The sensor that directly measures the angle η1 may be included in the various types of sensors 32.

The movement correcting unit 302 (pressure controlling unit) controls the pressure of the boom cylinder 7, specifically controls excessive one of the pressure of the rod-side oil chamber or the pressure of the bottom-side oil chamber, based on the obtained force F1 and either the distances D1 and D3 or the distances D2 and D4, such that the inequality (15), namely the inequality (10) or (14) is established. That is, the movement correcting unit 302 (pressure controlling unit) controls either the rod pressure $P_R$ or the bottom pressure $P_B$ of the boom cylinder 7, such that the inequality (15) is established. More specifically, by employing various configurations (see FIG. 26A through FIG. 34), which will be described below, it becomes possible for the movement correcting unit 302 to control the pressure of the boom cylinder 7 by outputting a control command to a control target, as necessary. Accordingly, the lifting of the shovel 100 is minimized.

<Method for Minimizing Lifting Movement by Taking into Account Changes in Tipping Fulcrum>

In the above description, changes in the tipping fulcrums P1 are not considered. However, because the positions of the tipping fulcrums P1 may change as described above, changes in the positions of the tipping fulcrums P1 may be taken into account. In the following, referring to FIG. 14A through FIG. 16, a method for minimizing the lifting movement by taking into account a change in a tipping fulcrum will be described.

As described above, the control condition (stability condition) in which the front and the rear of the shovel 100 are not lifted is the inequality (15), namely the inequality (10) and the inequality (14). In the inequality (10) and the inequality (14), the distances D1, D2, D3, and D4 are used as parameters, and these distances depend on the position of a tipping fulcrum P1.

Figure 14A:
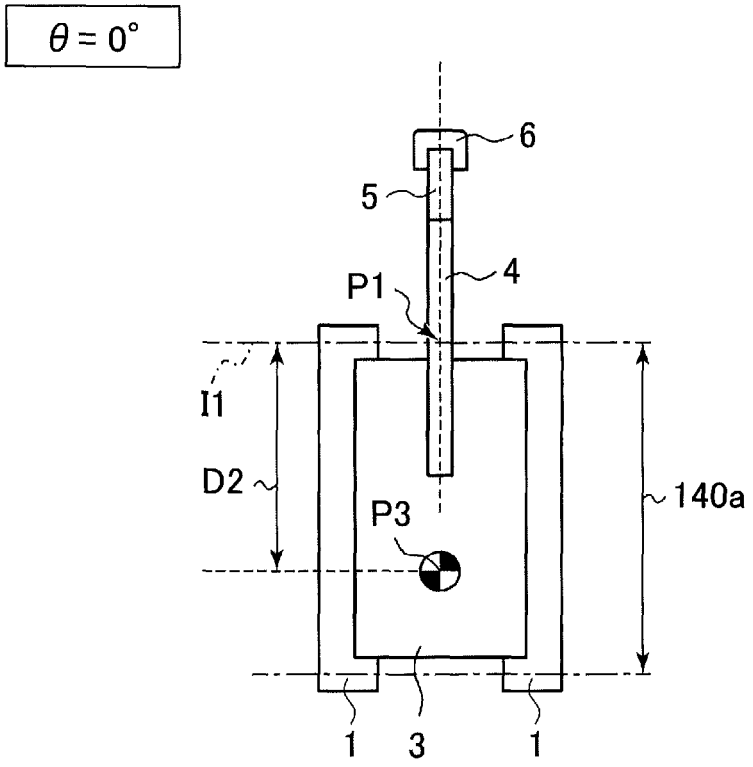
FIG. 14A is a drawing illustrating the relationship between a tipping fulcrum and the direction of an upper turning body.
Figure 14B:
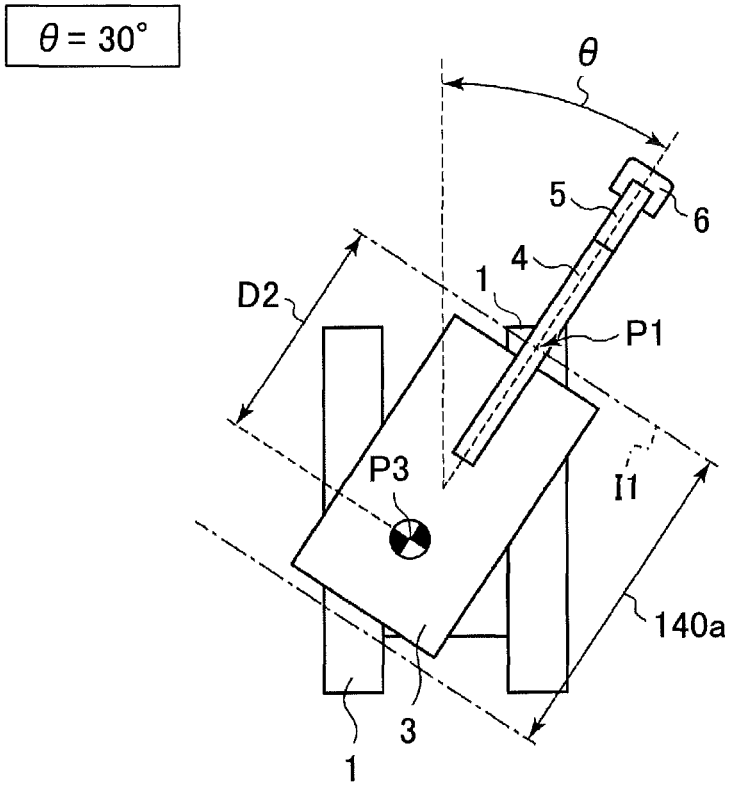
FIG. 14B is a drawing illustrating the relationship between the tipping fulcrum and the direction of the upper turning body.
Figure 14C:
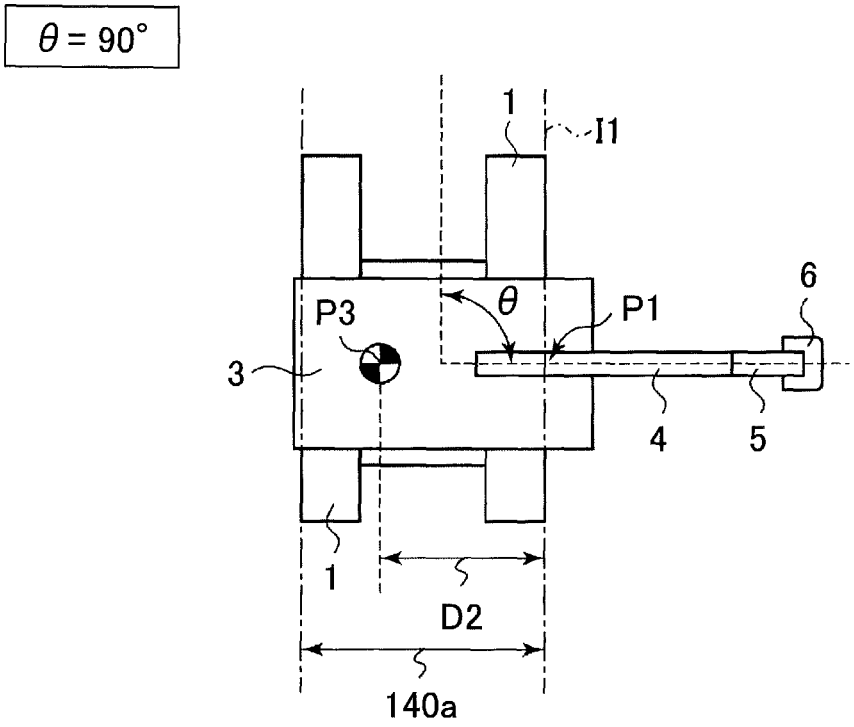
FIG. 14C is a drawing illustrating the relationship between the tipping fulcrum and the direction of the upper turning body.
Figure 15:
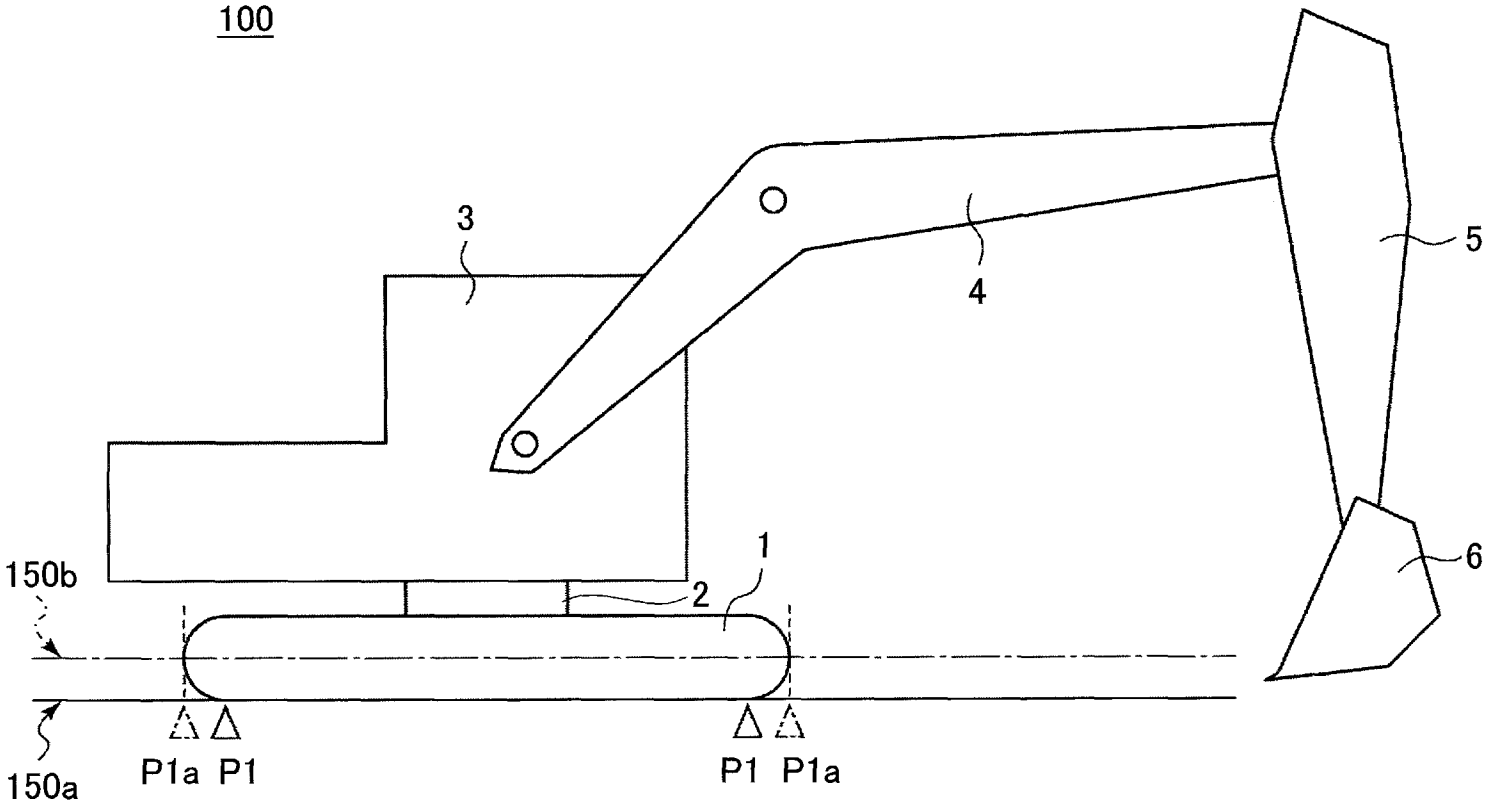
FIG. 15 is a drawing illustrating the relationship between a tipping fulcrum and the conditions of the ground surface.

FIG. 14A through FIG. 14C are drawings illustrating the relationship between a tipping fulcrum P1 and the direction (turning angle θ) of the upper turning body 3. In FIG. 14A through FIG. 14C, the turning angle θ is assumed to be 0° when the extending direction of the attachment (the direction of the attachment) is the same as the direction (the traveling direction) of the lower traveling body 1, and turning to the right is assumed to be the positive direction. More specifically, FIG. 14A, FIG. 14B, and FIG. 14C respectively depict the tipping fulcrum P1 when the turning angle θ is 0°, 30°, and 90°. Further, FIG. 15 is a drawing illustrating the relationship between the tipping fulcrum P1 and conditions of a ground surface 150*a* (work site).

In FIG. 14A through FIG. 14C, it is assumed that the rear of the shovel is lifted, and the tipping fulcrum P1 is located on the front of the shovel. Further, a line 11 is orthogonal to the extending direction of the attachment (the direction of the upper turning body 3), and passes through the frontmost end of an effective ground contact area 140*a* in the extension direction of the attachment 12. The tipping fulcrum P1 is on the line 11. Further, in FIG. 15, the continuous line indicates the hard ground surface 150*a*, and the dash-dot line indicates the soft ground surface 150*b*.

As illustrated in FIG. 14A through FIG. 14C and FIG. 15, the tipping fulcrum P1 moves in accordance with the direction of the upper turning body 3 and also the conditions of the ground surface.

For example, as illustrated in FIG. 14A through FIG. 14C, as the tipping fulcrum P1 moves, the distance D2 changes. Similarly, as the tipping fulcrum P1 moves, the distance D4 changes.

Further, as illustrated in FIG. 15, on the hard ground surface 150*a*, the tipping fulcrum is located at a position P1 indicated by the continuous triangle. On the soft ground surface 150*b*, the tipping fulcrum is located at a position P1*a* indicated by the dash-dot line triangle. Moreover, if there is a hard obstacle near the tipping fulcrum P1 at the work site, or if the lower traveling body 1 rides on an obstacle, the tipping fulcrum P1 may be moved further.

The change in the position of the tipping fulcrum P1 affects the distances D1 to D4, and affects the mechanical stability condition in which the body of the shovel 100 does not fall. Accordingly, the movement correcting unit 302 may set the control condition (stability condition) in accordance with the position of the tipping fulcrum P1, and correct the movement of the attachment based on the set control condition, so as to minimize the lifting of the body of the shovel 100.

For example, as will be described below, the movement determining unit 301 monitors the state of the body or the attachment based on the inputs from the various types of sensors 32, and identifies a moment of time when the front or the rear of the lower traveling body 1 is lifted. Then, the movement correcting unit 302 dynamically changes the control condition (stability condition) used to correct the movement of the attachment, that is, the inequality (10) and the inequality (14), based on the state of the shovel 100 at a moment of time when the body of the shovel 100 (the lower traveling body 1) is lifted.

A moment of time when the body of the shovel 100 is lifted may be approximated as the state in which the moment $\tau 1$, caused by the force F1 exerted by the attachment and tilting the body, is balanced with the moment $\tau 2$, caused by gravity acting against the force F1. Therefore, by monitoring the state of the shovel 100 and identifying a moment of time when the body of the shovel 100 is lifted, it is possible to minimize the lifting of the body of the shovel 100 in a variety of applications.

The movement determining unit 301 identifies (detects) a moment of time when the shovel 100 (the lower traveling body 1) is lifted, based on the outputs of the various types of sensors 32. For example, a sensor may detect the rotation about the pitch axis and identify a moment of time when the body of the shovel 100 is lifted, based on the outputs of an orientation sensor (an inclination angle sensor), a gyro sensor (an angular acceleration sensor), an acceleration sensor, and an IMU, which may be mounted on the upper turning body 3 and included in the various types of sensors 32.

For example, the movement correcting unit 302 (condition setting unit) sets the control condition for minimizing the lifting of the rear of the body, if the movement determining unit 301 detects the angular acceleration or the angular velocity in the forward direction, based on the outputs of the various types of sensors 32. Further, the movement correcting unit 302 (the control condition setting unit) sets the control condition for minimizing the lifting of the front of the body, if the movement determining unit 301 (condition setting unit) detects the angular acceleration or the angular velocity in the backward direction, based on the outputs of the various types of sensors 32.

The movement correcting unit 302 (condition setting unit) acquires the force F1 (F1_INIT) exerted by the boom cylinder 7 on the upper turning body 3 at a moment of time when lifting is detected (identified) by the movement determining unit 301. Then, the movement correcting unit 302 (condition setting unit) acquires parameters related to the position of the tipping fulcrum P1 based on the acquired F1_INIT, and also sets the control condition based on the parameters.

For example, as the control condition for minimizing the lifting of the front of the body, the above-described inequality (10) is used.

If backward rotation about the pitch axis, which corresponds to the lifting of the front of the body, is detected by the movement determining unit 301, the moment $\tau 1$ and the moment $\tau 2$ are balanced at a moment when the front of the body is lifted. Therefore, the following equation (18) is established.

$$D3 \cdot F1_INIT = D1 \cdot Mg \tag{18}$$

Because the force F1_INIT, the body mass M, and the gravitational acceleration g are known, the equation (18) is considered to be satisfied by the distances D1 and D3 in the current situation where the shovel 100 is used.

With the known equation (18), the distances D1 and D3 are geometrically uniquely determined. Therefore, the movement correcting unit 302 (condition setting unit) acquires the current distances D1 and D3 (distances D1 DET and D3 DET), based on the equation (18) and the orientation of the attachment.

Note that acquiring the distance D1 is equivalent to acquiring position information of the tipping fulcrum P1. Because the position of the center of gravity P3 does not change, the position of the tipping fulcrum P1 can be uniquely determined once the distance D1 is acquired.

The movement correcting unit 302 (condition setting unit) sets the following inequality (19) as the subsequent control condition.

$$D3_DET \cdot F1 < D1_DET \cdot Mg \tag{19}$$

The movement correcting unit 302 (condition setting unit) corrects the movement of the attachment based on the control condition represented by the inequality (19).

As long as the direction of the upper turning body 3 does not change and also the conditions of the ground do not change, the distance D1 does not change, and thus, the same value can be used, once acquired. Conversely, the distance D3 varies in accordance with the raising and lowering of the boom 4. Therefore, when the angle of the boom 4 changes, the movement correcting unit 302 (condition setting unit) changes the distance D3 accordingly, and applies the change to the control condition.

The lifting of the rear of the body is controlled in a similar manner. For example, the above-described inequality (14) is used as the control condition for minimizing the lifting of the rear of the body.

If forward rotation about the pitch axis, which corresponds to the lifting of the rear of the body, is detected by the movement determining unit 301, the moment $\tau 1$ and the moment $\tau 2$ are balanced at a moment of time when the rear of the body is lifted. Therefore, the following equation (20) is established.

$$D4 \cdot F1_INIT = D2 \cdot Mg \tag{20}$$

Because the F1_INIT, the body mass M, and the gravitational acceleration g are known, the equation (20) is considered to be satisfied by the distances D2 and D4 in the current situation where the shovel 100 is used.

The movement correcting unit 302 (condition setting unit) acquires the current distances D2 and D4 (distances D2_DET and D4_DET) based on the equation (20) and the orientation of the attachment.

Note that acquiring the distance D2 is equivalent to acquiring position information of the tipping fulcrum P1.

Then, the movement correcting unit 302 (condition setting unit) sets the following inequality (21) as the subsequent control condition, based on the above-described inequality (14).

$$D2_DET \cdot F1 < D4_DET \cdot Mg \tag{21}$$

The movement correcting unit 302 corrects the movement of the attachment based on the control condition represented by the inequality (21).

As long as the direction of the upper turning body 3 does not change and also the conditions of the ground do not change, the distance D2 does not change, and thus, the same value can be used, once acquired. Conversely, the distance D4 varies in accordance with the raising and lowering of the boom 4. Therefore, when the angle of the boom 4 changes, the movement correcting unit 302 (condition setting unit) changes the distance D4 accordingly, and applies the change to the control condition.

Figure 16:
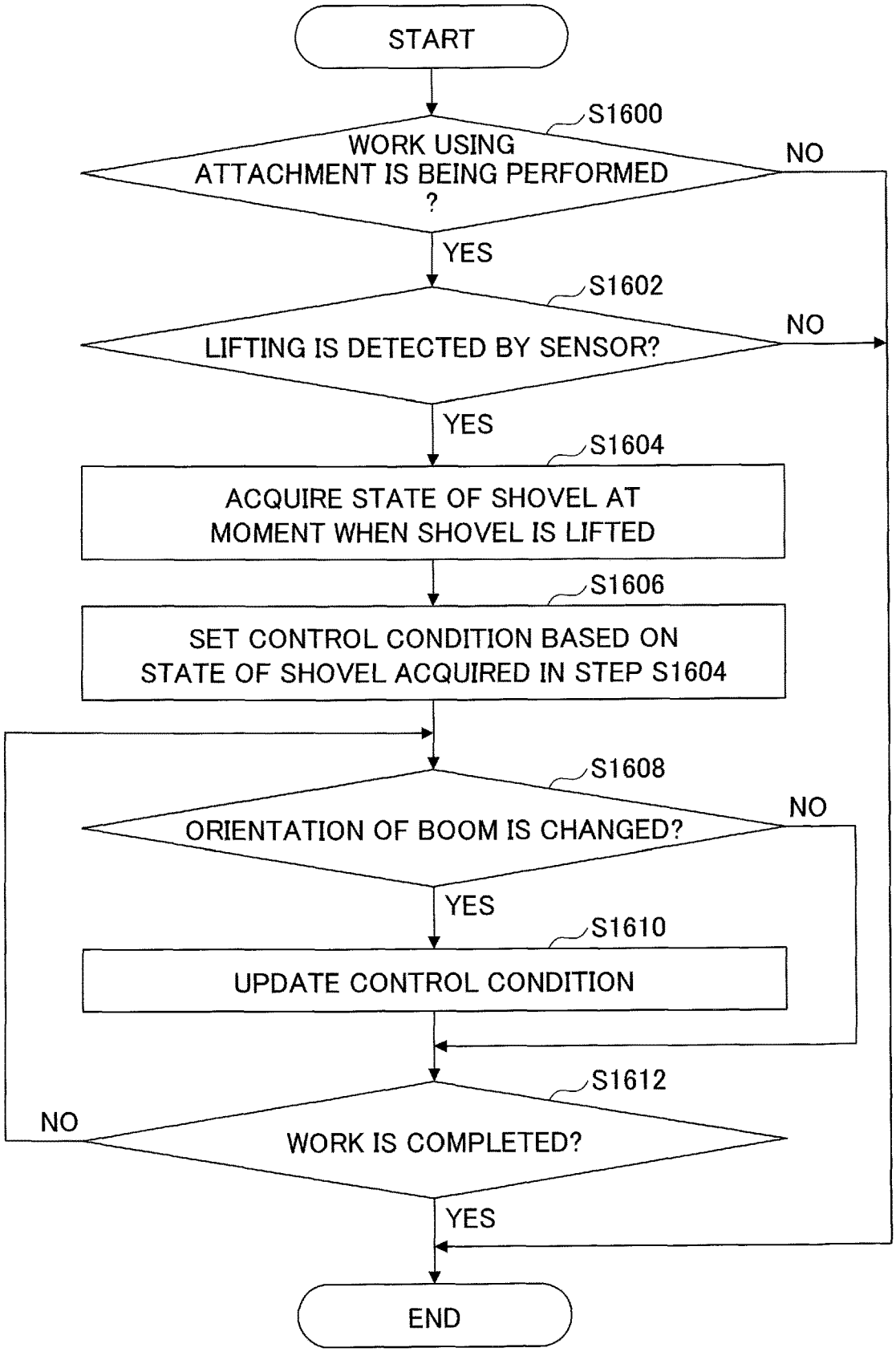
FIG. 16 is a flowchart illustrating an example of a process performed by a controller to set a control condition when lifting is detected.

FIG. 16 is a flowchart schematically illustrating a process (condition setting process) performed by the controller 30 (the movement determining unit 301 and the movement correcting unit 302) to set a control condition. This process may be performed periodically or at predetermined intervals after the shovel is started to be operated until stopped.

In step S1600, the movement determining unit 301 determines whether excavation work using the attachment is being performed. The movement determining unit 301 may determine that excavation work using the attachment is being performed when the shovel is not traveling and turning, and the pressure of any or all of the boom cylinder 7, the arm cylinder 8, and the bucket cylinder 9 are greater than or equal to a predetermined pressure. When the movement determining unit 301 determines that excavation work using the attachment is being performed, the process proceeds to step S1602. When it is determined that excavation work using the attachment is not being performed, the process ends.

Note that the excavation work includes leveling work and backfilling work.

In step S1602, the movement determining unit 301 monitors the occurrence of lifting of the shovel 100. When the movement determining unit 301 identifies (detects) lifting, the process proceeds to step S1604. When the movement determining unit 301 identifies (detects) no lifting, the process ends.

In step S1602 in which the control condition has not been set, the body of the shovel 100 is lifted for a moment. If an appropriate combination of a processor and a software program is used in the controller 30, the control condition can be set in a very short period of time after the lifting of the body is identified (detected) in step S1602, without causing the body of the shovel 100 to be largely tilted. The movement correcting unit 302 can start to correct the movement of the attachment before the body of the shovel 100 is largely tilted.

In step S1604, the movement correcting unit 302 acquires information related to the state of the shovel 100 at a moment of time when the body of the shovel 100 is lifted. Examples of the information related to the state of the shovel 100 include the above-described F1_INIT.

In step S1606, the movement correcting unit 302 calculates parameters related to the tipping fulcrum P1, such as the distances D1 through D4, and sets a control condition based on the information related to the state of the shovel 100 acquired in step S1604. Thereafter, the movement correcting unit 302 corrects the movement of the attachment based on the set control condition until the excavation work is completed, as long as the control condition is not updated in S1610.

In step S1608, the movement determining unit 301 determines whether the orientation of the boom 4 is changed. When the movement determining unit 301 determines that the orientation of the boom 4 is changed, the process proceeds to step S1610. When the movement determining unit 301 determines that the orientation of the boom 4 is not changed, the process proceeds to step S1612.

In step S1610, because the distances D3 and D4 are changed in accordance with the change in the orientation of the boom 4, the movement correcting unit 302 updates the control condition.

In step S1612, the movement determining unit 301 determines whether the excavation work is completed. When the movement determining unit 301 determines that the excavation work is not completed, the process returns to step S1608. When the movement determining unit 301 determines that the excavation work is completed, the process ends.

In the present embodiment, the control condition is defined by calculating the distances D1 through D4; however, the present invention is not limited thereto. For example, by changing the inequality (10) and the inequality (14), the following inequality (22) and (23) are obtained.

$$F1<D1/D3\cdot Mg \tag{22}$$

$$F1<D2/D4\cdot Mg \tag{23}$$

The following equations (24) and (25) are established at a moment of time when the body is lifted.

$$F1_INIT=D1/D3\cdot Mg \tag{24}$$

$$F1_INIT=D2/D4\cdot Mg \tag{25}$$

Accordingly, the movement correcting unit 302 (condition setting unit) may acquire the force 1_INIT exerted at a moment of time when the body is lifted, and may set the following inequality (26) as the subsequent control condition.

$$F1<F1_INIT \tag{26}$$

Note that, although the distances D1 through D4 and the position of the tipping fulcrum 21 are not explicitly calculated, accurate position information of the tipping fulcrum 21 is, of course, applied to the control condition expressed by the inequality (26).

Further, in the present embodiment, the force F1 is explicitly included in the control condition for minimizing the lifting of the body; however, the present invention is not limited thereto. For example, instead of the force F1, another force or moment having correlation with the force F1 may be used to define the control condition.

<Method for Minimizing Vibration>

Figure 17A:
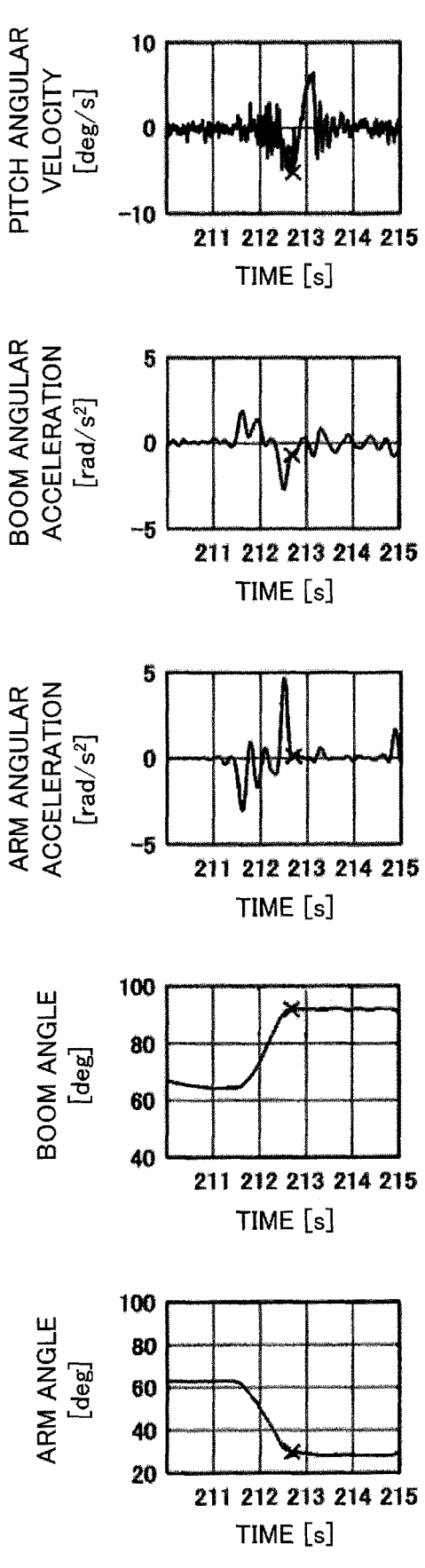
FIG. 17A is a drawing illustrating examples of waveforms related to vibration of the shovel.
Figure 17B:
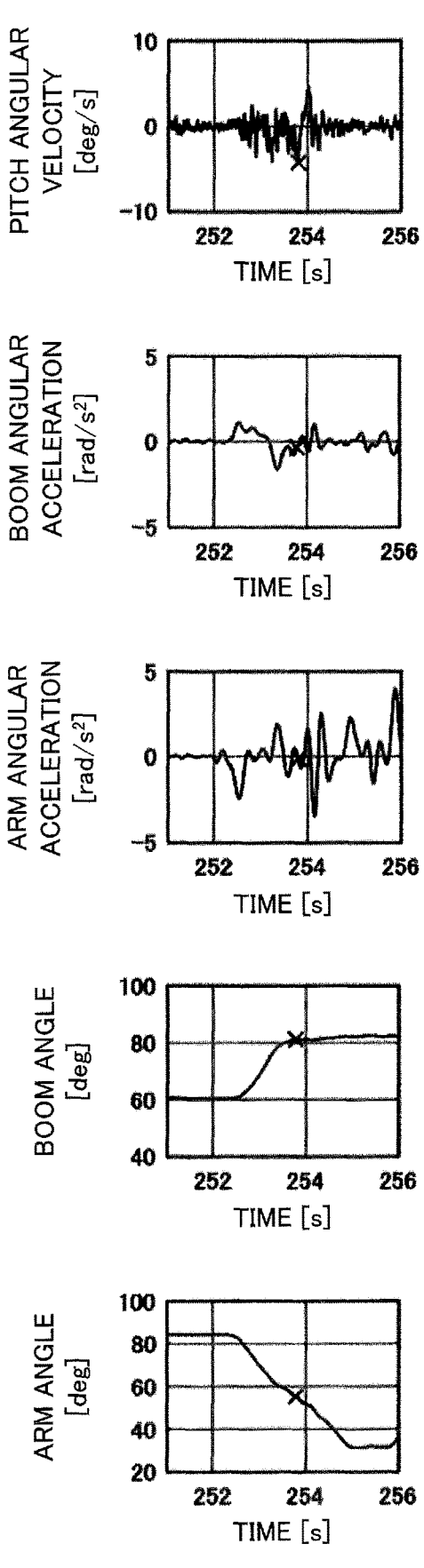
FIG. 17B is a drawing illustrating examples of waveforms related to vibration of the shovel.
Figure 17C:
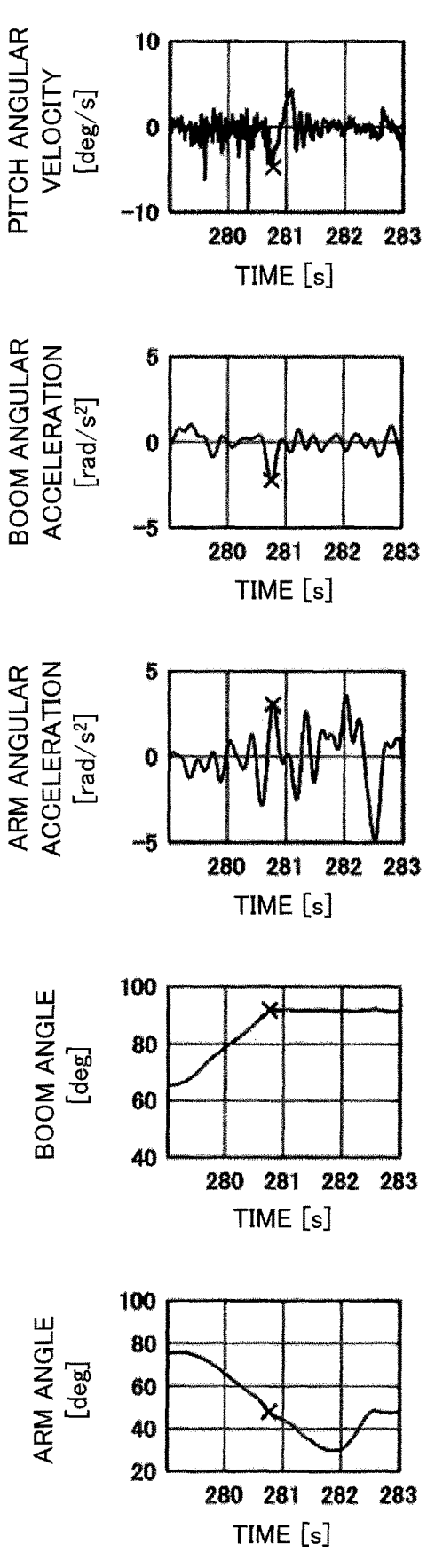
FIG. 17C is a drawing illustrating examples of waveforms related to vibration of the shovel.

FIG. 17A through FIG. 17C are drawings illustrating examples of waveforms related to vibration of the shovel 100. More specifically, FIG. 17A through 17C are drawings illustrating one example, another example, and yet another example of waveforms when in-air movement of the attachment is repeatedly performed. FIG. 17A through 17C depict, from the top, pitch angular velocity (namely, vibration of the body of the shovel), boom angular acceleration, arm angular acceleration, a boom angle, and an arm angle.

In FIG. 17A through 17C, an X symbol indicates a point corresponding to a negative peak of the pitch angular velocity.

As illustrated in FIG. 17A through 17C, vibration is induced when the boom angle stops changing. In other words, it can be said that the boom angular acceleration has the largest effect on the generation of vibration. Namely, this means that controlling the boom angular acceleration is effective in minimizing vibration. This can be intuitively understood because the moment of inertia with respect to the bucket angle is affected only by the mass of the bucket 6, and the moment of inertia with respect to the arm angle is affected by the mass of the bucket and the mass of the arm, whereas the moment of inertia with respect to the boom angle is affected by the total mass of the boom 4, the arm 5, and the bucket 6.

Therefore, it is preferable for the movement correcting unit 302 to correct the movement of the boom cylinder 7, which serves as a control target. That is, the movement correcting unit 302 operates so that the thrust of the boom cylinder 7 does not exceed the upper limit (thrust limit $F_{MAX}$) based on the state of the attachment.

The thrust F of the boom cylinder 7 is expressed by the equation (27), based on the pressure receiving area AR of the rod-side oil chamber, the rod pressure $P_R$ of the rod-side oil chamber, the pressure receiving area AB of the bottom-side oil chamber, and the bottom pressure $P_B$ of the bottom-side oil chamber.

$$F=AB\cdot P_B-AR\cdot P_R \tag{27}$$

The thrust F of the boom cylinder 7 is required to be smaller than the thrust limit $F_{MAX}$. Thus, the following inequality (28) is required to be established.

$$F_{MAX}>AB\cdot P_B-AR\cdot P_R \tag{28}$$

From the inequality (28), the following inequality (29) is obtained.

$$P_B<(F_{MAX}+AR\cdot P_R)/AB \tag{29}$$

The right side of the inequality (29) corresponds to the upper limit $P_{BMAX}$ of the bottom pressure $P_B$, which corresponds to the thrust limit $F_{MAX}$. Therefore, the following equation (30) is obtained.

$$P_{BMAX}=(F_{MAX}+AR\cdot P_R)/AB \tag{30}$$

The movement correcting unit 302 corrects the movement of the attachment, namely the movement of the boom cylinder 7 so that the equation (30) is established. That is, the movement correcting unit 302 controls the bottom pressure $P_B$ of the boom cylinder 7 so that the equation (30) is established. More specifically, by employing various configurations (see FIG. 27 through FIG. 35), which will be described below, it becomes possible for the movement correcting unit 302 to control the bottom pressure $P_B$ of the boom cylinder 7 by outputting a control command to a control target, as necessary. Accordingly, the vibration of the shovel 100 is minimized.

The movement correcting unit 302 acquires the thrust limit $F_{MAX}$, based on detection signals output from the various types of sensors 32. In one embodiment, a thrust limit obtaining unit 586 receives the state of the attachment, namely detection signals from the various types of sensors 32, and acquires the thrust limit $F_{MAX}$ by calculation. The movement correcting unit 302 calculates the upper limit $P_{BMAX}$ of the bottom pressure $P_B$ based on the equation (30), and controls the bottom pressure $P_B$ of the boom cylinder 7 not to exceed the calculated upper limit $P_{BMAX}$.

If the thrust limit $F_{MAX}$ is too small, the boom 4 is lowered. Therefore, the movement correcting unit 302 may acquire a thrust (holding thrust $F_{MIN}$) that can hold the orientation of the boom 4, and may set the thrust limit $F_{MAX}$ in a range greater than the holding thrust $F_{MIN}$.

Figure 18:
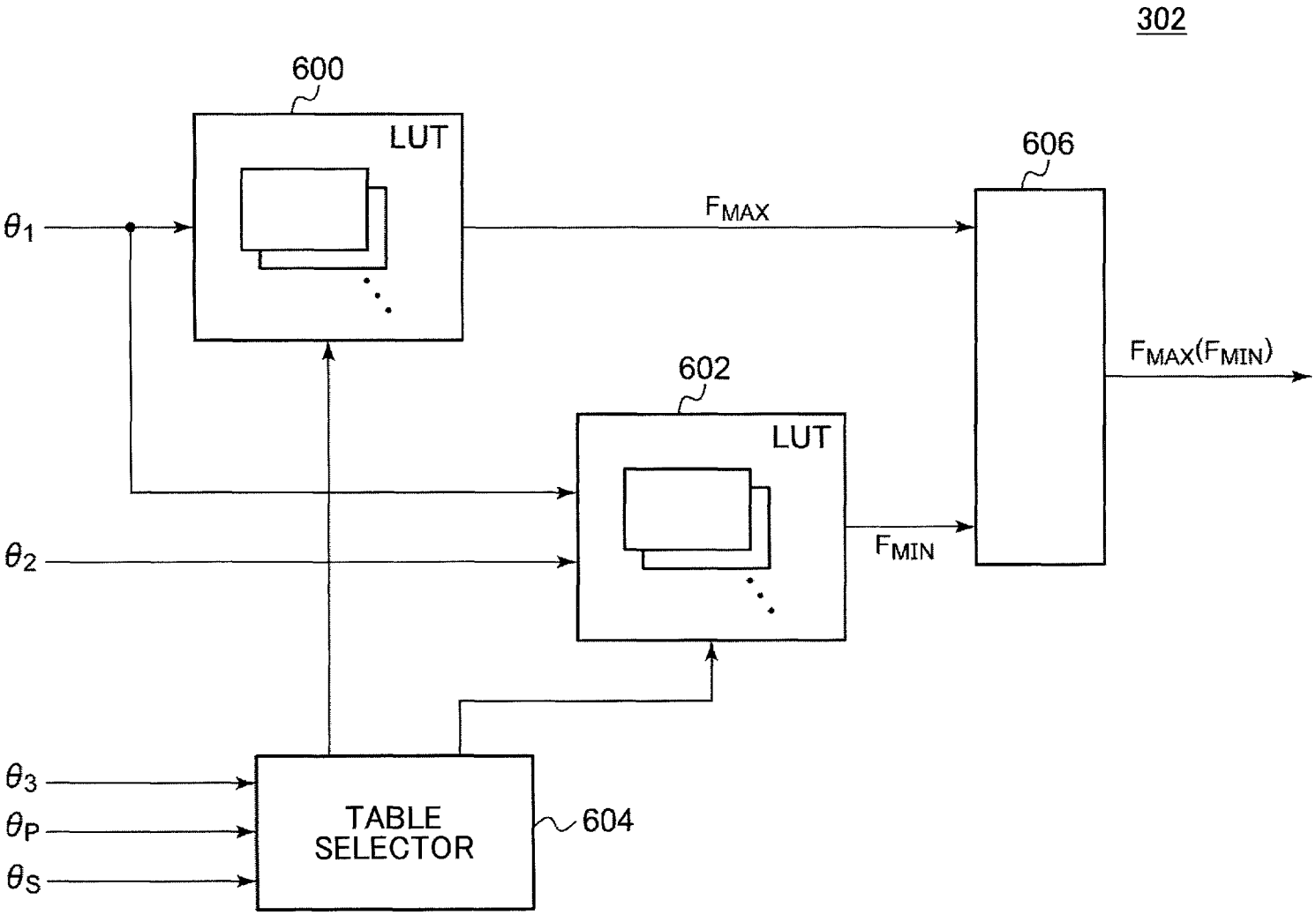
FIG. 18 is a drawing illustrating a method for acquiring a limit thrust.

FIG. 18 is a drawing illustrating a method performed by the movement correcting unit 302 to acquire the thrust limit $F_{MAX}$. More specifically, FIG. 18 is a block diagram illustrating a functional configuration in which the movement correcting unit 302 acquires the thrust limit $F_{MAX}$.

As illustrated in FIG. 18, the movement correcting unit 302 acquires the thrust limit $F_{MAX}$ based on table reference. The movement correcting unit 302 includes a first lookup table 600, a second lookup table 602, a table selector 604, and a selector 606.

The first lookup table 600 receives a boom angle $\theta_1$, output from a boom angle sensor included in the various types of sensors 32, and outputs the thrust limit $F_{MAX}$. The first lookup table 600 may include a plurality of tables provided corresponding to a plurality of different predetermined states of the shovel 100.

The second lookup table 602 receives the boom angle $\theta_1$ and an arm angle $\theta_2$, output from the boom angle sensor and an arm angle sensor included in the various types of sensors 32, and outputs the holding thrust $F_{MIN}$. Similar to the first lookup table 600, the second lookup table 602 may include a plurality of tables provided corresponding to a plurality of different predetermined states of the shovel 100.

The table selector 604 uses any or all of a bucket angle $\theta_3$, a body pitch direction $\theta_P$, and a swing angle $\theta_S$ as parameters, which are output from a bucket angle sensor, a pitch direction sensor mounted on the body (upper turning body 3), and a swing angle sensor included in the various types of sensors 32, to select an optimum table in the first lookup table 600.

Further, the table selector 604 uses any or all of the bucket angle $\theta_3$, the body pitch direction $\theta_P$, and the swing angle $\theta_S$ as parameters to select an optimum table in the second lookup table 602.

The selector 606 outputs the larger one of the thrust limit $F_{MAX}$ and the holding thrust $F_{MIN}$. Accordingly, it is possible to minimize vibration while also preventing the lowering of the boom.

Note that the movement correcting unit 302 may acquire the thrust limit $F_{MAX}$ by calculation instead of table reference. Similarly, the movement correcting unit 302 may acquire the holding thrust $F_{MIN}$ by calculation instead of table reference.

[Method for Determining Occurrence of Unintended Movement of Shovel]

Next, referring to FIG. 19A through FIG. 26B, a method for determining the occurrence of an unintended movement will be described.

<Method for Determining Occurrence of Dragging Movement>

Figure 19A:
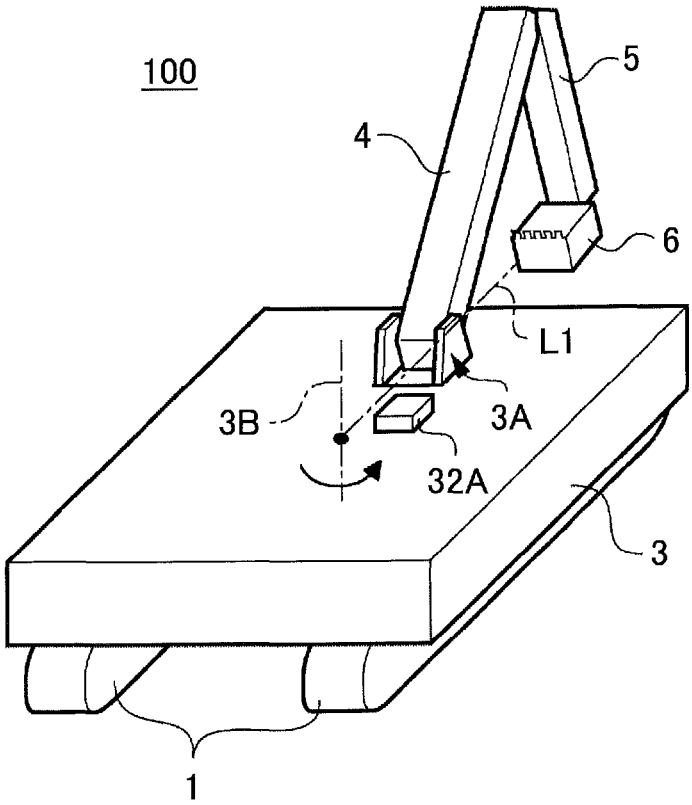
FIG. 19A is a drawing illustrating a first example of a method for determining the occurrence of dragging.
Figure 19B:
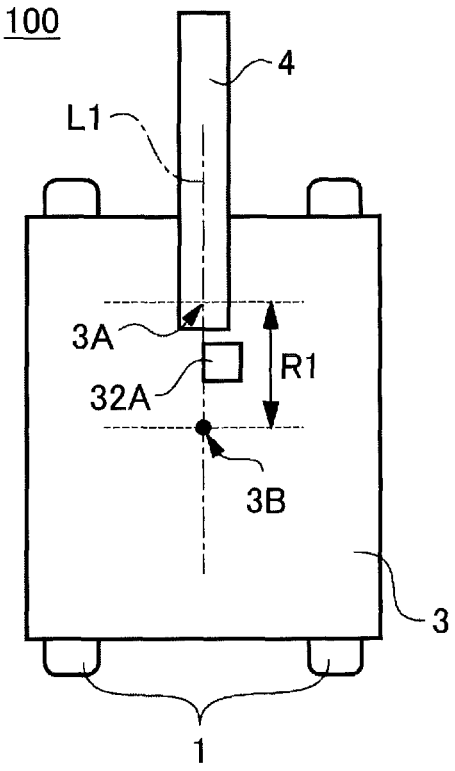
FIG. 19B is a drawing illustrating the first example of the method for determining the occurrence of dragging.

FIG. 19A and FIG. 19B are drawings illustrating a first example of a method for determining the occurrence of dragging of the shovel 100. To be more specific, FIG. 19A and FIG. 19B are drawings illustrating an example position of an acceleration sensor 32A mounted on the upper turning body 3 of the shovel 100.

In this example, the various types of sensors 32 of the shovel 100 include the acceleration sensor 32A.

As illustrated in FIG. 19A and FIG. 19B, the acceleration sensor 32A is mounted on the upper turning body 3.

The acceleration sensor 32A has a detection axis in the direction along a straight line L1 corresponding to the extending direction of the attachment of the shovel 100 in plan view. The point of action at which a force is exerted by the attachment on the upper turning body 3 is located at the bottom 3A of the boom 4. Therefore, it is preferable to provide the acceleration sensor 32A at the bottom of the boom 4. In this manner, the movement determining unit 301 can suitably identify the occurrence of the dragging of the shovel 100 caused by the movement of the attachment, based on an output signal of the acceleration sensor 32A.

If the acceleration sensor 32A is located away from a turning axis 3B, the acceleration sensor 32A may be affected by the centrifugal force when the upper turning body 3 is rotated. Therefore, it is desirable to provide the acceleration sensor 32A in the vicinity of the bottom 3A of the boom 4 and also in the vicinity of the turning axis 3B.

Namely, the acceleration sensor 32A is desirably provided in a region R1 located between the bottom 3A of the boom 4 and the turning axis 3B of the upper turning body 3. Accordingly, it becomes possible to reduce the influence of rotation, thereby allowing the movement determining unit 301 to suitably detect the occurrence of dragging caused by the movement of the attachment, based on an output signal of the acceleration sensor 32A.

Further, if the acceleration sensor 32A is located far away from the ground surface, acceleration components due to pitch and roll tend to be included in the output of the acceleration sensor 32A. In light of the above, the acceleration sensor 32A is preferably mounted as low as possible on the upper turning body 3.

Further, in this example, a velocity sensor, which may be included in the various types of sensors 32, may be mounted at a similar position on the upper turning body 3, instead of the acceleration sensor 32A. Accordingly, the movement determining unit 301 can identify the occurrence of dragging of the shovel 100, based on the output corresponding to the velocity along the straight line L1 detected by the velocity sensor.

Further, in this example, the various types of sensors 32 may include an angular velocity sensor mounted on the upper turning body 3, in addition to the acceleration sensor 32A. In this case, the output of the acceleration sensor 32A may be corrected based on the output of the angular velocity sensor. The output of the acceleration sensor 32A includes components of not only linear motion (dragging movement) in a particular direction, but also of rotational motion in the pitch direction, the yaw direction, and the roll direction. By using the angular velocity sensor together, the influence of rotational motion can be excluded, thereby extracting linear motion corresponding to the dragging movement only. As a result, the accuracy of determining the dragging movement by the movement determining unit 301 can be improved.

Further, in this example, the acceleration sensor 32A is mounted on the upper turning body 3, but may be mounted on the lower traveling body 1. In this case, the movement determining unit 301 may also use the output of an angle sensor together, which detects a turning angle (turning position) of the upper turning body 3 and may be included in the various types of sensors 32. In this manner, the movement determining unit 301 can identify linear motion along the extending direction (straight line L1) of the attachment, based on the output of the acceleration sensor 32A of the lower traveling body 1, thereby identifying the occurrence of dragging in that direction.

Figure 20:
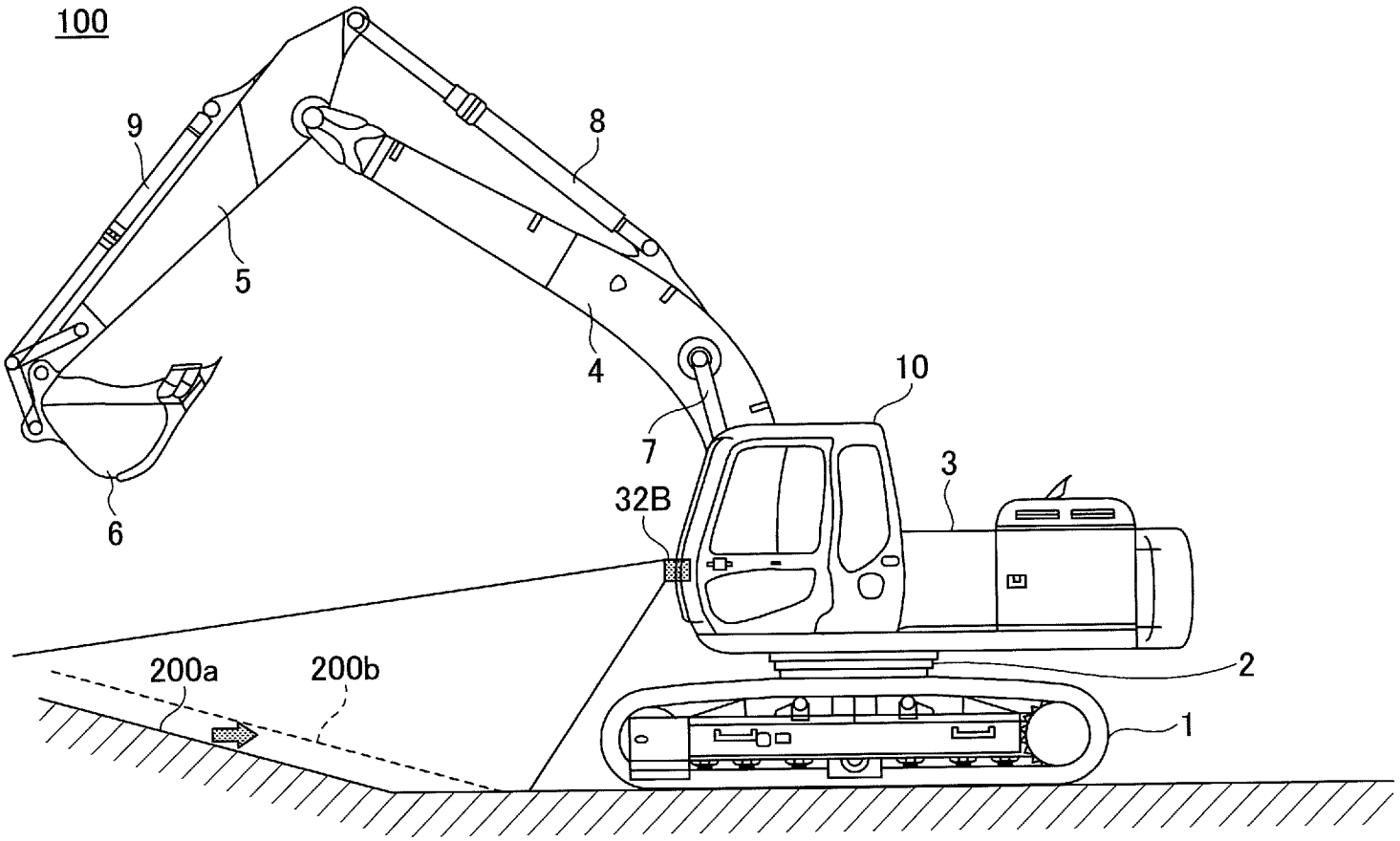
FIG. 20 is a drawing illustrating a second example of the method for determining the occurrence of dragging.

Next, FIG. 20 is a drawing illustrating a second example of the method for determining the occurrence of dragging.

In this example, the various types of sensors 32 include a distance sensor 32B.

As illustrated in FIG. 20, the distance sensor 32B is mounted to the front end of the upper turning body 3 of the shovel 100, and measures the distance between the body (upper turning body 3), on which the distance sensor 32B is mounted, and the ground surface, an obstacle, or any other object located in front of the upper turning body 3 of the shovel 100 within a predetermined range. The distance sensor 32B may be light detection and ranging (LIDAR), a millimeter wave radar, a stereo camera, or the like.

The movement determining unit 301 determines the occurrence of dragging of the shovel 100, based on a change in the relative positional relationship between the upper turning body 3 and a fixed reference object around the shovel 100, which is measured by the distance sensor 32B. More specifically, the movement determining unit 301 determines that the shovel 100 has been dragged, when the relative position of a ground surface 200*a* viewed from the upper turning body 3 is moved approximately in the horizontal direction, more specifically, approximately parallel to the surface on which the shovel 100 is located, based on the output of the distance sensor 32B. For example, as illustrated in FIG. 20, the movement determining unit 301 determines that the shovel 100 has been dragged forward, when the relative position of the ground surface 200*a* viewed from the upper turning body 3 is moved towards the upper turning body 3 (towards a dotted line 200*b*) approximately in the horizontal direction, based on the output of the distance sensor 32B. Conversely, the movement determining unit 301 determines that the shovel 100 has been dragged backward, when the relative position of the ground surface 200*a* viewed from the upper turning body 3 is moved away from the upper turning body 3 approximately in the horizontal direction.

Instead of the distance sensor 32B, the movement determining unit 301 may use any other sensor such as an image sensor (a monocular camera) capable of detecting the relative position between the upper turning body 3 and a fixed reference object around the shovel 100 to determine the occurrence of dragging.

Further, the fixed reference object around the shovel 100 is not limited to the ground surface, and may be a building or may be an object intentionally disposed around the shovel 100 to be used as the reference object.

Further, the distance sensor 32B is not required to be mounted on the upper turning body 3, and may be mounted on the attachment. In this case, the movement determining unit 301 may be able to measure the distance between the attachment and the upper turning body 3, in addition to the distance between the attachment and a reference object. Accordingly, the movement determining unit 301 can identify the relative position of the reference object and the relative position of the upper turning body 3 with respect to the attachment, based on the output of the distance sensor 32B. That is, the movement determining unit 301 can determine the relative position between the reference object and the upper turning body 3 in an indirect manner. Accordingly, the movement determining unit 301 determines that the shovel 100 has been dragged, when the relative position between the reference object and the upper turning body 3 is changed, namely when the reference object is moved approximately parallel to the surface on which the upper turning body 3 is located, based on the output of the distance sensor 32B mounted on the attachment.

Figure 21A:
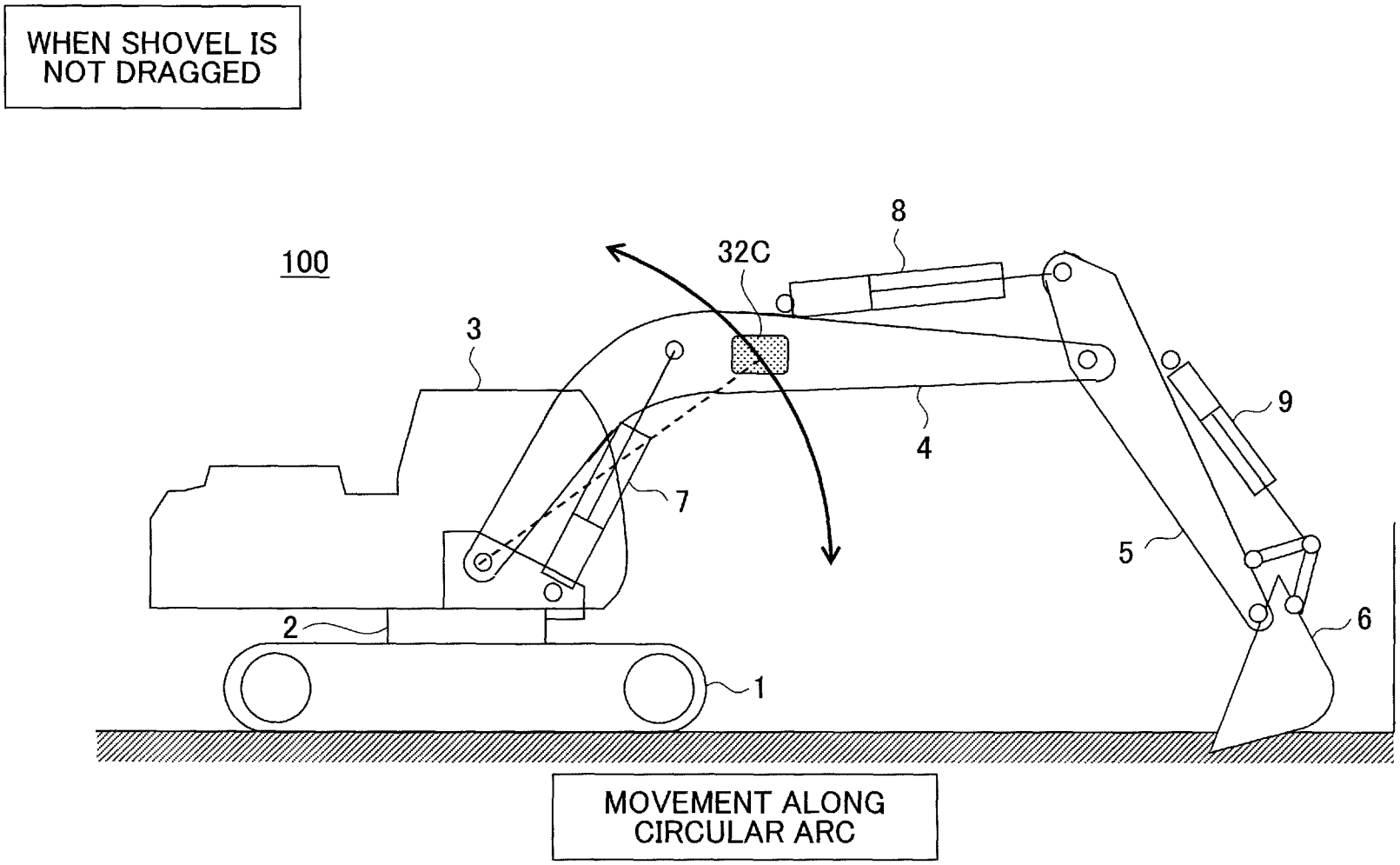
FIG. 21A is a drawing illustrating a third example of the method for determining the occurrence of dragging.
Figure 21B:
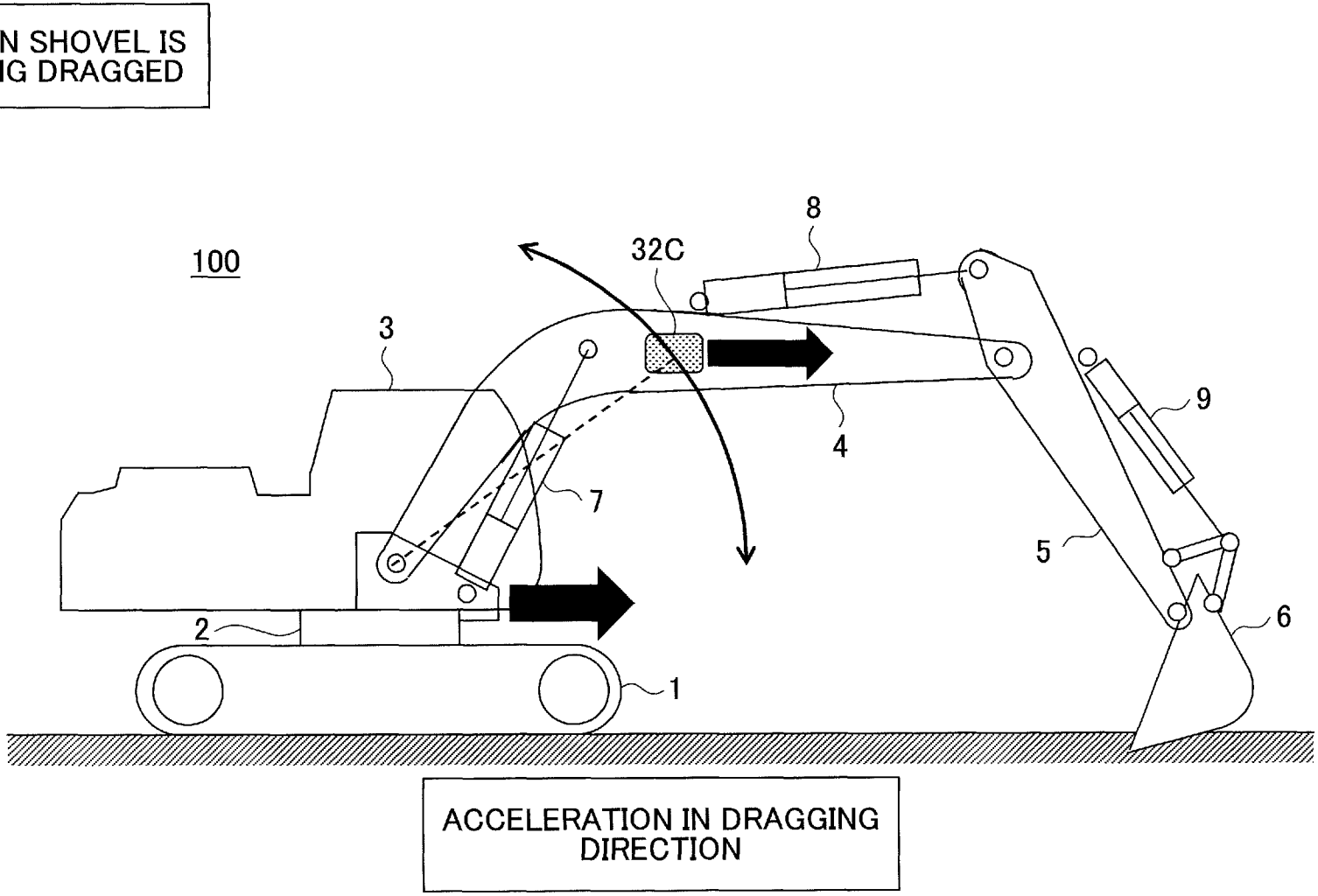
FIG. 21B is a drawing illustrating the third example of the method for determining the occurrence of dragging.

Next, FIG. 21A and FIG. 21B are drawings illustrating a third example of the method for determining the occurrence of dragging. To be more specific, FIG. 21A depicts the shovel 100 that is not dragged, and FIG. 21B depicts the shovel 100 that is being dragged.

In this example, the various types of sensors 32 include an IMU 32C.

As illustrated in FIG. 21A and FIG. 21B, the IMU 32C is mounted on the boom 4.

As illustrated in FIG. 21A, when the shovel 100 is not dragged, the IMU 32C of the boom 4 detects rotational motion in accordance with the raising and lowering of the boom 4. Thus, an acceleration component in the front-back direction of the shovel 100 detected by the IMU 32C is output as a relatively small value because of the rotational motion.

Conversely, as illustrated in FIG. 21B, at the time of dragging, the shovel 100 moves in the front-back direction. Thus, an acceleration component in the dragging direction, namely an acceleration component in the front-back direction of the shovel 100 detected by the IMU 32C is output as a relatively large value.

Therefore, when an acceleration component detected by the IMU 32C becomes greater than or equal to a predetermined threshold, the movement determining unit 301 may determine that the dragging of the shovel 100 has occurred. The predetermined threshold may be set as appropriate based on experiments, simulation analyses, and the like. Further, the movement determining unit 301 can determine whether the shovel 100 is dragged forward or backward, based on the direction of the detected acceleration component.

Further, in this example, any other sensor such as a velocity sensor or an acceleration sensor may be used instead of the IMU 32C, as long as the motion in the front-back direction of the boom 4 can be detected. In this case, as with the IMU 32C, the movement determining unit 301 may determine that the dragging of the shovel 100 has occurred when the output value of the sensor becomes relatively large.

Figure 22A:
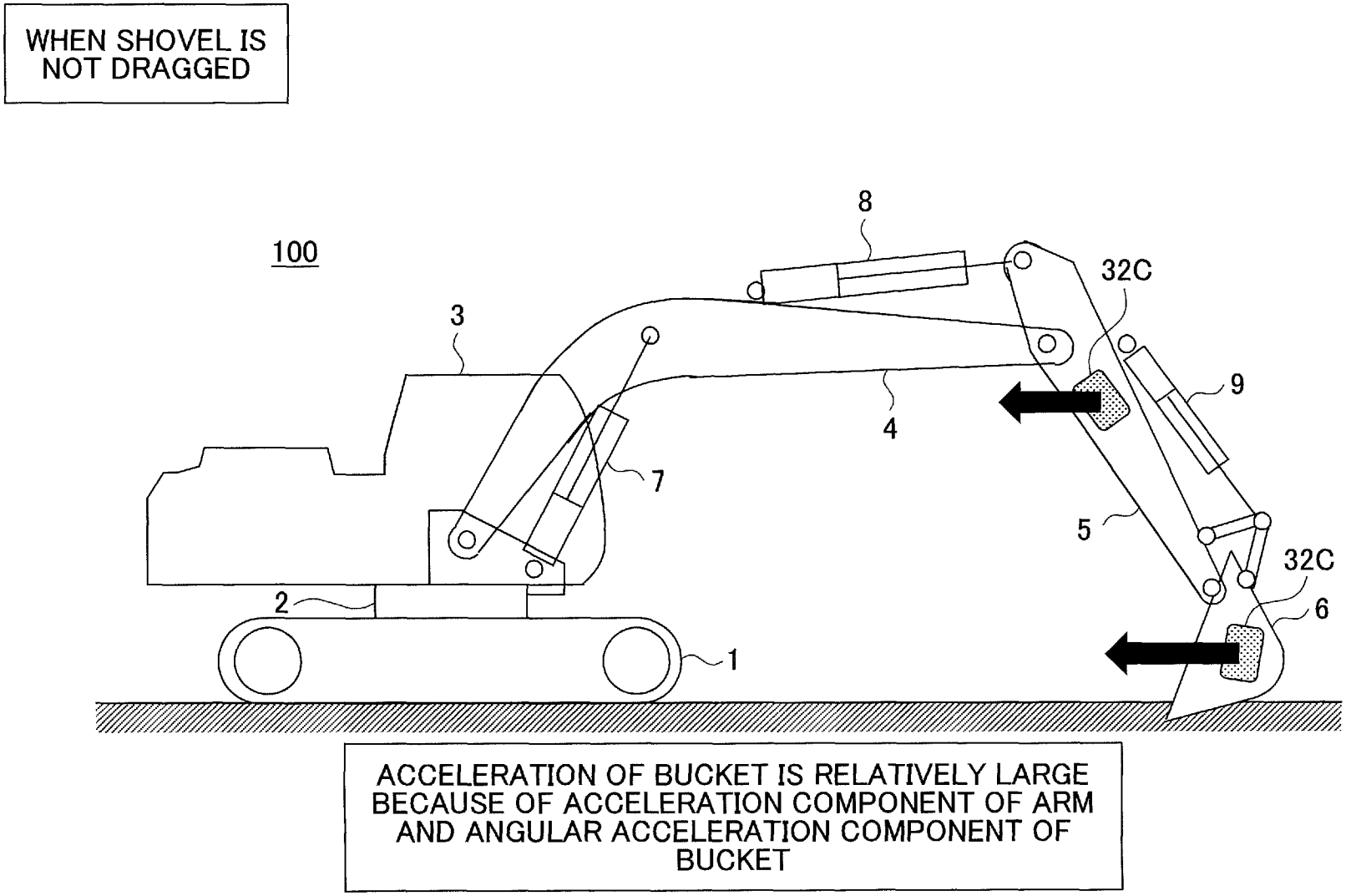
FIG. 22A is a drawing illustrating a fourth example of the method for determining the occurrence of dragging.
Figure 22B:
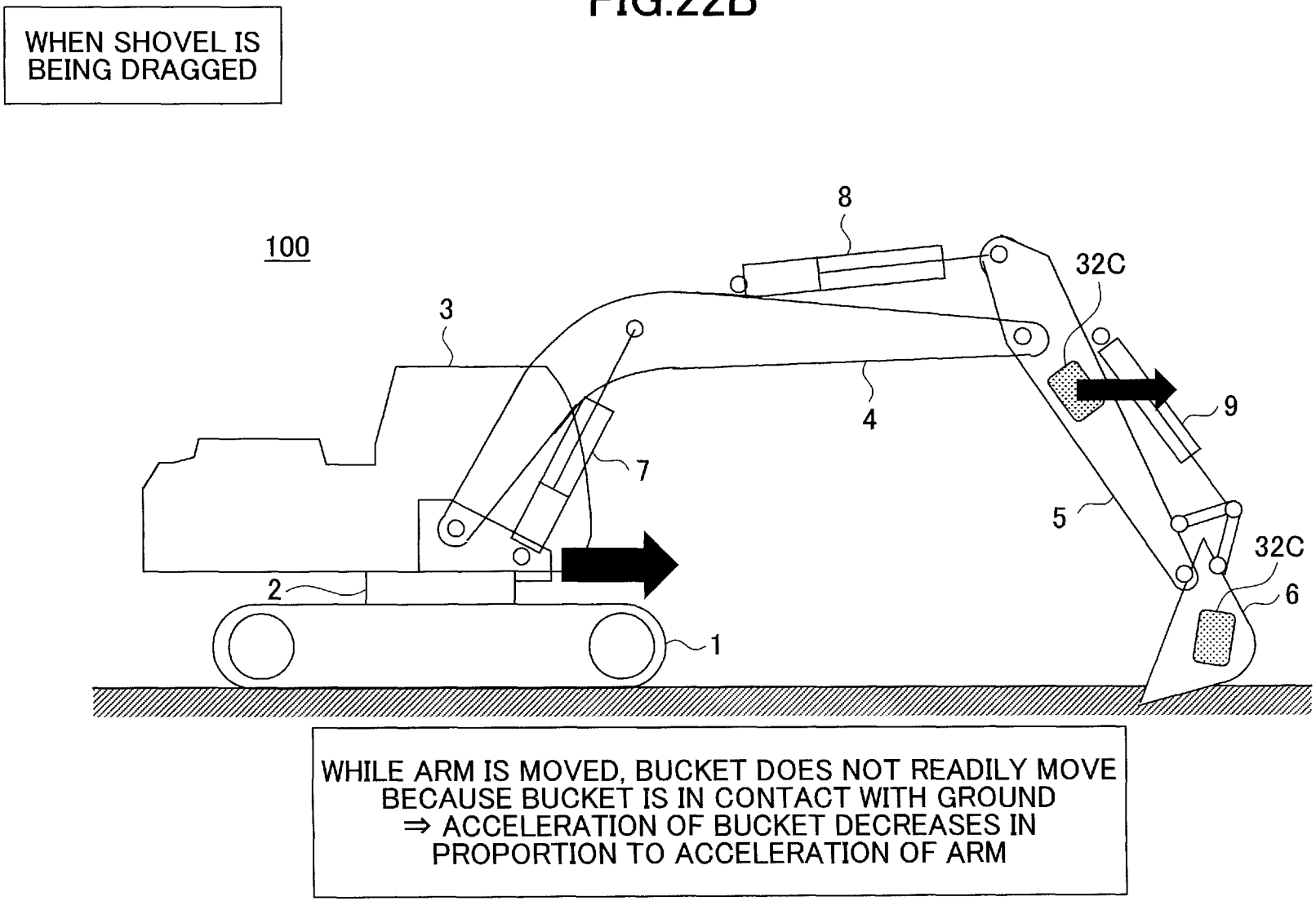
FIG. 22B is a drawing illustrating the fourth example of the method for determining the occurrence of dragging.

Next, FIG. 22A and FIG. 22B are drawings illustrating a fourth example of the method for determining the occurrence of dragging. To be more specific, FIG. 22A depicts the shovel 100 that is not dragged, and FIG. 22B depicts the shovel 100 that is being dragged.

In this example, the various types of sensors 32 include two IMUs 32C.

As illustrated in FIG. 22A and FIG. 22B, one IMU 32C is mounted on the arm 5, and the other IMU 32C is mounted on the bucket 6.

As illustrated in FIG. 22A, when the shovel 100 is not dragged, an acceleration component in the front-back direction detected by the IMU 32C of the bucket 6 is represented as a combination of an acceleration component of the arm 5 and an angular acceleration component about the drive axis of the bucket 6. Therefore, the acceleration component detected by the IMU 32C of the bucket 6 becomes relatively larger than the acceleration component in the front-back direction detected by the IMU 32C of the arm 5.

Conversely, as illustrated in FIG. 22B, when the shovel 100 is being dragged, the arm 5 is moved in the front-back direction of the shovel 100. Because the bucket 6 makes contact with the ground surface for excavation work, the bucket 6 does not readily move. Therefore, an acceleration component in the front-back direction detected by the IMU 32C of the bucket 6 becomes somewhat smaller than an acceleration component in the front-back direction detected by the IMU 32C of the arm 5.

Thus, when the difference between an acceleration component detected by the IMU 32C of the arm 5 and an acceleration component detected by the IMU 32C of the bucket 6 becomes greater than or equal to a predetermined threshold, the movement determining unit 301 may determine that the dragging of the shovel 100 has occurred. The predetermined threshold may be set as appropriate based on experiments, simulation analyses, and the like. Further, the movement determining unit 301 can determine whether the shovel 100 is dragged forward or backward, based on the direction of the acceleration component of the arm 5.

Further, the IMU 32C mounted on the arm 5 is preferably disposed closer to the position where the arm 5 is coupled to the boom 4 than to the position where the arm 5 is coupled to the bucket 6. Accordingly, with the position where the arm 5 is coupled to the bucket 6 being used as the fulcrum, the amount of movement of the arm 5 at the position where the IMU 32C is mounted can be increased as much as possible when the dragging of the shovel 100 has occurred. Thus, the movement determining unit 301 can readily determine the occurrence of dragging, based on the difference between the acceleration component detected by the IMU 32C of the arm 5 and the acceleration component detected by the IMU 32C the IMU 32C of the bucket 6.

Further, in this example, instead of the IMUs 32C, any other sensors such as velocity sensors or acceleration sensors may be employed, as long as the sensors are capable of detecting the motion in the front-back direction of the arm 5 and the bucket 6. Further, in this example, the IMUs 32C are mounted on the arm 5 and the bucket 6; however, an additional IMU 32C may be mounted on the boom 4. Accordingly, the movement determining unit 301 can determine the occurrence of dragging, based on the difference between output values of the respective IMUs 32C mounted on the boom 4 and the bucket 6, in addition to the difference between output values of the respective IMUs 32C mounted on the arm 5 and the bucket 6, thereby improving determination accuracy. Further, the IMU 32C is not required to be mounted on the arm 5, and the IMUs 32C may be mounted on the boom 4 and the bucket 6. In this case, the movement determining unit 301 may determine the occurrence of dragging, based on the difference between output values of the respective IMUs 32C mounted on the boom 4 and the bucket 6.

<Method for Determining Occurrence of Lifting>

Figure 23A:
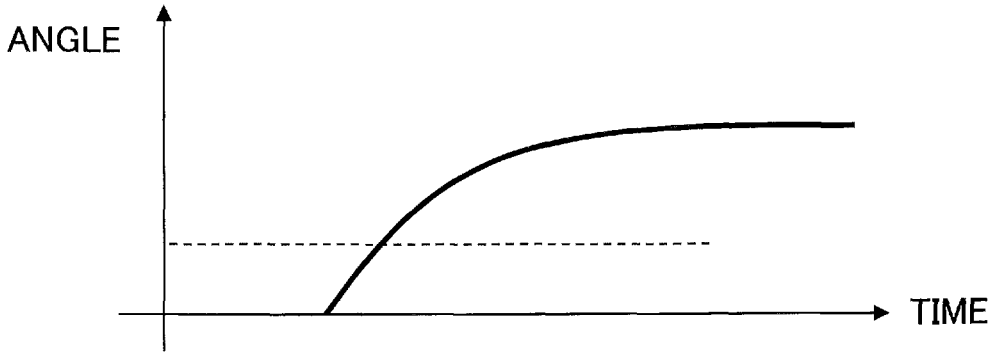
FIG. 23A is a graph illustrating a first example of a method for determining the occurrence of lifting.
Figure 23B:
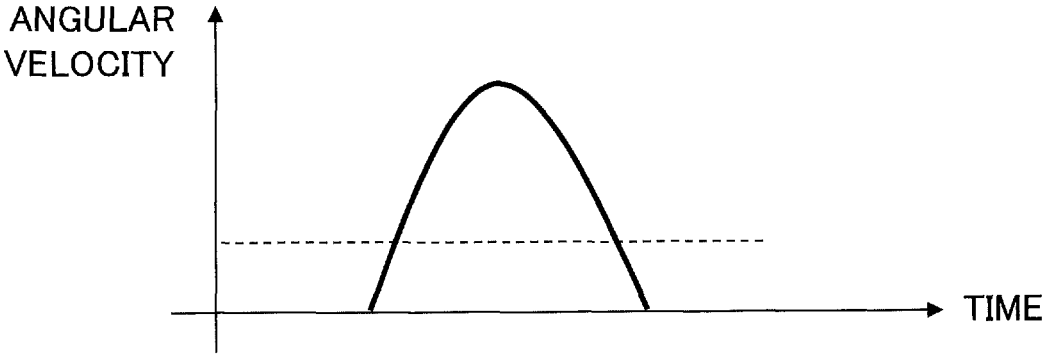
FIG. 23B is a graph illustrating the first example of the method for determining the occurrence of lifting.
Figure 23C:
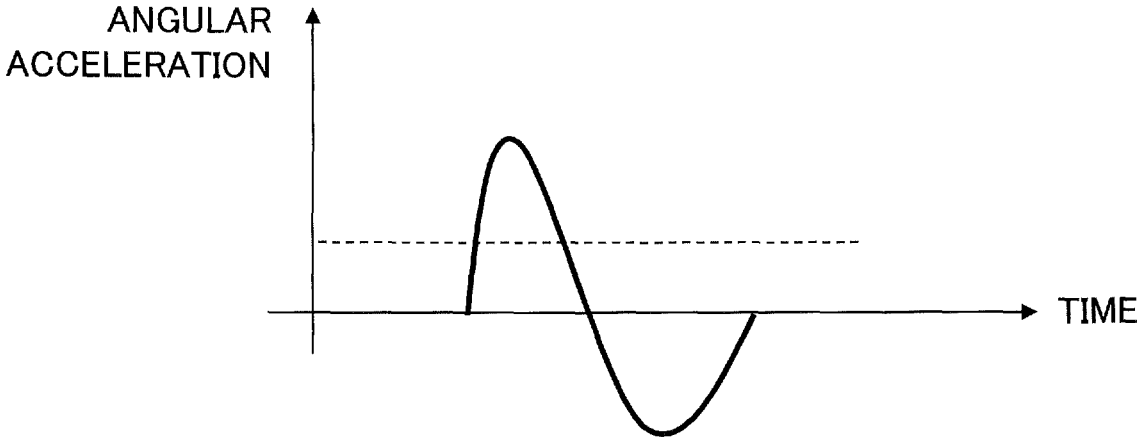
FIG. 23C is a graph illustrating the first example of the method for determining the occurrence of lifting.

FIG. 23A through FIG. 23C are drawings illustrating a first example of a method for determining the occurrence of lifting of the shovel 100. To be more specific, FIG. 23A is a graph illustrating changes in the inclination angle in the front-back direction of the body of the shovel 100 (in the pitch direction) over time, FIG. 23B is a graph illustrating changes in the angular velocity over time, and FIG. 23C is a graph illustrating changes in the angular acceleration over time when the shovel 100 is lifted.

In this example, the movement determining unit 301 determines the occurrence of lifting of the shovel 100 based on the outputs of sensors included in the various types of sensors 32. The sensors are capable of outputting information related to the inclination angle in the front-back direction of the body of the shovel 100, namely the inclination angle in the pitch direction.

Examples of the sensors capable of outputting information related to the inclination angle in the pitch direction of the body of the shovel 100 include an inclination angle sensor (angle sensor), an angular velocity sensor, and an IMU.

For example, as illustrated in FIG. 23A through FIG. 23C, at the time of the occurrence of lifting, the inclination angle, the angular velocity, and the angular acceleration in the pitch direction become somewhat large. Therefore, when these values exceed predetermined thresholds (constant values indicated by dotted lines), the movement determining unit 301 can determine that the lifting has occurred. In addition, the movement determining unit 30 can determine whether the front of the shovel 100 has lifted or the rear of the shovel 100 has lifted, based on the direction of the inclined angle, the angular velocity, and the angular acceleration, namely based on the forward inclination or the backward inclination about the pitch axis.

Figure 24:
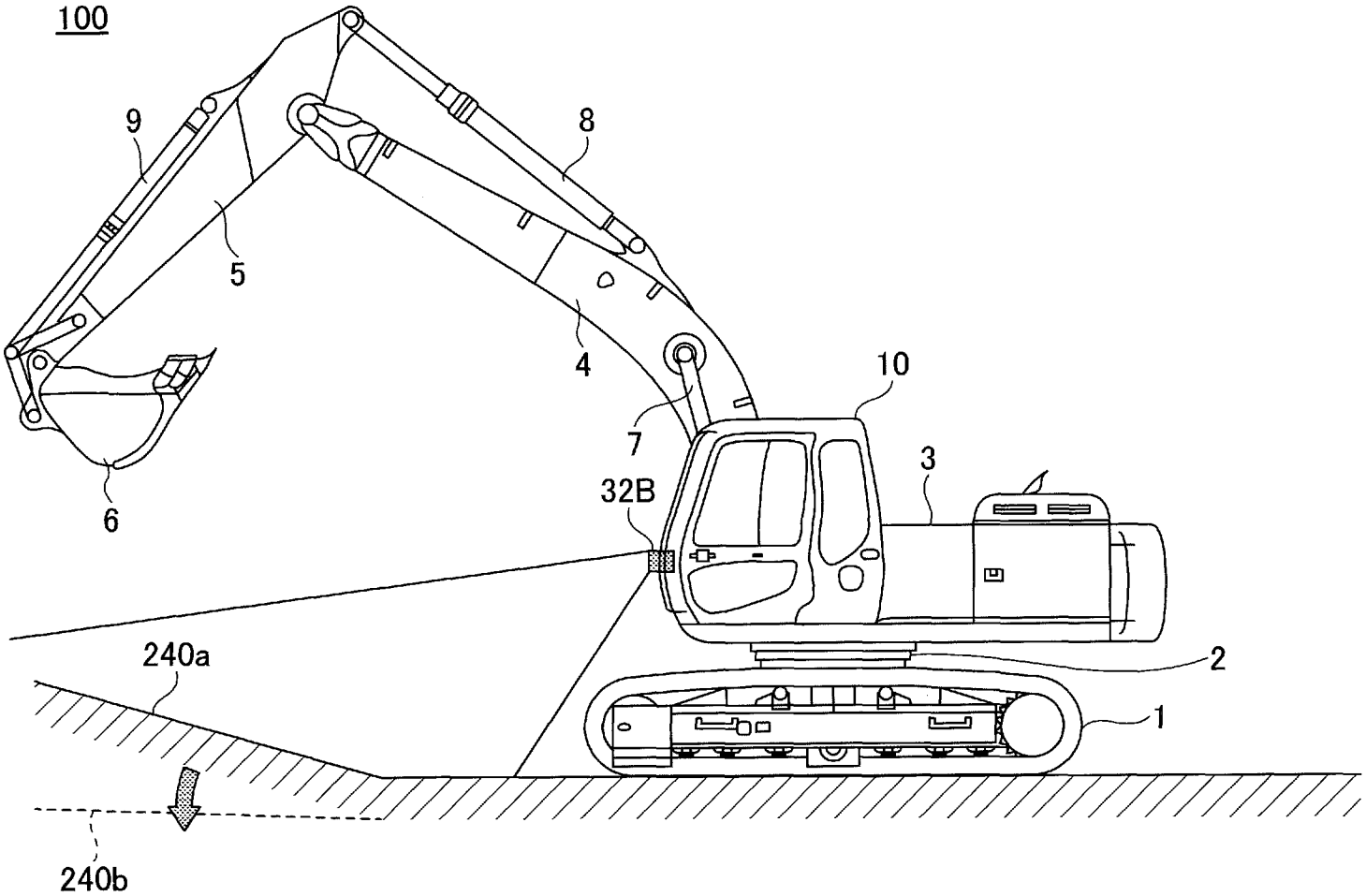
FIG. 24 is a drawing illustrating a second example of the method for determining the occurrence of lifting.

Next, FIG. 24 is a drawing illustrating a second example of the method for determining the occurrence of lifting.

In this example, similar to FIG. 20, the various types of sensors 32 include the distance sensor 32B.

As illustrated in FIG. 24, similar to FIG. 20, the distance sensor 32B is mounted to the front end of the upper turning body 3 of the shovel 100, and measures the distance from the body (upper turning body 3), on which the distance sensor 32B is mounted, to the ground surface, an obstacle, or any other object located in front of the upper turning body 3 of the shovel 100 within a predetermined range.

Similar to FIG. 20, the movement determining unit 301 determines the occurrence of lifting of the shovel 100, based on a change in the relative positional relationship between the upper turning body 3 and a fixed reference object around the shovel 100, which is measured by the distance sensor 32B. More specifically, the movement determining unit 301 determines that the shovel 100 has been lifted, when the relative position of a ground surface 240*a* viewed from the upper turning body 3 is moved approximately in the vertical direction, more specifically, approximately perpendicular to the surface on which the shovel 100 is located, based on the output of the distance sensor 32B. For example, as illustrated in FIG. 24, the movement determining unit 301 determines that the front of the shovel 100 has been lifted, when the relative position of the ground surface 240*a* viewed from the upper turning body 3 is moved approximately downward (toward a dotted line 240*b*), based on the output of the distance sensor 32B. Conversely, the movement determining unit 301 determines that the rear of the shovel 100 has been lifted, when the relative position of the ground surface 240*a* viewed from the upper turning body 3 is moved away from the upper turning body 3 approximately upward.

Instead of the distance sensor 32B, the movement determining unit 301 may use any other sensor such as an image sensor (a monocular camera) capable of detecting the relative position between the upper turning body 3 and a fixed reference object around the shovel 100 to determine the occurrence of lifting.

Further, the fixed reference object around the shovel 100 is not limited to the ground surface, and may be a building or may be an object intentionally disposed around the shovel 100 to be used as the reference object.

Further, the distance sensor 32B is not required to be mounted on the upper turning body 3, and may be mounted on the attachment. In this case, the movement determining unit 301 may be able to measure the distance between the attachment and the upper turning body 3, in addition to the distance between the attachment and a reference object. Accordingly, the movement determining unit 301 can identify the relative position of the reference object and the relative position of the upper turning body 3 with respect to the attachment, based on the output of the distance sensor 32B. That is, the movement determining unit 301 can determine the relative position between the reference object and the upper turning body 3 in an indirect manner. Accordingly, the movement determining unit 301 determines that the shovel 100 has been lifted, when the relative position between the reference object and the upper turning body 3 is changed, namely when the reference object is moved approximately perpendicular to the surface on which the upper turning body 3 is located, based on the output of the distance sensor 32B mounted on the attachment.

Figure 25A:
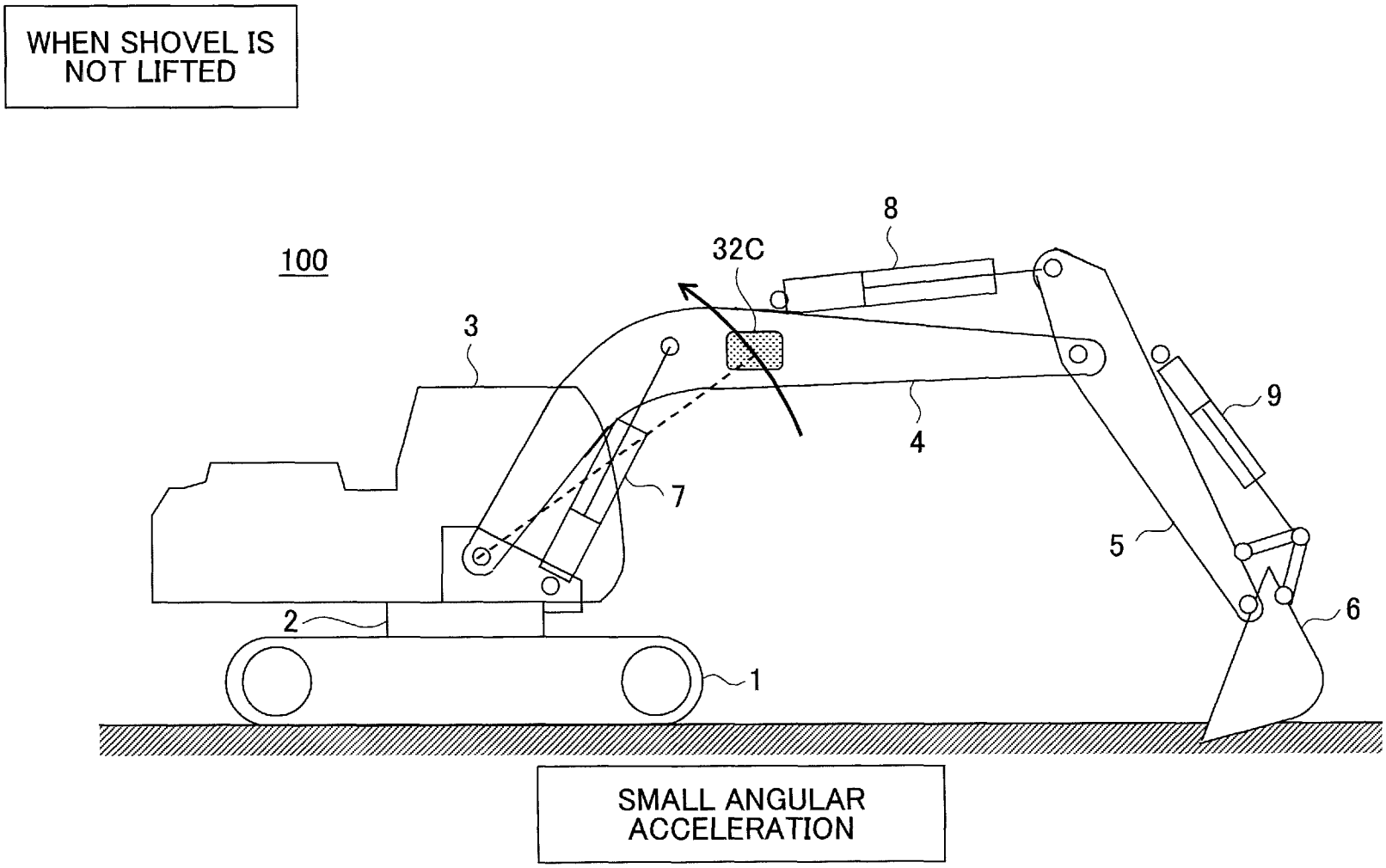
FIG. 25A is a drawing illustrating a third example of the method for determining the occurrence of lifting.
Figure 25B:
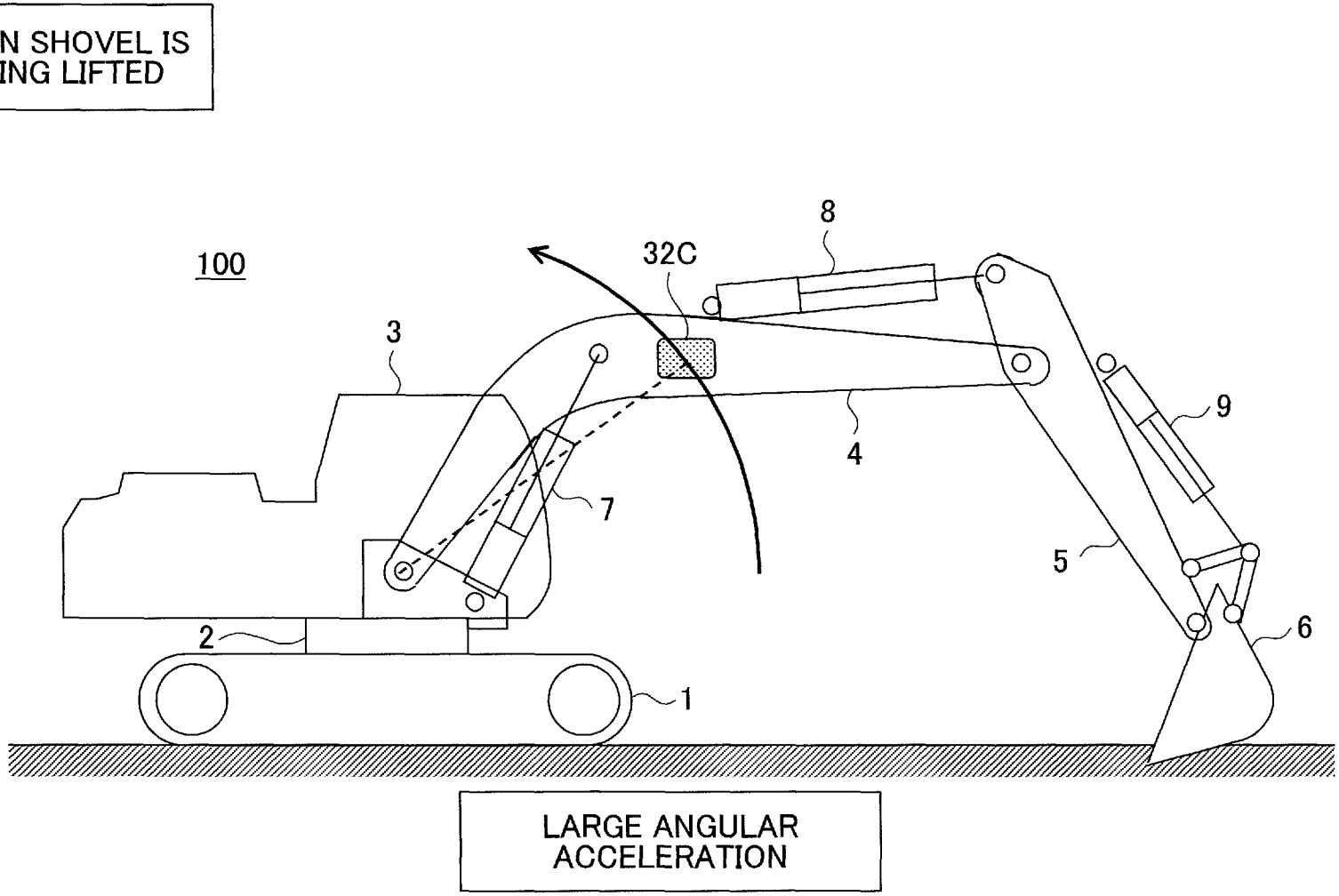
FIG. 25B is a drawing illustrating the third example of the method for determining the occurrence of lifting.

Next, FIG. 25A and FIG. 25B are drawings illustrating a third example of the method for determining the occurrence of lifting. To be more specific, FIG. 25A depicts the shovel 100 that is not lifted, and FIG. 25B depicts the shovel 100 that is being lifted.

In this example, the various types of sensors 32 include the IMU 32C, similar to FIG. 21A and FIG. 21B.

As illustrated in FIG. 25A and FIG. 25B, the IMU 32C is mounted on the boom 4, similar to FIG. 21A and FIG. 21B.

As illustrated in FIG. 25A, when the shovel 100 is not lifted, the IMU 32C of the boom 4 detects rotational motion in accordance with the relatively slow raising and lowering of the boom 4. Thus, an angular acceleration component detected by the IMU 32C is output as a relatively small value.

Conversely, as illustrated in FIG. 25B, at the time of the lifting of the shovel 100, an angular acceleration component in the lifting direction is detected by the IMU 32C and output as a relatively large value.

Therefore, when an angular acceleration component detected by the IMU 32C becomes greater than or equal to a predetermined threshold, the movement determining unit 301 may determine that the lifting of the shovel 100 has occurred. The predetermined threshold may be set as appropriate based on experiments, simulation analyses, and the like. Further, the movement determining unit 301 can determine whether the front or the rear of the shovel 100 is lifted, based on the direction of the detected acceleration component.

Further, with only the absolute value of angular acceleration generated in the boom 4, it may be difficult to determine the occurrence of the lifting of the shovel 100, when the lifting direction of the shovel 100 is opposite to the moving direction of the boom 4. Therefore, the movement determining unit 301 may determine that the shovel 100 has lifted, when the amount of change or the rate of change in angular acceleration detected by the IMU 32C of the boom 4 becomes greater than or equal to a predetermined threshold.

Further, in this example, any other sensor such as a velocity sensor or an acceleration sensor may be employed instead of the IMU 32C, as long as the motion in the rotation direction of the boom 4 can be detected. In this case, as with the IMU 32C, the movement determining unit 301 may determine that the lifting of the shovel 100 has occurred, when the output value of the sensor or the rate of change becomes relatively large.

Figure 26A:
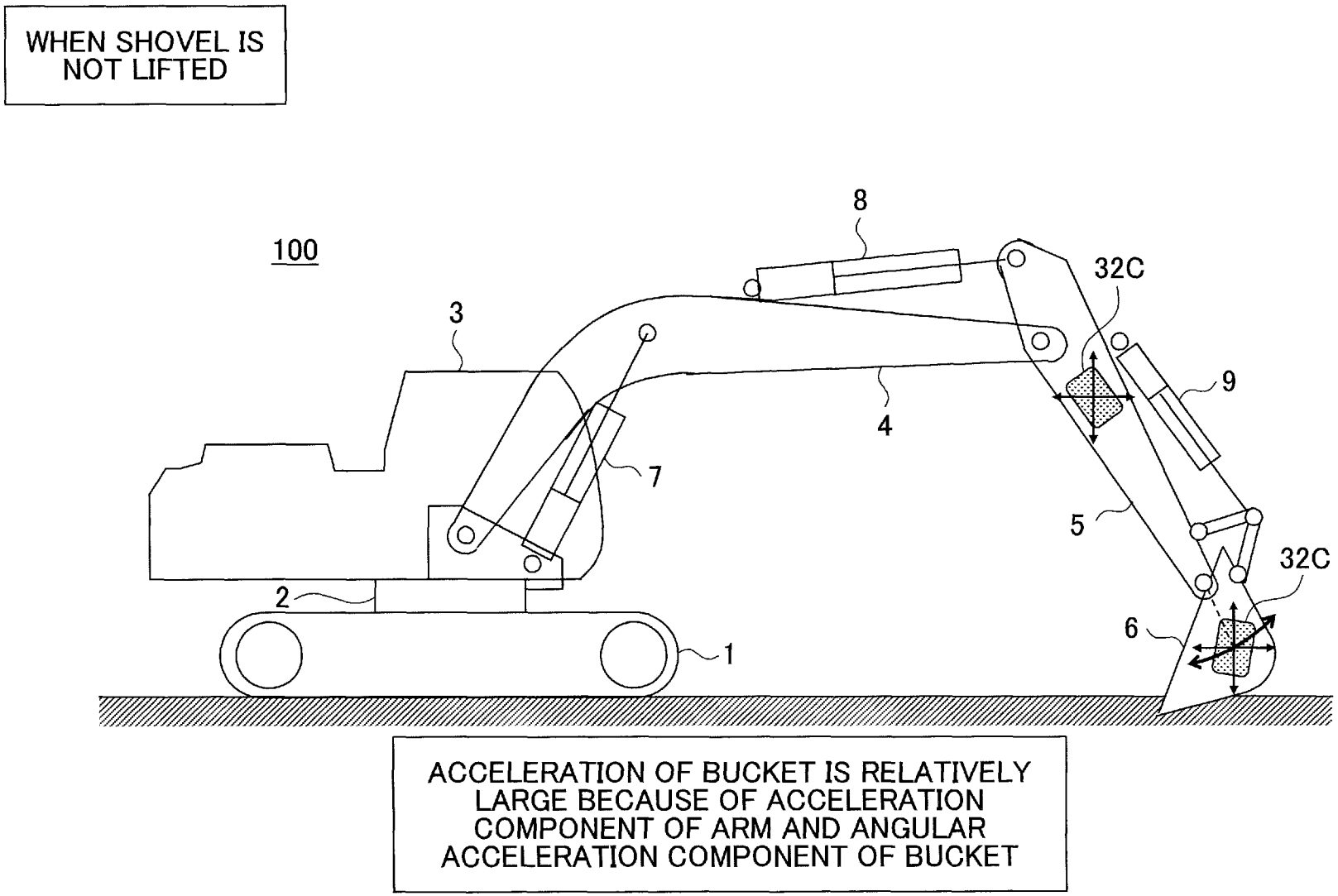
FIG. 26A is a drawing illustrating a fourth example of the method for determining the occurrence of lifting.
Figure 26B:
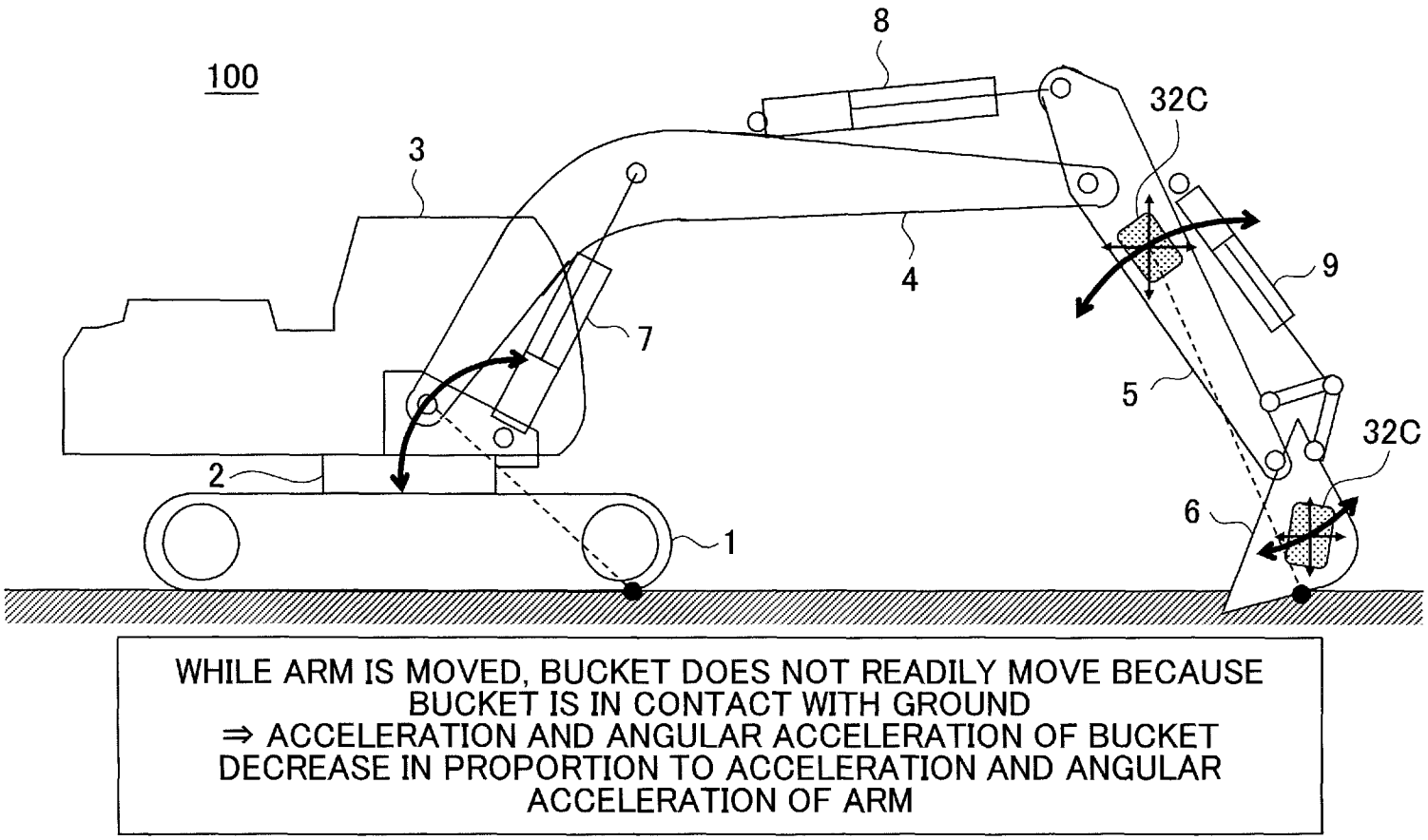
FIG. 26B is a drawing illustrating the fourth example of the method for determining the occurrence of lifting.

Next, FIG. 26A and FIG. 26B are drawings illustrating a fourth example of the method for determining the occurrence of lifting. To be more specific, FIG. 26A depicts the shovel 100 that is not lifted, and FIG. 26B depicts the shovel 100 that is being lifted.

In this example, similar to FIG. 22A and FIG. 22B, the various types of sensors 32 include two IMUs 32C.

As illustrated in FIG. 26A and FIG. 26B, one IMU 32C is mounted on the arm 5, and the other IMU 32C is mounted on the bucket 6.

As illustrated in FIG. 26A, when the shovel 100 is not lifted, an acceleration component in the front-back direction detected by the IMU 32C of the bucket 6 is represented as a combination of an acceleration component of the arm 5 and an angular acceleration component about the drive axis of the bucket 6. Therefore, the acceleration component detected by the IMU 32C of the bucket 6 becomes relatively larger than the acceleration component in the front-back direction detected by the IMU 32C of the arm 5.

Conversely, as illustrated in FIG. 26B, when the shovel 100 is lifted, the arm 5 is moved (rotated) centered on the point at which the bucket 6 makes contact with the ground. Because the bucket 6 makes contact with the ground surface for excavation work, the bucket 6 does not readily move. Therefore, an acceleration component in the front-back direction and an angular acceleration component about the drive axis detected by the IMU 32C of the bucket 6 become somewhat smaller than an acceleration component in the front-back direction and an angular acceleration component detected by the IMU 32C of the arm 5.

Thus, when the difference between acceleration components or between angular acceleration components about an axis parallel to the drive axis of the attachment, detected by the respective IMUs 32C of the arm 5 and the bucket 6, becomes greater than or equal to a predetermined threshold, the movement determining unit 301 may determine that the lifting of the shovel 100 has occurred. The predetermined threshold may be set as appropriate based on experiments, simulation analyses, and the like. Further, the movement determining unit 301 can determine whether the front or the rear of the shovel 100 is lifted, based on the direction of the acceleration component of the arm 5.

Further, the IMU 32C mounted on the arm 5 is preferably disposed closer to the position where the arm 5 is coupled to the boom 4 than to the position where the arm 5 is coupled to the bucket 6. Accordingly, with the position where the arm 5 is coupled to the bucket 6 being used as the fulcrum, the amount of movement of the arm 5 at the position where the IMU 32C is mounted can be increased as much as possible when the lifting of the shovel 100 has occurred. Thus, the movement determining unit 301 can readily determine the occurrence of lifting based on the difference between acceleration components detected by the respective IMUs 32C of the arm 5 and the bucket 6.

Further, in this example, instead of the IMUs 32C, any other sensors such as velocity sensors or acceleration sensors may be employed, as long as the sensors are capable of detecting the motion in the front-back direction of the arm 5 and the bucket 6 as well as in the rotational direction about the axis parallel to the drive axis. Further, in this example, the IMUs 32C are mounted on the arm 5 and the bucket 6; however, an additional IMU 32C may be mounted on the boom 4. Further, in this example, the IMUs 32C are mounted on the arm 5 and the bucket 6; however, an additional IMU 32C may be mounted on the boom 4. Accordingly, the movement determining unit 301 can determine the occurrence of lifting, based on the difference between output values of the respective IMUs 32C mounted on the boom 4 and the bucket 6, in addition to the difference between output values of the respective IMUs 32C mounted on the arm 5 and the bucket 6, thereby improving determination accuracy. Further, the IMU 32C is not required to be mounted on the arm 5, and the IMUs 32C may be mounted on the boom 4 and the bucket 6. In this case, the movement determining unit 301 may determine the occurrence of lifting, based on the difference between output values of the respective IMUs 32C mounted on the boom 4 and the bucket 6.

<Method for Determining Occurrence of Vibration>

The movement determining unit 301 can determine the occurrence of vibration when a sensor capable of detecting vibration, such as an acceleration sensor, an angular acceleration sensor, or an IMU, is mounted on the body (upper turning body 3). The above sensor is included in the various types of sensors 32. More specifically, the movement determining unit 301 may determine that the body of the shovel has been vibrated, when there is vibration that is caused by a change in the moment of inertia of the attachment and that matches the natural frequency of the body of the shovel, based on the outputs of the various types of sensors 32.

Further, as described above, vibration is generated while the attachment is being moved in the air. Therefore, the movement determining unit 301 may determine that the body of the shovel has been vibrated, when there is vibration that is caused by a change in the moment of inertia of the attachment during in-air movement of the attachment, and that matches the natural frequency of the body of the shovel, based on the output of the various types of sensors 32.

[Detailed Configuration for Correcting Movement of Attachment]

Next, referring to FIG. 27 through FIG. 35, a characteristic configuration of the shovel 100 according to the present embodiment, that is, an example configuration for correcting the movement of the attachment in order to minimize an unintended movement will be described.

Figure 27:
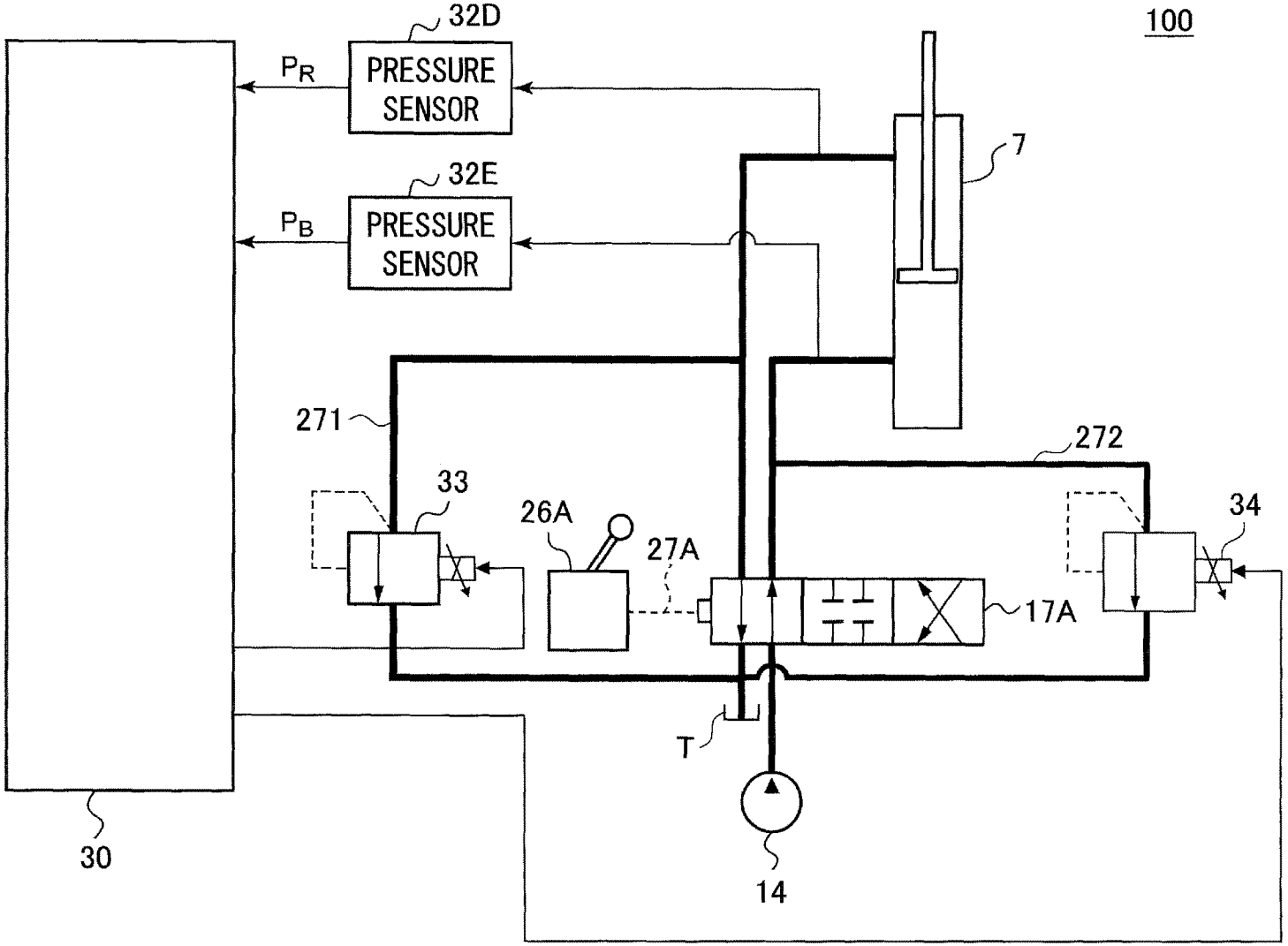
FIG. 27 is a drawing schematically illustrating a first example of a characteristic configuration of the shovel.

FIG. 27 is a drawing illustrating a first example of the characteristic configuration of the shovel 100 according to the present embodiment. More specifically, the first example mainly illustrates a configuration of a hydraulic circuit that supplies hydraulic oil to the boom cylinder 7 of the shovel 100 according to the present embodiment.

In the present example, it is assumed that the boom 4, namely the boom cylinder 7, is operated by the lever 26A. The same applies to FIG. 28 through FIG. 35. Further, a pilot line 27 that applies a secondary-side pilot pressure from the lever 26A to the port of the boom direction control valve 17A, which supplies hydraulic oil to the boom cylinder 7 and is included in the control valve 17, is referred to as a pilot line 27A.

As illustrated in FIG. 27, bypass oil passages 271 and 272 for discharging hydraulic oil into a tank T is provided. The bypass oil passage 271 extends from the rod-side oil chamber of the boom cylinder 7, and the bypass oil passage 272 extends from the bottom-side oil chamber of the boom cylinder 7.

An electromagnetic relief valve 33 for discharging hydraulic oil of the rod-side oil chamber into the tank T is provided in the bypass oil passage 271.

An electromagnetic relief valve 34 for discharging hydraulic oil of the bottom-side oil chamber into the tank T is provided in the bypass oil passage 272.

Note that the bypass oil passages 271 and 272, and the electromagnetic relief valves 33 and 34 may be provided inside of the control valve 17 or outside of the control valve 17.

Further, the various types of sensors 32 include pressure sensors 32D and 32E that detect the rod pressure $P_R$ and the bottom pressure $P_B$ of the boom cylinder 7. The outputs of the pressure sensors 32D and 32E are input into the controller 30.

The controller 30, which serves as the movement correcting unit 302, can monitor the rod pressure $P_R$ and the bottom pressure $P_B$ based on output signals from the pressure sensors 32D and 32E. The movement correcting unit 302 outputs current command values to the electromagnetic relief valves 33 and 34 as appropriate, so as to forcibly discharge hydraulic oil of either the rod-side oil chamber or the bottom-side oil chamber of the boom cylinder 7 into the tank T, thereby reducing excessive pressure in the boom cylinder 7. Accordingly, it is possible to minimize unintended movements such as dragging and lifting of the shovel 100, by reducing excessive pressure generated in the boom cylinder 7, using the correction method for correcting the movement of the boom cylinder 7 described with reference to FIG. 9A through FIG. 17C.

Figure 28:
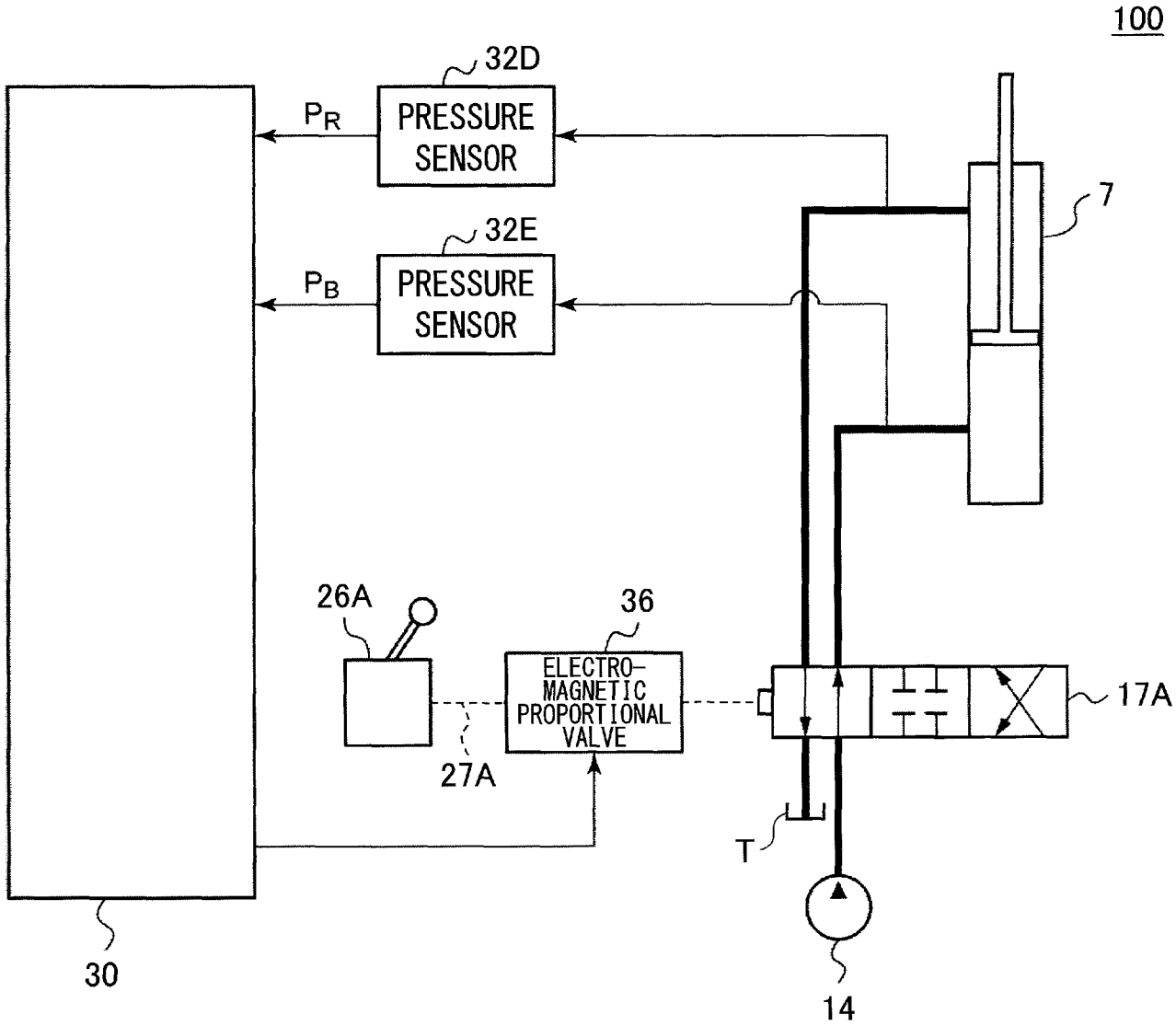
FIG. 28 is a drawing schematically illustrating a second example of the characteristic configuration of the shovel.

Next, FIG. 28 is a drawing illustrating a second example of the characteristic configuration of the shovel 100 according to the present embodiment. More specifically, the second example mainly illustrates a configuration of a hydraulic circuit that supplies hydraulic oil to the boom cylinder 7 of the shovel 100 according to the present embodiment.

As illustrated in FIG. 28, an electromagnetic proportional valve 36 is provided in the pilot line 27A between the lever 26A and the port of the boom direction control valve 17A.

Further, similar to FIG. 27, the various types of sensors 32 include the pressure sensors 32D and 32E that detect the rod pressure $P_R$ and the bottom pressure $P_B$ of the boom cylinder 7. The outputs of the pressure sensors 32D and 32E are input into the controller 30.

The controller 30, which serves as the movement correcting unit 302, can monitor the rod pressure $P_R$ and the bottom pressure $P_B$ based on output signals from the pressure sensors 32D and 32E. The movement correcting unit 302 outputs a current command value to the electromagnetic proportional valve 36 as appropriate, so as to change a pilot pressure corresponding to the state of an operation with the lever 26A and input the changed pilot pressure into the port of the boom direction control valve 17A. Namely, the movement correcting unit 302 outputs a current command value to the electromagnetic proportional valve 36 as appropriate, so as to control the boom direction control valve 17A. As a result, the movement correcting unit 302 can cause hydraulic oil of either the rod-side oil chamber or the bottom-side oil chamber of the boom cylinder 7 to be discharged into the tank T as appropriate, thereby reducing excessive pressure in the boom cylinder 7. Accordingly, it is possible to minimize unintended movements such as dragging and lifting of the shovel 100, by reducing excessive pressure generated in the boom cylinder 7, using the correction method for correcting the movement of the boom cylinder 7 described with reference to FIG. 9A through FIG. 17C.

In this example, a signal corresponding to the state of an operation performed by the operator with the lever 26A, namely a signal corresponding to the operating state of the boom 4 is corrected and the corrected signal is input into the boom direction control valve 17A. However, a signal different from the signal corresponding to the operating state of the boom 4 may be input into the boom direction control valve 17A. For example, the electromagnetic proportional valve 36 may be provided in an oil passage that branches from the pilot line 25 located on an upstream side (on the pilot pump 15 side) relative to the lever 26A, and that is connected to the port of the boom direction control valve 17A. In this case, the movement correcting unit 302 may input the signal different from the signal corresponding to the operating state of the boom 4 into the boom direction control valve 17A, such that the boom direction control valve 17A can be controlled regardless of the state of an operation with the lever 26A. Further, in normal state, the controller 30 may output a current command to the electromagnetic proportional valve 36, based on a pressure signal corresponding to the state of an operation with the lever 26A detected by the pressure sensor 29. As a result, the boom direction control valve 17A can be controlled in accordance with the state of the operation performed by the operator with the lever 26A.

Figure 29:
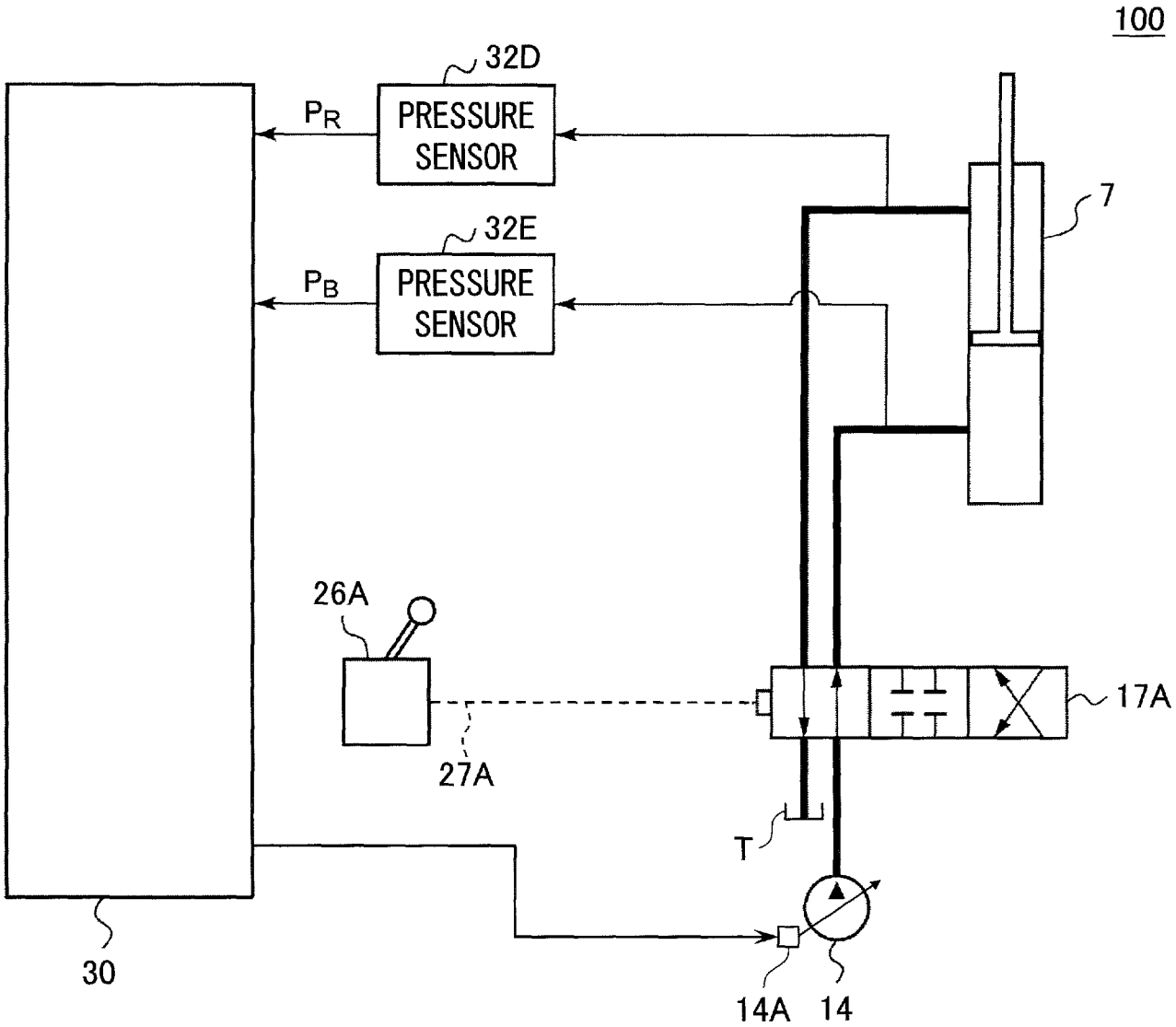
FIG. 29 is a drawing schematically illustrating a third example of the characteristic configuration of the shovel.

Next, FIG. 29 is a drawing illustrating a third example of the characteristic configuration of the shovel 100 according to the present embodiment. More specifically, the third example mainly illustrates a configuration of a hydraulic circuit that supplies hydraulic oil to the boom cylinder 7 of the shovel 100 according to the present embodiment.

As illustrated in FIG. 29, similar to FIG. 27, the various types of sensors 32 include the pressure sensors 32D and 32E that detect the rod pressure $P_R$ and the bottom pressure $P_B$ of the boom cylinder 7. The outputs of the pressure sensors 32D and 32E are input into the controller 30.

The controller 30, which serves as the movement correcting unit 302, can monitor the rod pressure $P_R$ and the bottom pressure $P_B$ based on output signals from the pressure sensors 32D and 32E. The movement correcting unit 302 outputs, as appropriate, a current command value to the regulator 14A that controls the inclination angle of the swash plate, so as to control the output and the flow rate of the main pump 14. Namely, the movement correcting unit 302 outputs a current command value to the regulator 14A as appropriate, so as to control the operation of the main pump 14. As a result, the flow rate of hydraulic oil supplied to the boom cylinder 7 can be controlled, thereby reducing excessive pressure in the boom cylinder 7. Accordingly, it is possible to minimize unintended movements such as dragging and lifting of the shovel 100, by reducing excessive pressure generated in the boom cylinder 7, using the correction method for correcting the movement of the boom cylinder 7 described with reference to FIG. 9A through FIG. 17C.

Figure 30:
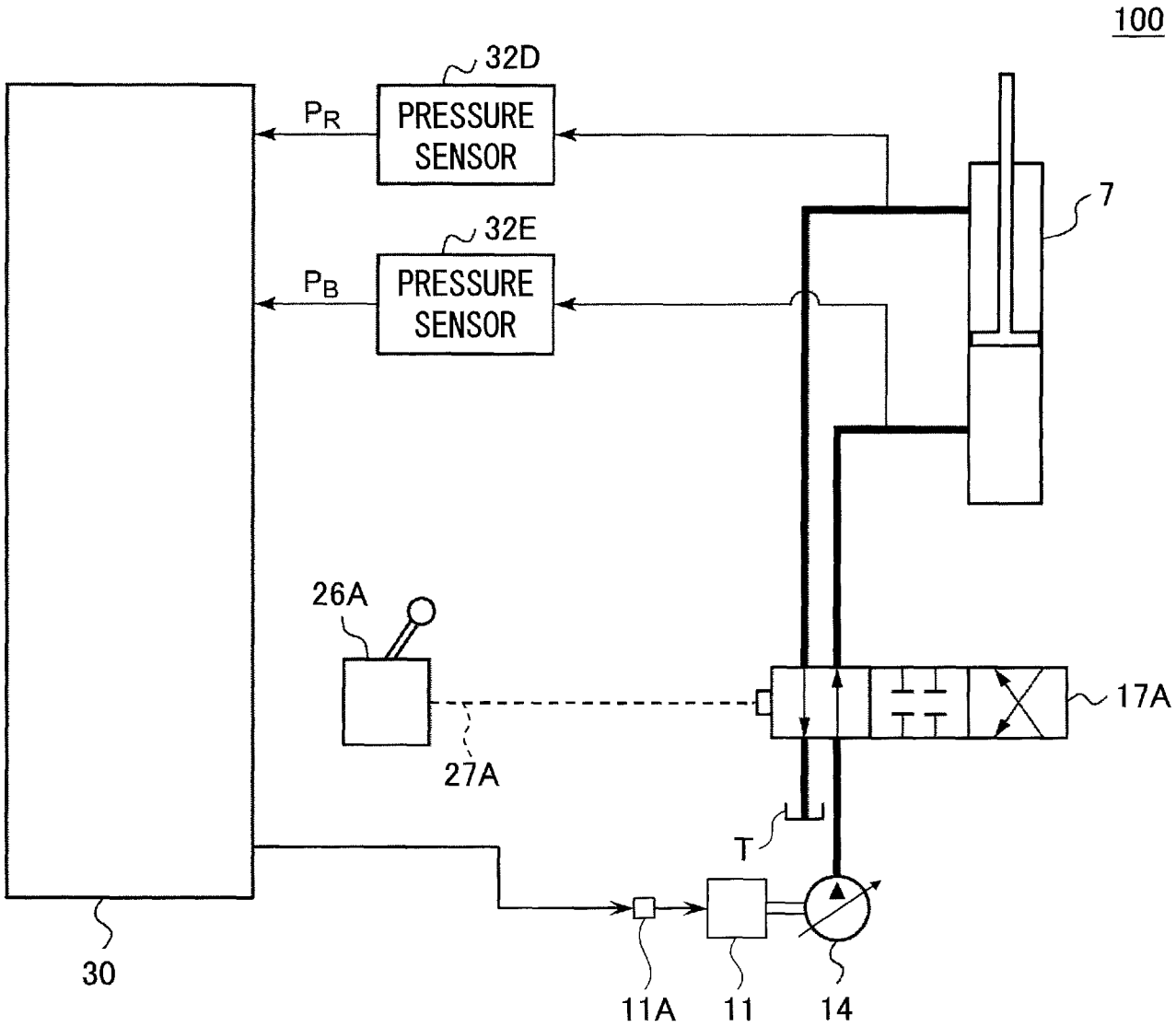
FIG. 30 is a drawing schematically illustrating a fourth example of the characteristic configuration of the shovel.

Next, FIG. 30 is a drawing illustrating a fourth example of the characteristic configuration of the shovel 100 according to the present embodiment. More specifically, the fourth example mainly illustrates a configuration of a hydraulic circuit that supplies hydraulic oil to the boom cylinder 7 of the shovel 100 according to the present embodiment.

As illustrated in FIG. 30, similar to FIG. 27, the various types of sensors 32 include the pressure sensors 32D and 32E that detect the rod pressure $P_R$ and the bottom pressure $P_B$ of the boom cylinder 7. The outputs of the pressure sensors 32D and 32E are input into the controller 30.

The controller 30, which serves as the movement correcting unit 302, can monitor the rod pressure $P_R$ and the bottom pressure $P_B$ based on output signals from the pressure sensors 32D and 32E. The movement correcting unit 302 outputs, as appropriate, a current command value to an engine control module (EMC) 11A that controls the operating state of the engine 11, so as to control the output of the engine 11. Namely, the movement correcting unit 302 outputs a current command value to the EMC 11A as appropriate, so as to control the output of the engine 11. As a result, the output of the main pump 14 driven by the engine 11 is controlled, thereby controlling the flow rate of hydraulic oil supplied to the boom cylinder 7. Namely, the movement correcting unit 302 can reduce excessive pressure in the boom cylinder 7. Accordingly, it is possible to minimize unintended movements such as dragging and lifting of the shovel 100 by reducing excessive pressure generated in the boom cylinder 7, using the correction method for correcting the movement of the boom cylinder 7 described with reference to FIG. 9A through FIG. 17C.

Figure 31:
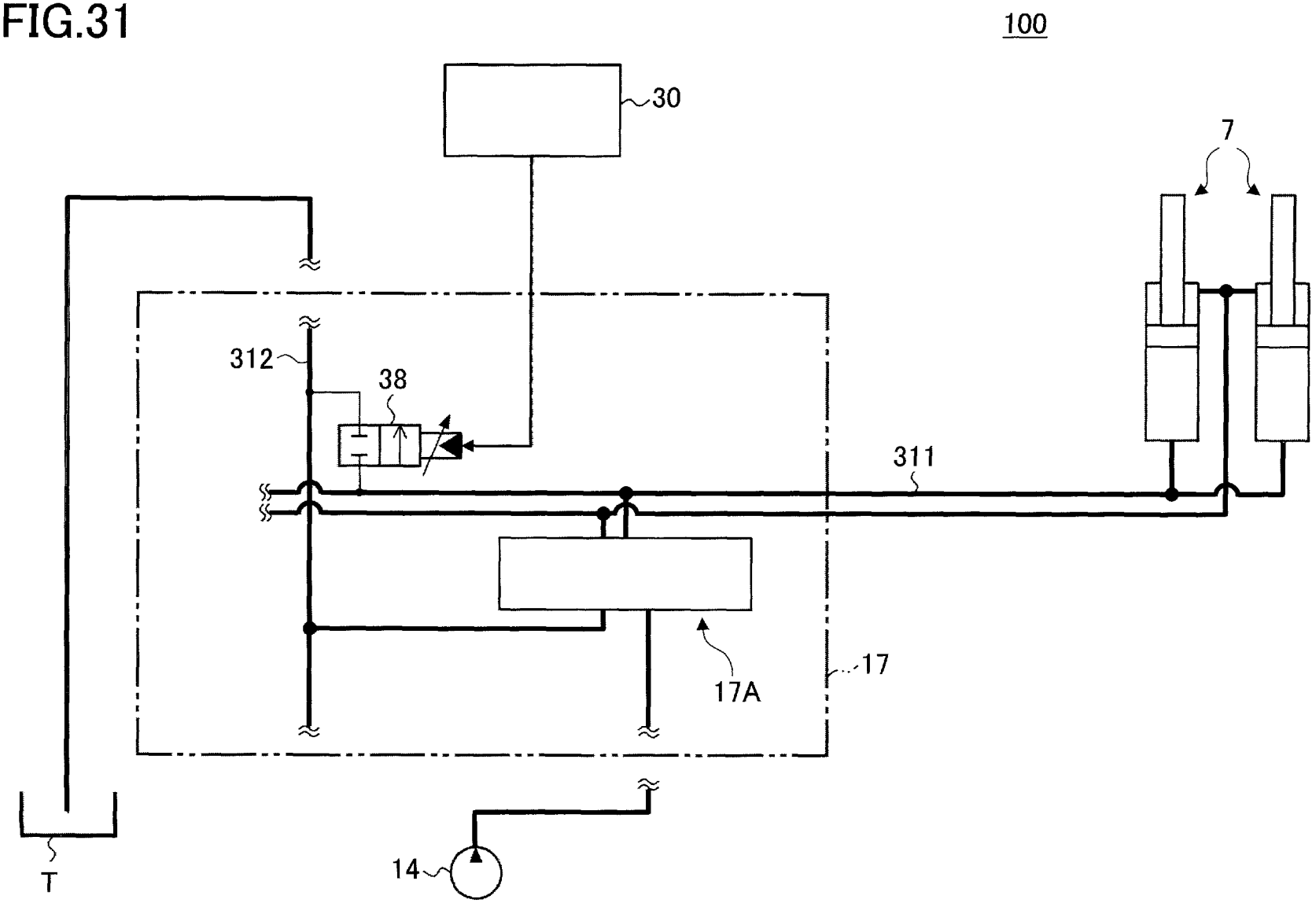
FIG. 31 is a drawing schematically illustrating a fifth example of the characteristic configuration of the shovel.

Next, FIG. 31 is a drawing illustrating a fifth example of the characteristic configuration of the shovel 100 according to the present embodiment. More specifically, the fifth example mainly illustrates a configuration of a hydraulic circuit that supplies hydraulic oil to the boom cylinder 7 of the shovel 100 according to the present embodiment.

In this example, it is assumed that pressure sensors similar to the pressure sensors 32D and 32E of FIG. 27 through FIG. 30 are included in the various types of sensors 32. The same applies to FIG. 32 through FIG. 35.

As illustrated in FIG. 31, in this example, the control valve 17 includes an electromagnetic selector valve 38.

The electromagnetic selector valve 38 is provided such that hydraulic oil flows from an oil passage 311, which connects the boom direction control valve 17A and the bottom-side oil chamber of the boom cylinder 7, to an oil passage 312, which circulates hydraulic oil into the tank T. Accordingly, when in a communication state, the electromagnetic selector valve 38 can discharge hydraulic oil in the bottom-side oil chamber of the boom cylinder 7 into the tank T.

The controller 30, which serves as the movement correcting unit 302, can monitor the rod pressure $P_R$ and the bottom pressure $P_B$ based on output signals from the various types of sensors 32 (the pressure sensors that detect the pressure of the rod-side oil chamber and the pressure of the bottom-side oil chamber of the boom cylinder 7). The movement correcting unit 302 outputs, as appropriate, a current command value to the electromagnetic selector valve 38, so as to control a communication state and a shutoff state of the electromagnetic selector valve 38. Namely, the movement correcting unit 302 outputs a current command value to the electromagnetic selector valve 38 as appropriate, so as to cause hydraulic oil in the bottom-side oil chamber of the boom cylinder 7 to be discharged into the tank T via the electromagnetic selector valve 38, thereby reducing excessive pressure (bottom pressure $P_B$) generated in the bottom-side oil chamber of the boom cylinder 7. Accordingly, it is possible to minimize unintended movements such as dragging and lifting of the shovel 100 by reducing excessive pressure generated in the boom cylinder 7, using the correction method for correcting the movement of the boom cylinder 7 described with reference to FIG. 9A through FIG. 17C.

Further, an electromagnetic selector valve may be provided within the control valve 17 such that hydraulic oil flows from an oil passage, which connects the boom direction control valve 17A and the rod-side oil chamber of the boom cylinder 7, to the oil passage 312, which circulates hydraulic oil into the tank T. In this case, the movement correcting unit 302 may also output a current command value to the electromagnetic selector valve as appropriate, so as to reduce excessive pressure generated in the rod-side oil chamber of the boom cylinder 7.

Figure 32:
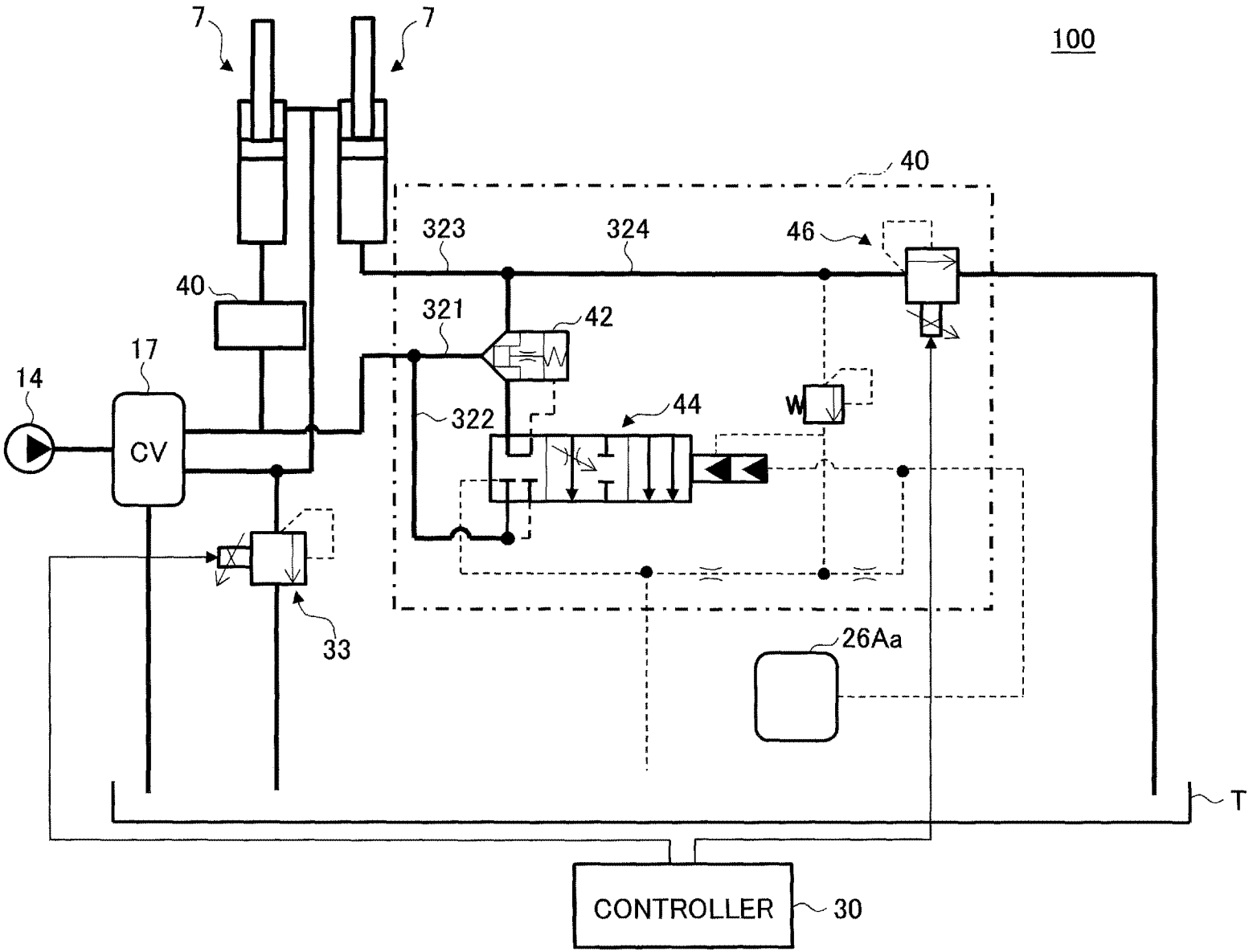
FIG. 32 is a drawing schematically illustrating a sixth example of the characteristic configuration of the shovel.

Next, FIG. 32 is a drawing illustrating a sixth example of the characteristic configuration of the shovel 100 according to the present embodiment. More specifically, the sixth example mainly illustrates a configuration of a hydraulic circuit that supplies hydraulic oil to a boom cylinder 7 of the shovel 100 according to the present embodiment. In FIG. 32, two boom cylinders 7 are illustrated. The two boom cylinders 7 have the same configuration in which the control valve 17 and a pressure holding circuit 40, which will be described below, are provided between the main pump 14 and each of the boom cylinders 7. Thus, one boom cylinder 7 (on the right in the figure) will be mainly described.

In this example, similar to FIG. 27, an electromagnetic relief valve 33 for discharging hydraulic oil in the rod-side oil chamber into the tank T is provided in an oil passage that branches from an oil passage between the control valve 17 and the rod-side oil chamber of a boom cylinder 7. The same applies to FIG. 33.

As illustrated in FIG. 32, in this example, the shovel 100 includes the pressure holding circuit 40. Even if a hydraulic hose is damaged, for example is ruptured, the pressure holding circuit 40 holds hydraulic oil of the bottom-side oil chamber of the boom cylinder 7 so as not to discharge the hydraulic oil. The same applies to FIG. 33 through FIG. 35.

The pressure holding circuit 40 is provided in an oil passage that connects the control valve 17 to the bottom-side oil chamber of the boom cylinder 7. The pressure holding circuit 40 mainly includes a holding valve 42 and a spool valve 44.

Regardless of the state of the spool valve 44, the holding valve 42 supplies hydraulic oil, received from the control valve 17 via an oil passage 321, to the bottom-side oil chamber of the boom cylinder 7.

Further, when the spool valve 44 is in a shutoff state (spool state on the left of the figure), the holding valve 42 holds hydraulic oil of the bottom-side oil chamber of the boom cylinder 7 such that the hydraulic oil is not discharged to the downstream side of the pressure holding circuit 40. Conversely, when the spool valve 44 is in a communication state (spool state on the right of the figure), the holding valve 42 discharges hydraulic oil of the bottom-side oil chamber of the boom cylinder 7 to the downstream side of the pressure holding circuit 40 via an oil passage 322.

The communication state and the shutoff state of the spool valve 44 are controlled in accordance with a pilot pressure that is input into the port of the spool valve 44 from a boom-lowering remote control valve 26Aa. The pilot pressure input from the boom-lowering remote control valve 26Aa corresponds to the state of a lowering operation of the boom 4 (a boom lowering operation) performed with the lever 26A. More specifically, when a pilot pressure, indicating that the boom lowering operation is being performed, is input from the boom-lowering remote control valve 26Aa, the spool valve 44 is put in a communication state (spool state on the right of the figure). Conversely, when a pilot pressure, indicating that the boom lowering operation is not performed, is input from the boom-lowering remote control valve 26Aa, the spool valve 44 is put in a shutoff state (spool state on the left of the figure). Accordingly, even if a hydraulic hose located on the downstream side of the pressure holding circuit 40 is damaged, hydraulic oil (bottom pressure) of the bottom-side oil chamber of the boom cylinder 7 can be held, thereby preventing the falling of the boom 4 when the boom lowering operation is not performed.

Further, the pressure holding circuit 40 also includes an electromagnetic relief valve 46.

The electromagnetic relief valve 46 is provided in an oil passage 324 that branches from an oil passage 323 and is connected to the tank T. The oil passage 323 is provided between the holding valve 42 of the holding circuit 40 and the bottom oil chamber of the boom cylinder 7. Namely, the electromagnetic relief valve 46 releases hydraulic oil from the oil passage 323, which is on the upstream side (the boom cylinder 7 side) relative to the holding valve 42, into the tank T. Accordingly, regardless of the operating state of the pressure holding circuit 40, and specifically, regardless of the communication state or the shutoff state of the spool valve 44, the electromagnetic relief valve 46 can discharge hydraulic oil of the bottom-side oil chamber of the boom cylinder 7 into the tank T. Namely, the pressure holding circuit 40 can reduce excessive pressure by discharging hydraulic oil of the bottom-side oil chamber of the boom cylinder 7 regardless of whether the boom lowering operation is performed, while also preventing the falling of the boom 4, using the function for holding hydraulic oil of the bottom-side oil chamber of the boom cylinder 7.

The controller 30, which serves as the movement correcting unit 302, can monitor the rod pressure $P_R$ and the bottom pressure $P_B$ based on output signals from the various types of sensors 32 (the pressure sensors that detect the pressure of the rod-side oil chamber and the pressure of the bottom-side oil chamber of the boom cylinder 7). Further, the movement correcting unit 302 outputs, as appropriate, current command values to the electromagnetic relief valves 33 and 46, so as to forcibly discharge hydraulic oil of either the rod-side oil chamber or the bottom-side oil chamber of the boom cylinder 7 into the tank T regardless of whether the boom lowering operation is performed. As a result, excessive pressure in the boom cylinder 7 can be reduced. Accordingly, it is possible to minimize unintended movements such as dragging and lifting of the shovel 100, by reducing excessive pressure generated in the boom cylinder 7, using the correction method for correcting the movement of the boom cylinder 7 described with reference to FIG. 9A through FIG. 17C.

Figure 33:
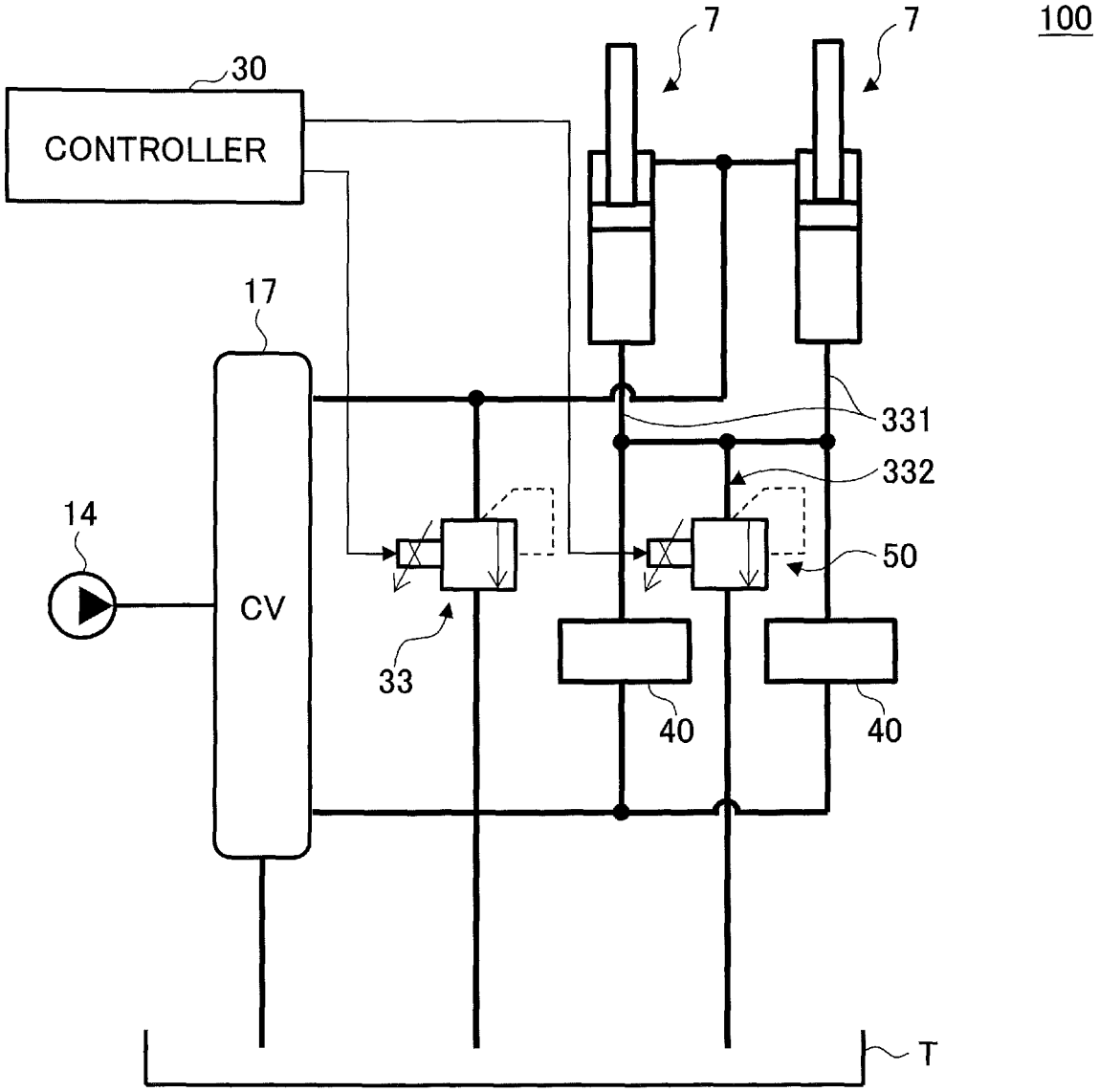
FIG. 33 is a drawing schematically illustrating a seventh example of the characteristic configuration of the shovel.

Next, FIG. 33 is a drawing illustrating a seventh example of the characteristic configuration of the shovel 100 according to the present embodiment. More specifically, the seventh example mainly illustrates a configuration of a hydraulic circuit that supplies hydraulic oil to a boom cylinder 7 of the shovel 100 according to the present embodiment.

As illustrated in FIG. 33, in this example, an electromagnetic relief valve 50 is provided in an oil passage 332 that branches from an oil passage 331 and is connected to the tank T. The oil passage 331 is provided between the bottom oil chamber of the boom cylinder 7 and a pressure holding circuit 40. Accordingly, regardless of the operating state of the pressure holding circuit 40, and specifically, regardless of the communication state or the shutoff state of a spool valve 44, the electromagnetic relief valve 50 can discharge hydraulic oil of the bottom-side oil chamber of the boom cylinder 7 into the tank T. Namely, the pressure holding circuit 40 can reduce excessive pressure by discharging hydraulic oil of the bottom-side oil chamber of the boom cylinder 7 regardless of whether the boom lowering operation is performed, while also preventing the falling of the boom 4 by the function for holding hydraulic oil of the bottom-side oil chamber of the boom cylinder 7.

The controller 30, which serves as the movement correcting unit 302, can monitor the rod pressure $P_R$ and the bottom pressure $P_B$ based on output signals from the various types of sensors 32 (the pressure sensors that detect the pressure of the rod-side oil chamber and the pressure of the bottom-side oil chamber of the boom cylinder 7). Further, the movement correcting unit 302 outputs, as appropriate, current command values to the electromagnetic relief valves 33 and 50, so as to forcibly discharge hydraulic oil of either the rod-side oil chamber or the bottom-side oil chamber of the boom cylinder 7 into the tank T regardless of whether the boom lowering operation is performed. As a result, excessive pressure in the boom cylinder 7 can be reduced. Accordingly, it is possible to minimize unintended movements such as dragging and lifting of the shovel 100, by reducing excessive pressure generated in the boom cylinders 7, using the correction method for correcting the movement of the boom cylinder 7 described with reference to FIG. 9A through FIG. 17C.

Figure 34:
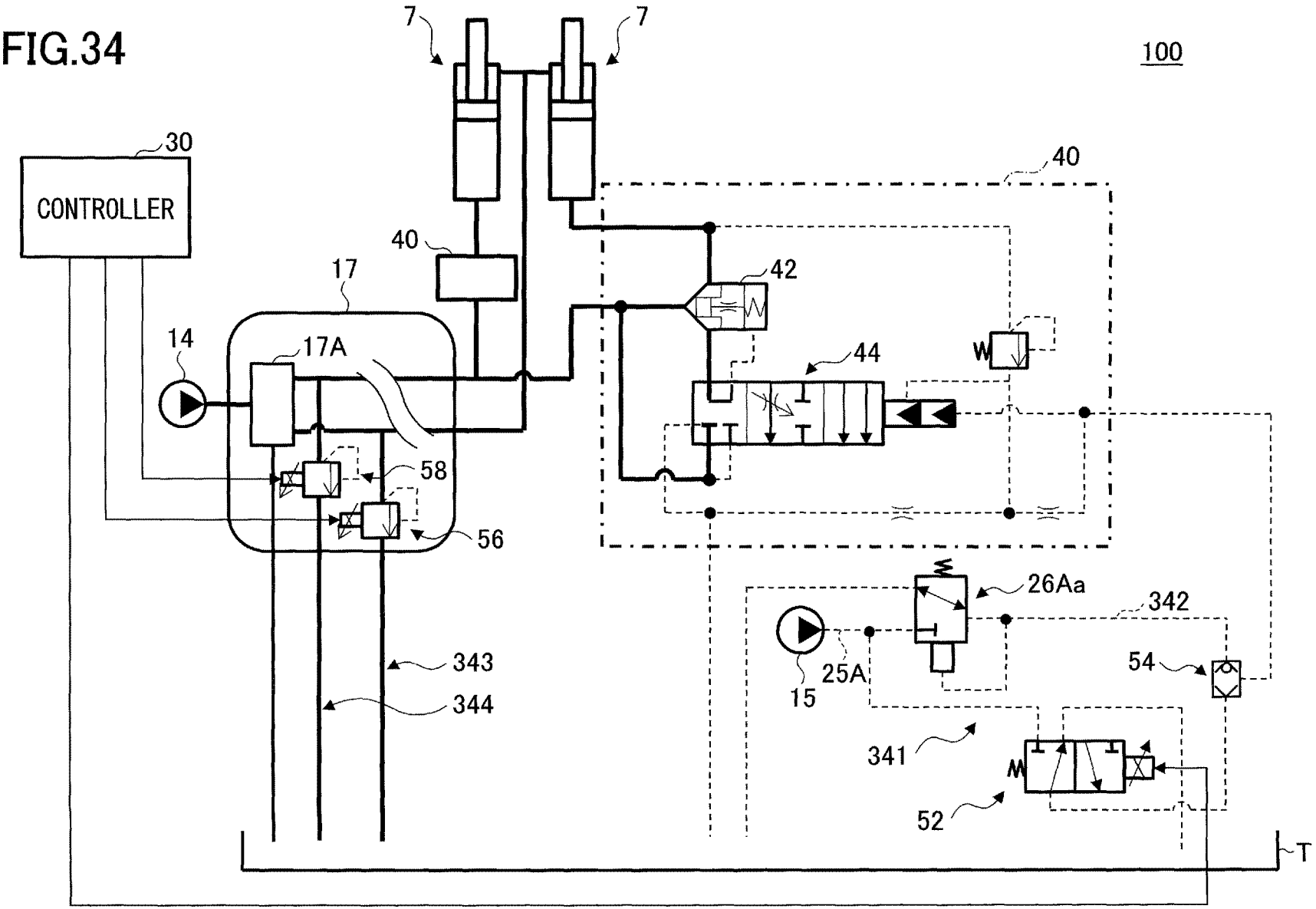
FIG. 34 is a drawing schematically illustrating an eighth example of the characteristic configuration of the shovel.

Next, FIG. 34 is a drawing illustrating an eighth example of the characteristic configuration of the shovel 100 according to the present embodiment. More specifically, the eighth example mainly illustrates a configuration of a hydraulic circuit that supplies hydraulic oil to a boom cylinder 7 of the shovel 100 according to the present embodiment.

As illustrated in FIG. 34, an electromagnetic selector valve 52 and a shuttle valve 54 are provided in a pilot circuit that applies a pilot pressure, corresponding to the state of the boom lowering operation, from the boom-lowering remote control valve 26Aa to the spool valve 44 of the pressure holding circuit 40.

The electromagnetic selector valve 52 is provided in an oil passage 341. The oil passage 341 branches from a pilot line 25A provided between the pilot pump 15 and the boom-lowering remote control valve 26Aa, bypasses the boom-lowering remote control valve 26Aa, and is connected to one input port of the shuttle valve 54. The electromagnetic selector valve 52 switches between the communication state and the shutoff state of the oil passage 341.

Note that, instead of the electromagnetic selector valve 52, an electromagnetic proportional valve may be employed to switch between the communication state and the shutoff state of the oil passage 341.

As described above, the oil passage 341 is connected to the one input port of the shuttle valve 54, and a secondary-side oil passage 342 of the boom-lowering remote control valve 26Aa is connected to the other input port of the shuttle valve 54. Among the two input pilot pressures, the shuttle valve 54 outputs a higher pilot pressure to the spool valve 44. Accordingly, even when the boom lowering operation is not performed, a pilot pressure similar to that when the boom lowering operation is performed can be input into the spool valve 44 via the electromagnetic selector valve 52 and the shuttle valve 54. Namely, even when the boom lowering operation is not performed, hydraulic oil in the bottom-side oil chamber of a boom cylinder 7 can flow out to the downstream side of the pressure holding circuit 40.

Further, in this example, electromagnetic relief valves 56 and 58 are provided inside of the control valve 17.

Note that the electromagnetic relief valves 56 and 58 may be provided outside of the control valve 17, as long as the electromagnetic relief valves 56 and 58 can branch from oil passages between the boom direction control valve 17A and the pressure holding circuit 40, and can discharge hydraulic oil into the tank T.

The electromagnetic relief valve 56 is provided in an oil passage 343. The oil passage 343 branches from an oil passage between the rod-side oil chamber of the boom cylinder 7 and the boom direction control valve 17A, and is connected to the tank T. Accordingly, the electromagnetic relief valve 56 can discharge hydraulic oil of the rod-side oil chamber of the boom cylinder 7 into the tank T.

The electromagnetic relief valve 58 is provided in an oil passage 344. The oil passage 344 branches from an oil passage between the pressure holding circuit 40 and the boom direction control valve 17A, and is connected to the tank T. Accordingly, the electromagnetic relief valve 58 can discharge hydraulic oil, flowing out from the bottom-side oil chamber of the boom cylinder 7 via the pressure holding circuit 40, into the tank T. That is, even when the boom lowering operation is not performed, the above-described electromagnetic selector valve 52 and the shuttle valve 54 cause hydraulic oil of the bottom-side oil chamber of the boom cylinder 7 to be discharged into the tank T, thereby reducing excessive bottom pressure $P_B$.

In this example, if the electromagnetic selector valve 38 of FIG. 31 is provided within the control valve 17, the electromagnetic relief valve 58 may be replaced with the electromagnetic selector valve 38. Further, as described above with reference to FIG. 31, an electromagnetic selector valve may be provided within the control valve 17 such that hydraulic oil passes from the oil passage, which connects the boom direction control valve 17A and the rod-side oil chamber of the boom cylinder 7, to an oil passage, which circulates hydraulic oil into the tank T. In this case, the electromagnetic relief valve 56 may be replaced with the above-described electromagnetic selector valve.

The controller 30, which serves as the movement correcting unit 302, can monitor the rod pressure $P_R$ and the bottom pressure $P_B$ based on output signals from the various types of sensors 32 (the pressure sensors that detect the pressure of the rod-side oil chamber and the pressure of the bottom-side oil chamber of the boom cylinder 7). Further, the movement correcting unit 302 outputs, as appropriate, current command values to the electromagnetic selector valve 52 and the electromagnetic relief valves 56 and 58, so as to forcibly discharge hydraulic oil of either the rod-side oil chamber or the bottom-side oil chamber of the boom cylinder 7 into the tank T regardless of whether the boom lowering operation is performed. As a result, excessive pressure in the boom cylinder 7 can be reduced. Accordingly, it is possible to minimize unintended movements such as dragging and lifting of the shovel 100, by reducing excessive pressure generated in the boom cylinders 7, using the correction method for correcting the movement of the boom cylinder 7 described with reference to FIG. 9A through FIG. 17C.

Figure 35:
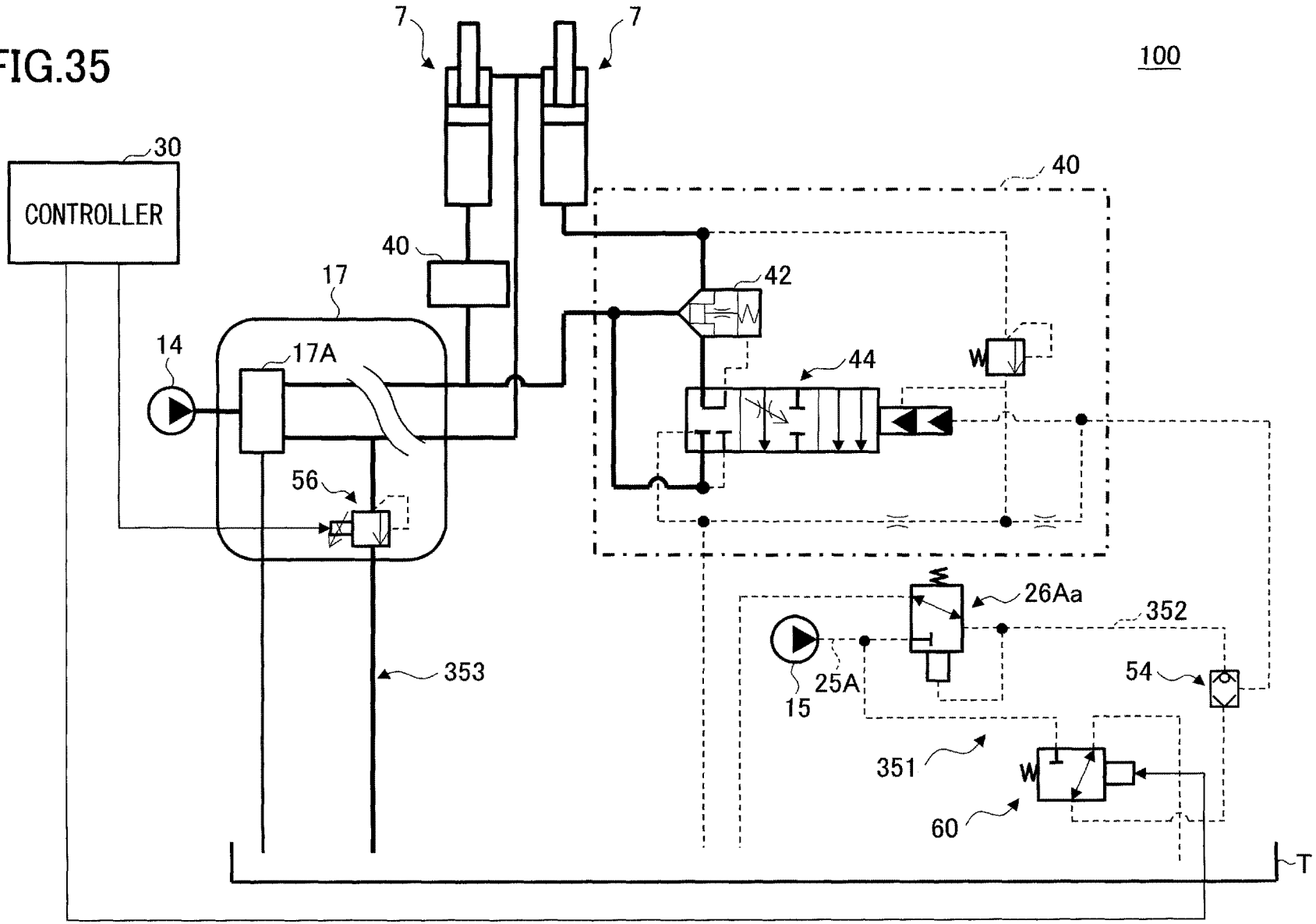
FIG. 35 is a drawing schematically illustrating a ninth example of the characteristic configuration of the shovel.

Next, FIG. 35 is a drawing illustrating a ninth example of the characteristic configuration of the shovel 100 according to the present embodiment. More specifically, the ninth example mainly illustrates a configuration of a hydraulic circuit that supplies hydraulic oil to a boom cylinder 7 of the shovel 100 according to the present embodiment.

As illustrated in FIG. 35, in this example, an electromagnetic proportional valve 60 and a shuttle valve 54, which is similar to that of FIG. 34, are provided in a pilot circuit that applies a pilot pressure, corresponding to the state of the boom lowering operation, from the boom-lowering remote control valve 26Aa to the spool valve 44 of the pressure holding circuit 40.

The electromagnetic proportional valve 60 is provided in an oil passage 351. The oil passage 351 branches from the pilot line 25A provided between the pilot pump 15 and the boom-lowering remote control valve 26Aa, bypasses the boom-lowering remote control valve 26Aa, and is connected to one input port of the shuttle valve 54. The electromagnetic proportional valve 60 controls the switching between the communication state and the shutoff state of the oil passage 341, and also controls a pilot pressure input into the shuttle valve 54.

Similar to FIG. 34, the oil passage 351 is connected to the one input port of the shuttle valve 54, and a secondary-side oil passage 352 of the boom-lowering remote control valve 26Aa is connected to the other input port of the shuttle valve 54. Among the two input pilot pressures, the shuttle valve 54 outputs a higher pilot pressure to the spool valve 44. Accordingly, even when the boom lowering operation is not performed, a pilot pressure similar to that when the boom lowering operation is performed can be input into the spool valve 44 via the electromagnetic selector valve 52 and the shuttle valve 54. Namely, even when the boom lowering operation is not performed, hydraulic oil in the bottom-side oil chamber of a boom cylinder 7 can flow out to the downstream side of the pressure holding circuit 40.

Further, in this example, the electromagnetic relief valve 56 is provided inside of the control valve 17.

Note that the electromagnetic relief valve 56 may be provided outside of the control valve 17, as long as the electromagnetic relief valve 56 can branch from an oil passage provided between the boom direction control valve 17A and the pressure holding circuit 40, and can discharge hydraulic oil into the tank T.

Similar to FIG. 34, the electromagnetic relief valve 56 is provided in an oil passage 353. The oil passage 353 branches from an oil passage provided between the rod-side oil chamber of the boom cylinder 7 and the boom direction control valve 17A, and is connected to the tank T. Accordingly, the electromagnetic relief valve 56 can discharge hydraulic oil of the rod-side oil chamber of the boom cylinder 7 into the tank T.

The controller 30, which serves as the movement correcting unit 302, can monitor the rod pressure $P_R$ and the bottom pressure $P_B$ based on output signals from the various types of sensors 32 (the pressure sensors that detect the pressure of the rod-side oil chamber and the pressure of the bottom-side oil chamber of the boom cylinder 7). Further, the movement correcting unit 302 outputs, as appropriate, a current command value to the electromagnetic relief valve 56, so as to forcibly discharge hydraulic oil in the rod-side oil chamber of the boom cylinder 7 into the tank T, thereby reducing excessive pressure (rod pressure) in the rod-side oil chamber of the boom cylinder 7.

Further, because the electromagnetic proportional valve 60 is employed, a pilot pressure, input into the shuttle valve 54 via the shuttle valve 54, can be finely controlled. Therefore, the controller 30 can finely control the operating state of the electromagnetic proportional valve 60 by outputting a current command value to the electromagnetic proportional valve 60. As a result, the controller 30 can finely adjust the flow rate of hydraulic oil flowing out from the bottom-side oil chamber of the boom cylinder 7 via the pressure holding circuit 40. In other words, independently of the control valve 17, the controller 30 can adjust the flow rate of hydraulic oil flowing out from the bottom-side oil chamber of the boom cylinder 7 via the control valve 17 during the boom lowering operation. Accordingly, regardless of whether the boom lowering operation is performed, the controller 30, which serves as the movement correcting unit 302, can cause hydraulic oil in the bottom-side oil chamber of the boom cylinder 7 to be discharged into the tank T as necessary by outputting a current command value to the electromagnetic proportional valve 6. As a result, excessive pressure in the boom cylinder 7 can be reduced.

Accordingly, it is possible to minimize unintended movements such as dragging and lifting of the shovel 100, by reducing excessive pressure generated in the boom cylinder 7, using the correction method for correcting the movement of the boom cylinder 7 described with reference to FIG. 9A through FIG. 17C.

[Details of Process for Correcting Movement of Attachment]

Next, referring to FIG. 36, a process for correcting the movement of the attachment (a movement correcting process) performed by the controller 30 (the movement determining unit 301 and the movement correcting unit 302) will be described.

Figure 36:
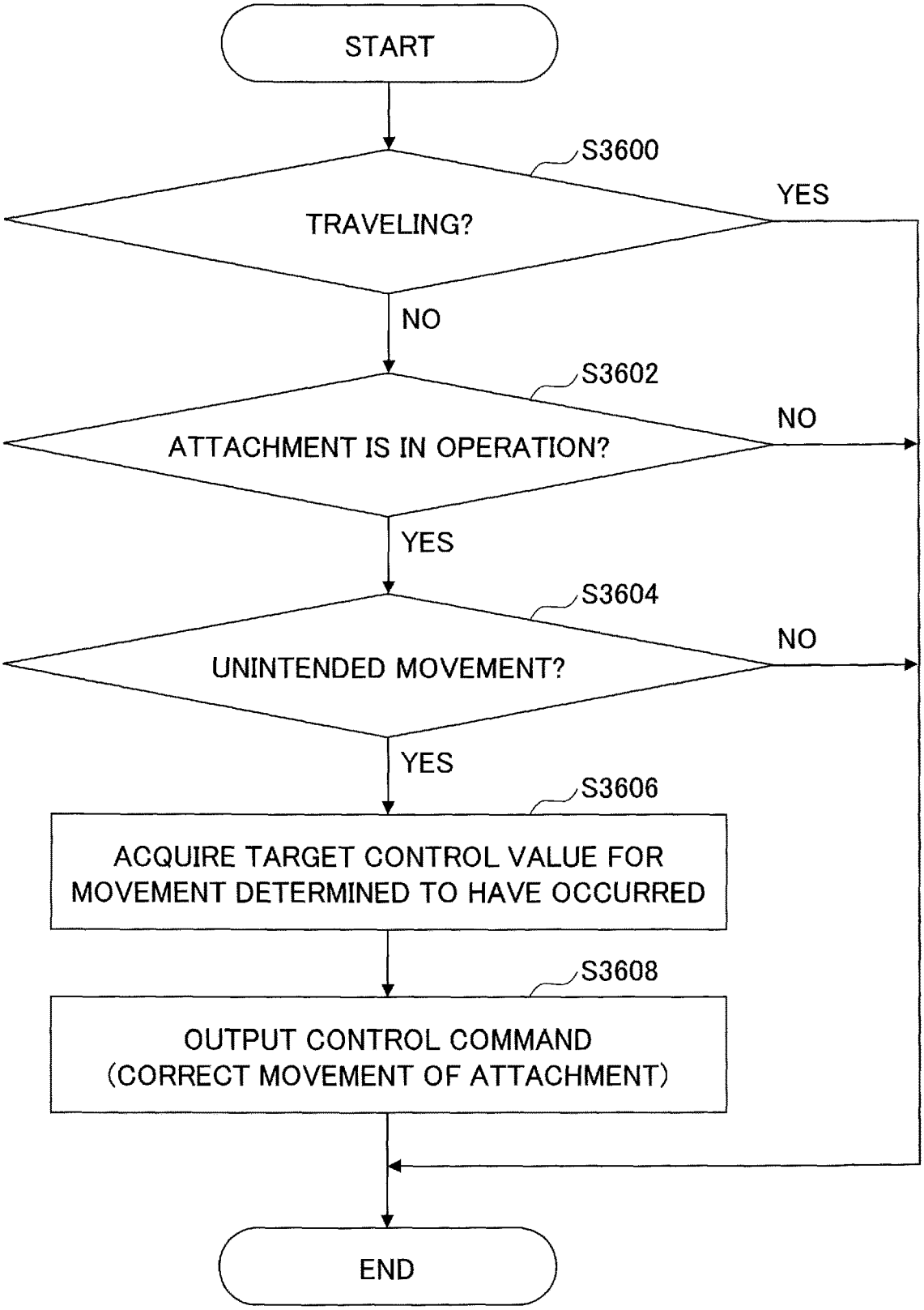
FIG. 36 is a flowchart schematically illustrating an example of a process (predetermined movement minimizing process) for minimizing an unintended movement of the shovel.

FIG. 36 is a flowchart schematically illustrating an example of the movement correcting process performed by the controller 30. This process is repeatedly performed at predetermined time intervals.

In step S3600, the movement determining unit 301 determines whether the shovel 100 is traveling, based on inputs from the pressure sensor 29 and the various types of sensors 32. If the movement determining unit 30 determines that the shovel 100 is not traveling, the process proceeds to step S3602. If the movement determining unit 30 determines that the shovel 100 is traveling, the process ends.

In step S3602, the movement determining unit 301 determines whether the attachment is in operation, namely the movement determining unit 301 determines whether work (excavation work) using the attachment is being performed, based on inputs from the pressure sensor 29 and the various types of sensors 32. If the movement determining unit 301 determines that the attachment is in operation, the process proceeds to step S3604. If the movement determining unit 301 determines that the attachment is not in operation, the process ends.

In step S3604, the movement determining unit 301 determines the occurrence of an unintended movement, based on inputs from the pressure sensor 29 and the various types of sensors 32. At this time, the movement determining unit 301 uses the above-described determination methods to determine the occurrence of some or all of the unintended movements. If the movement determining unit 301 determines that an unintended movement has occurred, the process proceeds to step S3606. If the movement determining unit 301 determines that an unintended movement has not occurred, the process ends.

In step S3606, the movement correcting unit 302 acquires a target control value for the movement that is determined to have occurred (determined movement). For example, if the movement correcting unit 302 determines that vibration has occurred, the movement correcting unit 302 acquires the thrust limit $F_{MAX}$ or the holding thrust $F_{MIN}$, in accordance with the method described with reference to FIG. 18. If the movement correcting unit 302 determines that an unintended movement other than vibration, such as dragging or lifting, has occurred, the movement correcting unit 302 may acquire the thrust limit as a target control value by table reference, in accordance with the method described with reference to FIG. 18 as well.

In step S3608, the movement correcting unit 302 outputs a control command to the control target, and corrects the movement of the attachment. As described above, examples of the control target include the electromagnetic relief valves 33 and 34, the electromagnetic proportional valve 36, the regulator 14A, the EMC 11A, the electromagnetic selector valve 38, the electromagnetic relief valve 46, the electromagnetic relief valve 50, the electromagnetic selector valve 52, the electromagnetic relief valves 56 and 58, and the electromagnetic proportional valve 60.

For example, in order to prevent a movement not intended by an operator of a shovel, the technique that corrects (minimizes) the movement of the attachment of the shovel is known (see Patent Document 1 above).

Patent Document 1 describes the technique that controls the pressure of a hydraulic cylinder, which drives the attachment of the shovel, not to exceed a predetermined maximum allowable pressure, thereby minimizing an unintended movement such as the dragging or lifting of the shovel.

However, the technique described in Patent Document 1 corrects the movement of the attachment of the shovel without determining whether an unintended movement has actually occurred. Thus, the operator's operability may be decreased.

In light of the above, in the present embodiment, the occurrence of an unintended movement is determined by the movement determining unit 301. If the movement determining unit 301 determines that an unintended movement has occurred, the movement correcting unit 302 corrects the movement of the attachment. Accordingly, after the unintended movement is determined to have actually occurred, the movement of the attachment is corrected, thus preventing a decrease in the operator's operability while minimizing the unintended movement.

The following clauses are further disclosed with respect to the above-described embodiments and variations described below.

(1-1) A shovel includes:

a traveling body;

a turning body turnably mounted on the traveling body;

an attachment attached to the turning body;

a detector attached to the turning body or the attachment and configured to detect a relative position of a fixed reference object around the shovel with respect to one of the turning body and the attachment; and a determining unit configured to determine whether a predetermined unintended movement occurs, based on a change in the detected relative position of the reference object around the shovel with respect to the one of the turning body and the attachment.

(1-2) The shovel according to (1-1), wherein the detector detects a relative position of a ground surface around the shovel with respect to the one of the turning body and the attachment. The ground surface serves as the reference object.

(1-3) The shovel according to (1-1) or (1-2), wherein the detector is attached to the turning body.

(1-4) The shovel according to (1-4), wherein the determining unit determines that unintended movement has occurred, when a relative position of the reference object with respect to the turning body is moved approximately parallel to a flat surface on which the shovel is located, the unintended movement being a dragging movement.

(1-5) The shovel according to (1-3) or (1-4), wherein the determining unit determines that the unintended movement has occurred, when a relative position of the reference object with respect to the turning body is moved approximately in a vertical direction, the unintended movement being a lifting movement.

(1-6) The shovel according to (1-1) or (1-2), wherein the detector is attached to the attachment, and detects a relative position of the reference object and a relative position of the turning body with respect to the attachment, and wherein the determining unit determines whether the unintended movement occurs, based on a change in the detected relative position of the reference object with respect to the attachment and a change in the detected relative position of the turning body with respect to the attachment.

(1-7) The shovel according to (1-1) through (1-6), further includes a movement correcting unit configured to correct the movement of the attachment when the determining unit determines that the unintended movement has occurred.

(1-8) The shovel according to (1-7), wherein the movement correcting unit corrects the movement of the attachment, when the determining unit determines that the unintended movement has occurred in a situation in which the traveling body is not operated and the attachment is being operated.

(2-1) A shovel includes:

a traveling body, a turning body turnably mounted on the traveling body;

an attachment attached to the turning body; and a determining unit configured to determine whether a predetermined unintended movement occurs.

(2-2) The shovel according to (2-1), wherein the unintended movement includes at least one of a movement in which the traveling body and the turning body are dragged forward or backward when viewed from the turning body, a movement in which front sides or rear sides of the traveling body and the turning body are lifted when viewed from the turning body, and a movement in which the traveling body and the turning body are vibrated due to the movement of the attachment, the unintended movement being determined to have occurred when the traveling body is not operated.

(2-3) The shovel according to (2-1) or (2-2), further comprising a sensor configured to detect a movement of the shovel, wherein the determining unit determines whether the unintended movement occurs, based on an output of the sensor.

(2-4) The shovel according to (2-3), wherein the sensor is attached to the turning body, and configured to detect a movement of the turning body.

(2-5) The shovel according to (2-3), wherein the sensor is attached to the attachment, and configured to detect the movement of the attachment.

(2-6) The shovel according to (2-5), wherein the sensor includes a first sensor attached to a boom of the attachment and configured to detect a movement of the boom, and the determining unit determines whether the unintended movement occurs, based on a change in an output of the first sensor.

(2-7) The shovel according to (2-5), wherein the sensor includes a second sensor attached to a bucket of the attachment and configured to detect a movement of the bucket, and also includes a third sensor attached to either a boom or an arm and configured to detect a movement of the boom or the arm, and the determining unit determines whether the unintended movement occurs, based on a change in a relative relationship between an output of the second sensor and an output of the third sensor.

(2-8) The shovel according to (2-1) through (2-7), further comprising a movement correcting unit configured correct the movement of the attachment when the determining unit determines that the unintended movement has occurred.

(2-9) The shovel according to (2-8), wherein the movement correcting unit corrects the movement of the attachment, when the determining unit determines that the unintended movement has occurred in a situation in which the traveling body is not operated and the attachment is being operated.

(3-1) A shovel includes:

a traveling body;

a turning body turnably mounted on the traveling body;

an attachment attached to the turning body;

a hydraulic actuator configured to drive the attachment; and a hydraulic control unit configured to control hydraulic pressure of the hydraulic actuator in relation to a movement of the attachment, the hydraulic control unit controlling the hydraulic pressure of the hydraulic actuator regardless of an operating state of the attachment.

(3-2) The shovel according to (3-1), further includes a control valve configured to control a movement of the hydraulic actuator in accordance with an operation by an operator, wherein the hydraulic control unit controls the hydraulic pressure of the hydraulic actuator by discharging hydraulic oil from an oil passage between the control valve and the hydraulic actuator into a tank.

(3-3) The shovel according to (3-2), further includes a holding valve disposed in an oil passage between the control valve and the hydraulic actuator to hold hydraulic oil of the hydraulic actuator, wherein the hydraulic control unit controls the hydraulic pressure of the hydraulic actuator by discharging hydraulic oil from an oil passage between the hydraulic actuator and the holding valve into the tank.

(3-4) The shovel according to (3-1), further includes a control valve configured to control a movement of the hydraulic actuator in accordance with an operation by an operator, wherein the hydraulic control unit controls the hydraulic pressure of the hydraulic actuator by correcting a signal corresponding to the operating state of the attachment and inputting the corrected signal into the control valve, or by inputting a signal different from the signal corresponding to the operating state of the attachment into the control valve.

(3-5) The shovel according to (3-1), further includes a hydraulic pump configured to be driven by a predetermined power source to supply hydraulic oil to the hydraulic actuator, wherein the hydraulic control unit controls the hydraulic pressure of the hydraulic actuator by controlling the hydraulic pump or the power source.

(3-6) The shovel according to (3-1), further includes:

a control valve configured to control a movement of the hydraulic actuator in accordance with an operation by an operator;

a holding valve disposed in an oil passage between the control valve and the hydraulic actuator to hold hydraulic oil of the hydraulic actuator, and a releasing device configured to release the hydraulic oil of the hydraulic actuator held by the holding valve, in accordance with the operating state of the attachment, wherein the hydraulic control unit controls the hydraulic pressure of the hydraulic actuator by controlling the releasing device so as to release the hydraulic oil held by the holding valve, regardless of the operating state of the attachment.

(3-7) The shovel according to any one of (3-1) to (3-6), further includes:

a determining unit configured to determine whether a predetermined unintended movement occurs, and a movement correcting unit configured to use the hydraulic control unit to correct the movement of the attachment when the determining unit determines that the predetermined unintended movement has occurred.

(3-8) The shovel according to (3-7), wherein the movement correcting unit corrects the movement of the attachment, when the determining unit determines that the unintended movement has occurred in a situation in which the traveling body is not operated and the attachment is being operated.

[Variations and Modifications]

Although the embodiments have been specifically described, the present invention is not limited to the above-described embodiments. Variations, modifications, and substitutions may be made to the described subject matter without departing from the scope of the present invention. Further, any features described with reference to the above-described embodiments may be combined as appropriate, as long as no technical contradiction occurs. The same applies to the following variations.

<First Variation>

For example, in the above-described embodiments, the configurations (such as FIG. 27 and FIG. 31 through FIG. 35) in which hydraulic oil in both the rod-side oil chamber and the bottom-side oil chamber of the boom cylinder 7 can be discharged into the tank T have been described; however, hydraulic oil in either the rod-side oil chamber or the bottom-side oil chamber may be discharged into the tank T. Specifically, if an oil chamber, whose pressure needs to be suppressed, is known in advance based on a determined unintended movement (for example, if an unintended movement is vibration, and a control target is fixed to the bottom-side oil chamber), a configuration in which hydraulic oil in only one of oil chambers is discharged into the tank T may be employed.

Further, in the above-described embodiments, the movement of the boom cylinder 7 (specifically, the pressure of the boom cylinder 7) of the attachment is mainly corrected. However, the movement of the arm cylinder 8 or the bucket cylinder 9 may be corrected, of course. In the following, a specific example in which the movement of the arm cylinder 8 is corrected will be described with reference to FIG. 37 and FIG. 38.

Figure 37:
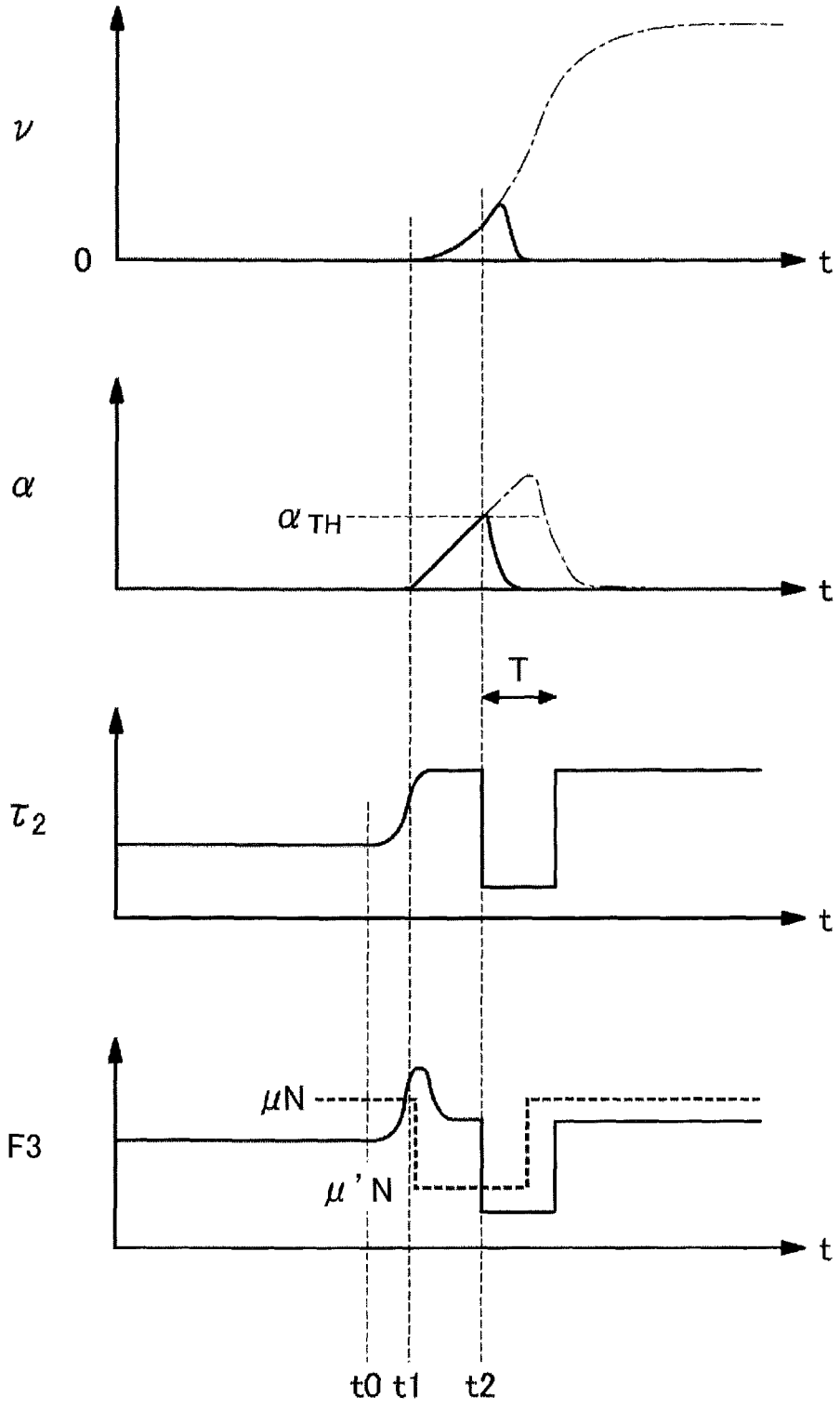
FIG. 37 is a drawing illustrating a first variation of the shovel.
Figure 38:
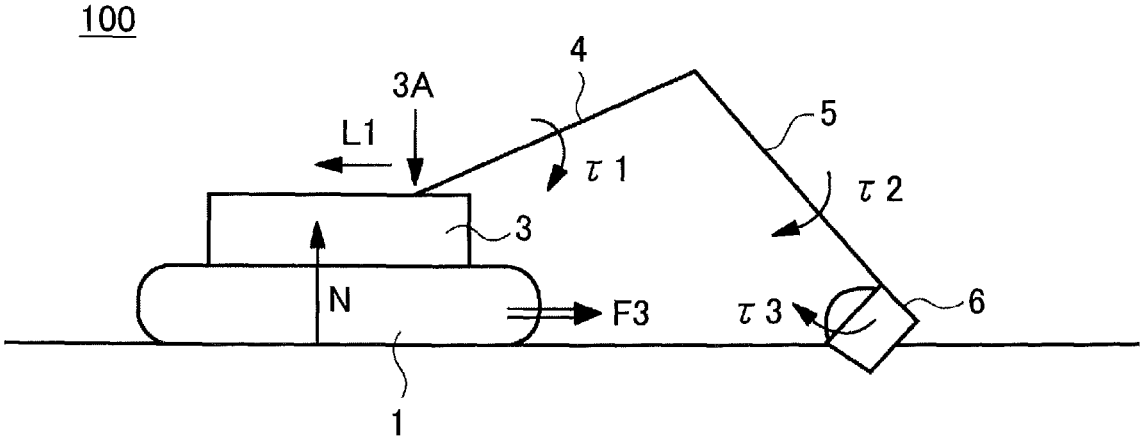
FIG. 38 is a drawing illustrating the first variation of the shovel.

FIG. 37 and FIG. 38 are drawings illustrating a first variation of the shovel 100. More specifically, FIG. 37 depicts waveforms related to the dragging of the shovel 100. FIG. 37 depicts, from top to bottom, the speed v of the lower traveling body 1 along a straight line L1 corresponding to the extending direction of the attachment, the acceleration α of the lower traveling body 1 along the straight line L1, a moment τ about the movement axis of the attachment (for example, a moment τ2 about the movement axis of the arm 5 illustrated in FIG. 38), and a force F3 exerted by the attachment on the body of the shovel 100 along the straight line L1. FIG. 38 is a drawing illustrating an example of a mechanical model of the shovel 100 performing excavation work, in which forces exerted on the shovel 100 during the excavation work are depicted.

In FIG. 37, dash-dot lines indicate waveforms for a comparative example in which the movement of the attachment is not corrected.

First, the comparative example in which the movement of the attachment is not corrected will be described.

As illustrated in FIG. 37, before a time t0, no dragging occurs, the lower traveling body 1 is stationary on the ground, and the speed v is zero.

At the time t0, when the operator tilts the levers 26A and 26B, the moment τ2 (or a moment τ1 or τ3 about the movement axis of another part of the attachment) increases. Accordingly, the force F3 exerted on the body of the shovel 100 along the straight line L1 increases. Then, at a time t1, the force F3 exceeds the maximum static friction force μN. As a result, the lower traveling body 1 starts to be dragged on the ground (starts to slide), and the speed v increases as indicated by the dash-dot line.

Next, the first variation in which the movement of the attachment is corrected will be described.

As illustrated in FIG. 37, at the time t1, when the lower traveling body 1 starts to slide, the acceleration a starts to increase. In other words, the dragging of the lower traveling body 1 appears as an increase in the acceleration α. Therefore, the movement determining unit 301 determines that the dragging of the lower traveling body 1 has occurred, based on the acceleration α detected by the above-described acceleration sensor 32A. For example, when the acceleration α detected by the acceleration sensor 32A exceeds a predetermined threshold value αTH, the movement determining unit 301 determines that dragging has occurred. When the movement determining unit 301 determines that dragging has occurred, the control that corrects the movement of the attachment by the movement correcting unit 302 is enabled (see FIG. 36.)

Specifically, at a time t2, the acceleration α exceeds the predetermined threshold value αTH. Thus, the correction control by the movement correcting unit 302 is enabled at the time t2. The correction control is enabled for a correction period of time T. In the correction period of time T, the movement correcting unit 302 decreases the moment τ2 about the movement axis of the arm 5, regardless of the state of an operation performed by the operator. When the moment τ2 decreases, the force F3 exerted by the attachment on the body of the shovel 100 decreases. Then, when the force F3 drops below a kinetic friction force μ'N, the dragging starts to decrease.

After the correction period of time T has passed, the correction control for the movement of the attachment (arm 5) is disabled, and the moment τ2 is returned to the moment before correction, which changes in accordance with the state of an operation performed by the operator. The correction period of time T may be approximately 1 millisecond to 2 seconds. Preferably, the correction period of time T may be approximately 10 milliseconds to 200 milliseconds, considering the results of simulation conducted by the inventors.

The force F also increases to the original level after the correction control is disabled. However, because the lower traveling body 1 is stationary on the ground, the lower traveling body 1 will not be dragged unless the force F exceeds the maximum static friction force ρN again.

For example, in the case of excavation work illustrated in FIG. 38, when the arm 5 is pulled (closed), with a large amount of sediment being loaded in the bucket 6, the force F3 is exerted, and the lower traveling body 1 starts to be dragged forward. Then, in accordance with the determination result by the movement determining unit 301, the movement correcting unit 302 instantly reduces the pressure of the arm cylinder 8 so as to control the thrust of the arm cylinder 8, thereby decreasing the pulling force of the arm 5, that is, the moment τ2. As a result, the force F3 exerted by the attachment on the body (the upper turning body 3) decreases, and drops below the kinetic friction force μ'N. Thus, the dragging of the shovel 100 stops. After the dragging of the shovel 100 stops, the correction control by the movement correcting unit 302 is disabled, and the moment τ2 acting on the arm 5 is returned to the moment before correction, which changes in accordance with the state of an operation performed by the operator. At this time, because the maximum static friction force μN is not exceeded (force F3>μ'N), dragging does not occur. By repeating the above process periodically at very short time intervals, it is possible to minimize the dragging of the shovel 100, without requesting the operator to change the operation amount of the operation lever and without deteriorating the operator's operability.

As described above, the movement of a cylinder other than the boom cylinder 7 of the attachment may be corrected to minimize an unintended movement.

<Second Variation>

In the above-described embodiments and variation, the movement of the attachment is corrected by suppressing the pressure of the boom cylinder 7 so as to control the thrust of the boom cylinder 7. However, the movement of the attachment may be corrected according to another aspect. In the following, a method for correcting the movement of the attachment by changing the position of at least one part of the attachment will be described with reference to FIG. 39.

Figure 39:
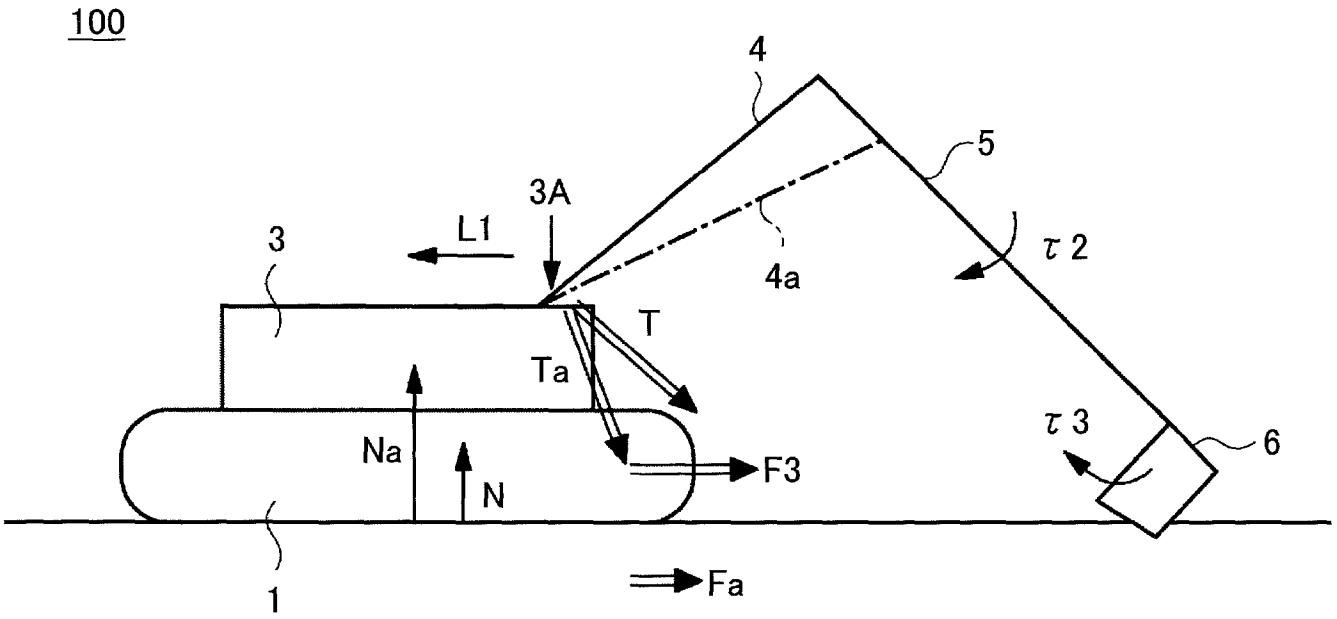
FIG. 39 is a drawing illustrating a second variation of the shovel.

FIG. 39 is a drawing illustrating a second variation of the shovel 100. More specifically, FIG. 39 is a drawing illustrating a method for correcting the movement of the attachment according to another aspect. In FIG. 39, a side view of the shovel 100 performing excavation work is depicted. The state of the attachment before correction is indicated by a continuous line, and the state of the attachment after correction is indicated by a dash-dot line.

For example, it is assumed that a large amount of sediment is placed in the bucket 6, and the shovel 100 is holding the bucket 6 (namely, closing the arm 5 and the bucket 6). In this case, a moment T is generated, with the bucket 6 being the center and the bottom 3A of the boom 4 being a point of action. A component of the moment T parallel to the ground surface acts as the force F3 that drags the lower traveling body 1.

When the movement of the attachment is corrected by the movement correcting unit 302, and the orientation of the attachment is changed, the direction of the moment (force) acting on the bottom 3A is changed from T to Ta. As an example, in FIG. 39, the movement correcting unit 302 changes the position of the boom 4 from the continuous line to the dash-dot line 4*a*. A component (a force that drags the lower traveling body 1) Fa of the corrected moment Ta parallel to the ground surface becomes smaller than the force F3 before correction. Accordingly, the dragging of the shovel 100 is minimized. Specifically, the movement correcting unit 302 moves the arm cylinder 8 in a contraction direction (a direction in which the arm 5 is lowered), regardless of the state of an operation performed by the operator. In this manner, the movement of the attachment is corrected. More specifically, for example, the movement correcting unit 302 may output a current command value to the electromagnetic proportional valve of FIG. 28, so as to move the arm cylinder 8 in the contraction direction.

Further, when the direction of the moment is changed from T to Ta, a component perpendicular to the ground surface, namely, a force that pushes the lower traveling body 1 to the ground increases. As a result, a normal force N increases as compared to that before correction, the kinetic friction force μ'N increases, and further, dragging is minimized.

In the example of FIG. 39, the dragging of the body of the shovel 100 is minimized by two actions of reducing the force F3, which affects the dragging movement, and of increasing the normal force N. However, it is also effective to use only one of the actions.

As described above, the movement of the attachment may be corrected to minimize an unintended movement by finely adjusting the orientation of the attachment of the shovel 100.

<Third Variation>

In the above-described embodiments and variations, the movement of the attachment is corrected when an unintended movement is determined to have occurred. However, regardless of the occurrence of an unintended movement, the movement of the attachment may be corrected. In the following, a method for correcting the movement of the attachment regardless of the occurrence of an unintended movement will be described with reference to FIG. 40.

Figure 40:
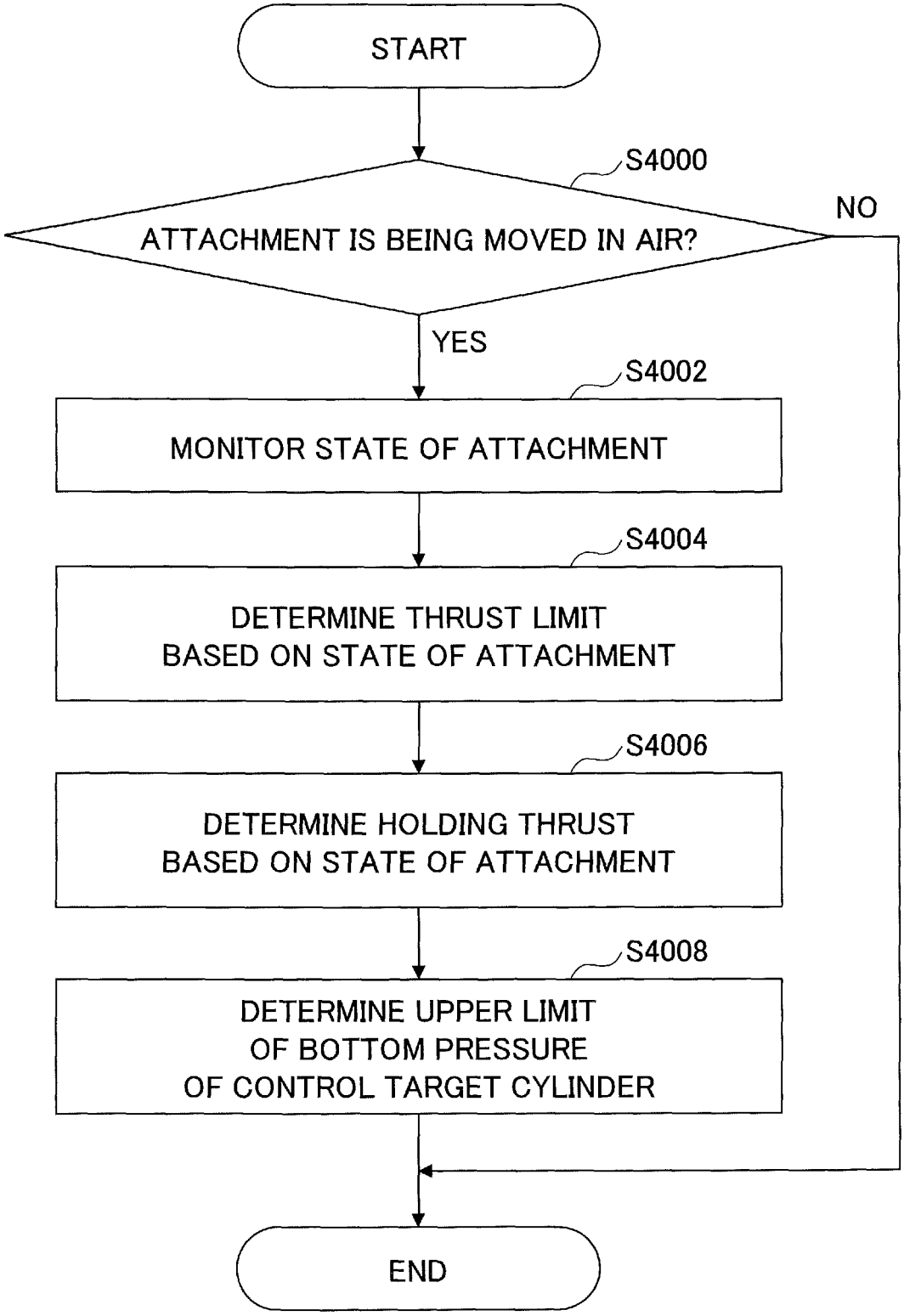
FIG. 40 is a drawing illustrating a third variation of the shovel.

FIG. 40 is a drawing illustrating a third variation of the shovel 100. Specifically, FIG. 40 is a flowchart schematically illustrating an example of a process performed by the movement correcting unit 302 to minimize vibration. For example, this process is repeatedly performed at predetermined time intervals while the shovel 100 is in operation.

In step S4000, the movement determining unit 301 determines whether the attachment is being moved in the air. When the movement determining unit 301 determines that the attachment is moved in the air, the process proceeds to step S4002. When the movement determining unit 301 determines that the attachment is not moved in the air, the process ends.

In step S4002, the movement correcting unit 302 monitors the state of the attachment (such as a boom angle θ1, an arm angle θ2, and a bucket angle θ3).

In step S4004, the movement correcting unit 302 determines the thrust limit $F_{MAX}$ based on the state of the attachment (see FIG. 18).

In step S4006, the movement correcting unit 302 determines the holding thrust $F_{MIN}$ based on the state of the attachment (see FIG. 18).

In step S4008, based on the thrust limit $F_{MAX}$ and the holding thrust $F_{MIN}$, the movement correcting unit 302 determines the upper limit $P_{MAX}$ of the bottom pressure of a control target cylinder (for example, the boom cylinder 7) (see FIG. 30).

In this manner, the movement correcting unit 302 may control the thrust of the cylinder, regardless of the occurrence of vibration, so as to minimize vibration. Further, for other unintended movements such as dragging and lifting, the movement correcting unit 302 may perform control in accordance with a target control value obtained by the above-described correction method (see FIG. 9A through FIG. 18), regardless of the occurrence of an unintended movement.

<Fourth Variation>

In the above-described embodiments and variations, in order to minimize an unintended movement, hydraulic oil in either the rod-side oil chamber or the bottom-side oil chamber of a control target cylinder (for example, the boom cylinder 7) is discharged into the tank; however, the hydraulic oil may be regenerated. In the following, a method for minimizing an unintended movement (such as dragging or lifting) by regenerating and supplying hydraulic oil between the rod-side oil chamber and the bottom-side oil chamber of a control target cylinder will be described.

Figure 41:
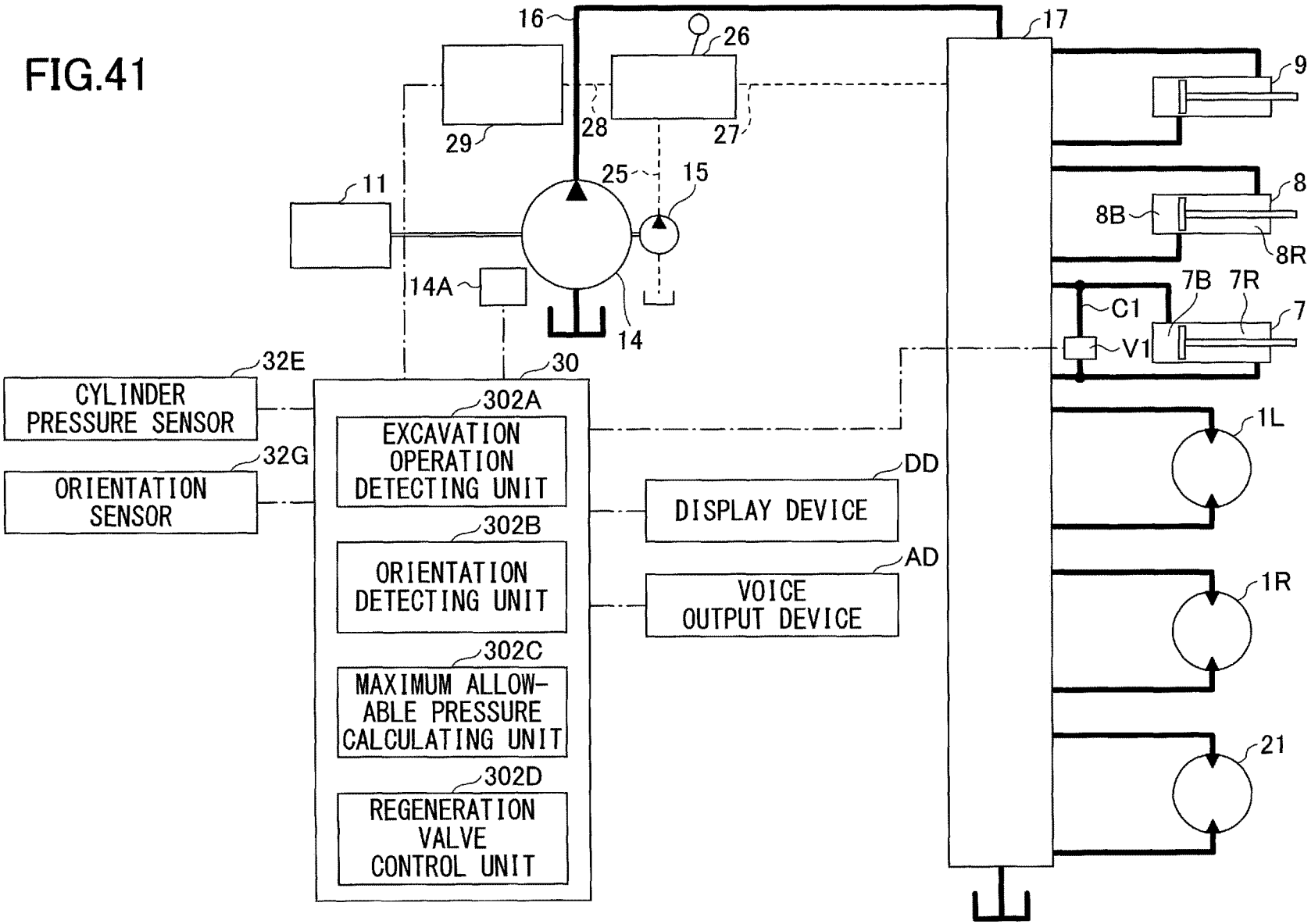
FIG. 41 is a drawing illustrating an example configuration of a drive system of a shovel according to a fourth variation.

FIG. 41 is a drawing illustrating an example configuration of a drive system mounted on a shovel according to a fourth variation. In FIG. 41, a mechanical power system is indicated by a double line, a hydraulic oil line is indicated by a thick continuous line, a pilot line is indicated by a dashed line, and an electric control system is indicated by a dash-dot line.

As described above (see FIG. 2), a main pump 14 and a control valve 17 are connected to the output shaft of the engine 11. The main pump 14 is, for example, a variable displacement hydraulic pump whose discharge flow rate per pump revolution is controlled by a regulator 14A. The pilot pump 15 is a fixed displacement hydraulic pump. The control valve 17 is connected to the main pump 14 via a hydraulic oil line 16. An operation device 26 is connected to the pilot pump 15 via a pilot line 25.

As described above, the control valve 17 is a valve unit including a plurality of valves, and controls a hydraulic system of the shovel. The control valve 17 is connected to hydraulic actuators such as a traveling hydraulic motor 1L, a traveling hydraulic motor 1R, a boom cylinder 7, an arm cylinder 8, a bucket cylinder 9, and a turning hydraulic motor 21 via hydraulic oil lines.

As described above, the operation device 26 is a device for operating the hydraulic actuators, and includes an operation lever and an operation pedal. The operation apparatus 26 is connected to the control valve 17 via a pilot line 27, and is connected to a pressure sensor 29 via a pilot line 28.

As described above, the pressure sensor 29 detects a pilot pressure generated by the operation device 26, and transmits information related to the detected pilot pressure to the controller 30. The pressure sensor 29 includes an arm pressure sensor that detects an operating state of an arm operation lever, and a boom pressure sensor that detects an operating state of a boom operation lever.

As described above, the controller 30 is a main controller that controls the driving of the shovel. In the fourth variation, the controller 30 is configured mainly by an arithmetic processing unit including a central processing unit (CPU) and an internal memory, and implements various functions by causing the CPU to execute a drive control program stored in the internal memory.

A cylinder pressure sensor 32E is an example of the above-described various types of sensors 32. Namely, the cylinder pressure sensor 32E is included in the various types of sensors 32. The cylinder pressure sensor 32E is a sensor that detects the pressure of hydraulic oil in an oil chamber of a hydraulic cylinder, and outputs a detection value to the controller 30. The cylinder pressure sensor 32E includes an arm rod pressure sensor, a boom rod pressure sensor, an arm bottom pressure sensor, and a boom bottom pressure sensor. The arm rod pressure sensor detects an arm rod pressure. The arm rod pressure is the pressure of hydraulic oil in a rod-side oil chamber 8R of the arm cylinder 8. The boom rod pressure sensor detects a boom rod pressure. The boom rod pressure is the pressure of hydraulic oil in a rod-side oil chamber 7R of the boom cylinder 7. The arm bottom pressure sensor detects an arm bottom pressure. The arm bottom pressure is the pressure of hydraulic oil in a bottom-side oil chamber 8B of the arm cylinder 8. The boom bottom pressure sensor detects a boom bottom pressure. The boom bottom pressure is the pressure of hydraulic oil in a bottom-side oil chamber 7B of the boom cylinder 7.

An orientation sensor 32G is an example of above-described various types of sensors 32. Namely, the orientation sensor 32G is included in the various types of sensors 32. The orientation sensor 32G is a sensor that detects the orientation of the shovel, and outputs a detection value to the controller 30. The orientation sensor 32G includes an arm angle sensor, a boom angle sensor, a bucket angle sensor, a turning angle sensor, and an inclination angle sensor. The arm angle sensor detects the opening and closing angle of the arm 5 relative to the boom 4 (hereinafter referred to as an "arm angle"). The boom angle sensor detects the raising and lowering angle of the boom 4 relative to the upper turning body 3 (hereinafter referred to as a "boom angle"). The bucket angle sensor detects the opening and closing angle of the bucket 6 relative to the arm 5 (hereinafter referred to as a "bucket angle"). Each of the arm angle sensor, the boom angle sensor, and the bucket angle sensor is configured by a combination of an acceleration sensor and a gyro sensor. Each of the arm angle sensor, the boom angle sensor, and the bucket angle sensor may be configured by a potentiometer, a stroke sensor, a rotary encoder, or the like. The turning angle sensor detects the turning angle of the upper turning body 3 relative to the lower traveling body 1. The inclination angle sensor detects a body inclination angle that is the angle of the ground surface contacted by the shovel relative to a horizontal plane.

A display device DD is a device for displaying various types of information, and is, for example, a liquid crystal display installed in a cabin of the shovel. The display device DD displays various types of information in accordance with a control signal from the controller 30.

A voice output device AD is a device for outputting various types of information by voice, and is, for example, a loudspeaker installed in the cabin of the shovel. The voice output device AD outputs various types of information by voice in accordance with a control signal from the controller 30.

A regeneration valve V1 is provided in a first oil passage C1 that connects a rod-side oil chamber and a bottom-side oil chamber of a hydraulic cylinder. Namely, the regeneration valve V1 is provided between the hydraulic cylinder and a flow rate control valve that adjusts the flow rate of hydraulic oil into the hydraulic cylinder. The regeneration valve V1 is, for example, an electromagnetic proportional valve, and controls the flow area of the first oil passage C1 in accordance with a control current from the controller 30. The regeneration valve V1 includes a boom regeneration valve and an arm regeneration valve. In the fourth variation, the regeneration valve V1 is a boom regeneration valve provided in the first oil passage C1 that connects the rod-side oil chamber 7R and the bottom-side oil chamber 7B of the boom cylinder 7. The regeneration valve V1 allows the bidirectional flow of hydraulic oil between the rod-side oil chamber 7R and the bottom-side oil chamber 7B. Namely, the regeneration valve V1 does not include a check valve. However, the regeneration valve V1 may have a first valve position, a second valve position, and a third valve position. The first valve position includes an oil passage in which a check valve is disposed to allow the flow of hydraulic oil only from the rod-side oil chamber 7R to the bottom-side oil chamber 7B. The second valve position includes an oil passage in which a check valve is disposed to allow the flow of hydraulic oil only from the bottom-side oil chamber 7B to the rod-side oil chamber 7R. The third valve position blocks the flow of hydraulic oil between the rod-side oil chamber 7R and the bottom-side oil chamber 7B. Alternatively, the regeneration valve V1 may be configured by a first proportional valve and a second proportional valve. The first proportional valve includes a valve position corresponding to the first valve position and a valve position corresponding to the third valve position. The second proportional valve includes a valve position corresponding to the second valve position and a valve position corresponding to the third valve position. Further, the regeneration valve V1 is provided outside of the control valve 17. Therefore, the regeneration valve V1 is controlled independently of spool valves within the control valve 17.

The controller 30 uses various types of functional elements to perform calculation by obtaining the outputs of the pressure sensor 29, the cylinder pressure sensor 32F, and the orientation sensor 32G. The various types of functional elements include an excavation operation detecting unit 302A, an orientation detecting unit 302B, a maximum allowable pressure calculating unit 302C, and a regeneration valve control unit 302D, which are detailed functional elements of the above-described movement correcting unit 302. The various types of functional elements may be configured by software or may be configured by hardware. Further, the controller 30 outputs calculation results to the display device DD, the voice output device AD, the regeneration valve V1, and the like.

The excavation operation detecting unit 302A is a functional element that detects whether an excavation operation is performed. In the fourth variation, the excavation operation detecting unit 302A detects whether an arm excavation operation including an arm closing operation is performed. Specifically, the excavation operation detecting unit 302A detects that an arm excavation operation has been performed, when an arm closing operation is detected, the boom rod pressure is a predetermined value or more, and a difference between the arm bottom pressure and the arm rod pressure is a predetermined value or more. The arm excavation operation includes a single operation of an arm closing operation only, a complex operation that is a combination of an arm closing operation and a boom lowering operation, and a complex operation that is a combination of an arm closing operation and a bucket closing operation.

The excavation operation detecting unit 302A may detect whether a boom complex excavation operation including a boom raising operation is performed. Specifically, the excavation operation detecting unit 302A detects that a boom complex excavation operation has been performed, when a boom raising operation is detected, the boom rod pressure is a predetermined value or more, and a difference between the arm bottom pressure and the arm rod pressure is a predetermined value or more. Furthermore, the excavation operation detecting unit 302A may detect a boom complex excavation operation, on the condition that an arm closing operation has been additionally detected.

The excavation operation detecting unit 302A may detect whether an excavation operation is performed, based on the outputs of other sensors such as the orientation sensor 32G in addition to or in place of the outputs of the pressure sensor 29 and the cylinder pressure sensor 32F.

The orientation detecting unit 302B is a functional element that detects the orientation of the shovel. In the fourth variation, the orientation detecting unit 302 detects a boom angle, an arm angle, a bucket angle, a body inclination angle, and a turning angle, as the orientation of the shovel.

The maximum allowable pressure calculating unit 302C is a functional element that calculates the maximum allowable pressure of hydraulic oil in a hydraulic cylinder during excavation work. The maximum allowable pressure changes in accordance with the orientation of the shovel. If hydraulic oil in a hydraulic cylinder exceeds the maximum allowable pressure during excavation work, an unintended movement of the shovel may occur. The unintended movement includes the lifting or dragging of the body of the shovel. In the fourth variation, the maximum allowable pressure calculating unit 302C calculates the maximum allowable boom rod pressure during excavation work. If the boom rod pressure exceeds the maximum allowable boom rod pressure, the body of the shovel may be lifted. The maximum allowable pressure calculating unit 302C may calculate the maximum allowable arm bottom pressure during excavation work. If the arm bottom pressure exceeds maximum allowable arm bottom pressure, the body of the shovel may be dragged toward an excavation point.

The regeneration valve control unit 302D is a functional element that controls the regeneration valve V1 in order to prevent an unintended movement of the body of the shovel during excavation work. In the fourth variation, the regeneration valve control unit 302D controls the opening area of the regeneration valve V1 not to exceed the maximum allowable boom rod pressure, in order to prevent the lifting of the body of the shovel. Specifically, when a predetermined condition (hereinafter referred to as a "control start condition") on the stability of the body of the shovel is determined to be satisfied, the regeneration valve control unit 302D controls the regeneration valve V1 to prevent an unintended movement of the body of the shovel.

More specifically, when the arm excavation operation that is a single operation of an arm closing operation only is performed, and the boom rod pressure increases and reaches a given pressure that is less than or equal to the maximum allowable boom rod pressure, the regeneration valve control unit 302D determines that the control start condition is satisfied. Then, the regeneration valve control unit 302D opens the regeneration valve V1 and increases the opening area of the regeneration valve V1. As a result, hydraulic oil flows from the rod-side oil chamber 7R to the bottom-side oil chamber 7B, and thus, the boom rod pressure decreases. At this time, the volume of hydraulic oil in the bottom-side oil chamber 7B increases, and the boom cylinder 7 extends. In this manner, the regeneration valve control unit 302D reduces the boom rod pressure such that the boom rod pressure does not exceed the maximum allowable boom rod pressure, thereby preventing the lifting of the body of the shovel.

Further, when the regeneration valve V1 has opened, the regeneration valve control unit 302D may output a control signal to one or both of the display device DD and the voice output device AD. This is to cause the display device DD to display a text message indicating that the regeneration valve V1 has opened, or to cause the voice output device AD to output a voice message or alarm sound indicating that the regeneration valve V1 has opened.

Figure 42:
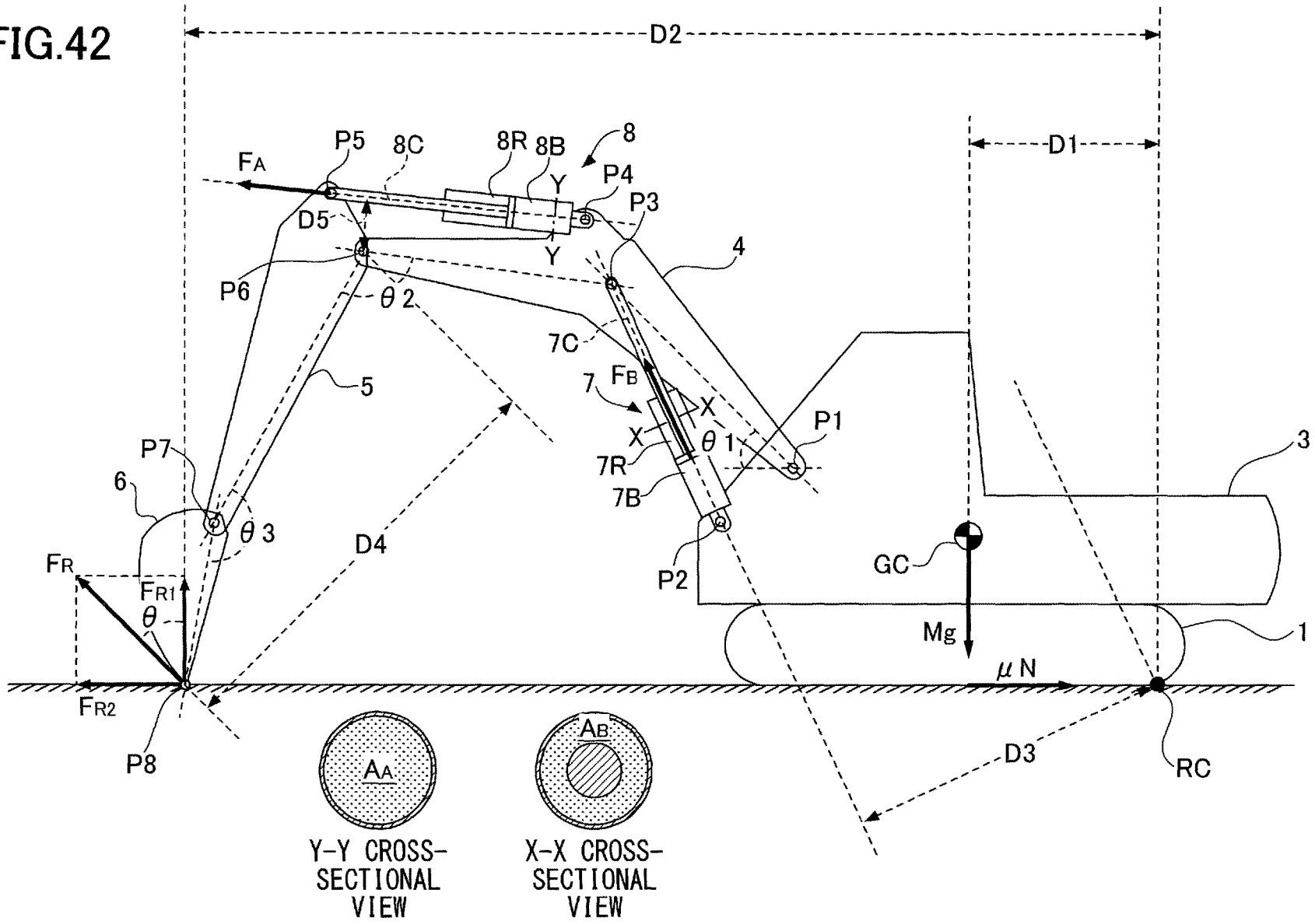
FIG. 42 is a drawing illustrating the relationship between forces that act on the shovel when excavation is performed.

Next, referring to FIG. 42, a method for detecting the orientation of the shovel by the orientation detecting unit 302B, and a method for calculating the maximum allowable pressure by the pressure calculating unit 302C will be described. FIG. 42 is a drawing illustrating the relationship between forces that act on the shovel when excavation is performed.

First, parameters related to control for preventing the lifting of the body of the shovel during excavation work will be described.

In FIG. 42, a point P1 indicates a joint between the upper turning body 3 and the boom 4, and a point P2 indicates a joint between the upper turning body 3 and the cylinder of the boom cylinder 7. Further, a point P3 indicates a joint between a rod 7C of the boom cylinder 7 and the boom 4, and a point P4 indicates a joint between the boom 4 and the cylinder of the arm cylinder 8. Further, a point P5 indicates a joint between a rod 8C of the arm cylinder 8 and the arm 5, and a point P6 indicates a joint between the boom 4 and the arm 5. Further, a point P7 indicates a joint between the arm 5 and the bucket 6, and a point P8 indicates the tip of the bucket 6. For clarification of explanation, the bucket cylinder 9 is not depicted in FIG. 42.

Further, in FIG. 42, the angle between a straight line that connects the point P1 to the point P3 and a horizontal line is represented as a boom angle θ1. The angle between a straight line that connects the point P3 to the point P6 and a straight line that connects the point P6 to the point P7 is represented as an arm angle θ2. The angle between the straight line that connects the point P6 to the point P7 and a straight line that connects the point P7 to the point P8 is represented as a bucket angle θ3.

Further, in FIG. 42, a distance D1 indicates a horizontal distance between a center of rotation RC and the center of gravity GC of the shovel, that is, a distance between the line of action of gravity M·g, which is the product of the mass M of the shovel and gravitational acceleration g, and the center of rotation RC, at the time of the occurrence of lifting. The product of the distance D1 and the magnitude of the gravity M·g represents the magnitude of a first moment of force about the center of rotation RC. Note that the symbol "·" represents "×" (a multiplication sign).

Further, in FIG. 42, a distance D2 indicates a horizontal distance between the center of rotation RC and the point P8, that is, a distance between the line of action of a vertical component $F_{R1}$ of an excavation reaction force $F_R$ and the center of rotation RC. The product of the distance D2 and the magnitude of the vertical component FR1 represents the magnitude of a second moment of force about the center of rotation RC. An excavation angle θ is formed by the excavation reaction force $F_R$ and the vertical axis, and the vertical component $F_{R1}$ of the excavation reaction force $F_R$ is expressed by $F_{R1}=FR\cdot\cos\theta$. Furthermore, the excavation angle θ is calculated based on the boom angle θ1, the arm angle θ2, and the bucket angle θ3.

Further, in FIG. 42, a distance D3 indicates a distance between a straight line, connecting the point P2 to the point P3, and the center of rotation RC, that is, a distance between the line of action of a force $F_B$, pulling the rod 7C out of the boom cylinder 7, and the center of rotation RC. The product of the distance D3 and the magnitude of the force $F_B$ represents the magnitude of a third moment of force about the center of rotation RC.

Further, in FIG. 42, a distance D4 indicates a distance between the line of action of the excavation reaction force $F_R$ and the point P6. The product of the distance D4 and the magnitude of the excavation reaction force $F_R$ represents the magnitude of a first moment of force about the point P6.

Further, in FIG. 42, a distance D5 indicates a distance between a straight line, connecting the point P4 to the point P5, and the point P6, that is, a distance between the line of action of an arm thrust $F_A$, which closes the arm 5, and the point P6. The product of the distance D5 and the magnitude of the arm thrust $F_A$ represents a second moment of force about the point P6.

It is assumed that the magnitude of a moment of force that causes the shovel to lift about the center of rotation RC by the vertical component $F_{R1}$ of the excavation reaction force $F_R$ and the magnitude of a moment of force that causes the shovel to lift about the center of rotation RC by the force $F_B$ that pulls the rod 7C out of the boom cylinder 7 are interchangeable with each other. In this case, the relationship between the magnitude of the second moment of force about the center of rotation RC and the magnitude of the third moment of force about the center of rotation RC is expressed by the following equation (31):

$$F_{R1}\cdot D2=F_R\cdot\cos\theta\cdot D2=F_B\cdot D3 \quad (31)$$

Furthermore, the magnitude of a moment of force that closes the arm 5 about the point P6 by the arm thrust $F_A$ and the magnitude of a moment of force that opens the arm 5 about the point P6 by the excavation reaction force $F_R$ are considered to be balanced. In this case, the relationship between the magnitude of the first moment of force about the point P6 and the magnitude of the second moment of force about the point P6 is expressed by the following equation (32) and equation (32)'.

$$F_A\cdot D5=F_R\cdot D4 \quad (32)$$

$$F_R=F_A\cdot D5/D4 \quad (32)'$$

In the above equation (32)', the symbol "/" represents "÷" (a division sign).

Further, from the equation (32) and the equation (32)', the force $F_B$ that pulls the rod 7C out of the boom cylinder 7 is expressed by the following equation (33).

$$F_B=F_A\cdot D2\cdot D5\cdot\cos\theta/(D3\cdot D4) \quad (33)$$

Further, the force $F_B$ that pulls the rod 7C out of the boom cylinder 7 is expressed by $F_B=P_B\cdot A_B-P_{B2}\cdot A_{B2}$, where the annular pressure receiving area of a piston that faces the rod-side oil chamber 7R of the boom cylinder 7 is represented as an area $A_B$ as illustrated in the X-X cross-sectional view of FIG. 42, the pressure of hydraulic oil in the rod-side oil chamber 7R is represented as a boom rod pressure $P_B$, the circular pressure receiving area of the piston that faces the bottom-side oil chamber 7B of the boom cylinder 7 is represented as an area $A_{B2}$, and the pressure of hydraulic oil in the bottom-side oil chamber 7B is represented as a boom bottom pressure $P_{B2}$. Accordingly, the equation (33) is expressed by the following equation (34) and equation (34)'.

$$P_B=F_A\cdot D2\cdot D5\cdot\cos\theta/(A_B\cdot D3\cdot D4) \quad (34)$$

$$F_A=P_B\cdot A_B\cdot D3\cdot D4/(D2\cdot D5\cdot\cos\theta) \quad (34)'$$

Further, the force $F_B$, pulling the rod 7C out of the boom cylinder 7 when the body of the shovel is lifted, is represented as a force $F_{BMAX}$. The magnitude of the first moment of force about the center of rotation RC that prevents the lifting of the body of the shovel by the gravity M·g, and the magnitude of the third moment of force about the center of rotation RC that lifts the body of the shovel by the force $F_{BMAX}$, are considered to be balanced. In this case, the relationship between the magnitude of the first moment of force and the magnitude of the third moment of force is expressed by the following equation (35).

$$M\cdot g\cdot D1=F_{BMAX}\cdot D3 \quad (35)$$

$$F_A=P_B\cdot A_B\cdot D3\cdot D4/(D2\cdot D5\cdot\cos\theta) \quad (34)'$$

Furthermore, the boom rod pressure $P_B$ at this point is represented as a maximum allowable boom rod pressure (hereinafter referred to as a "first maximum allowable pressure") $P_{BMAX}$ used to prevent the lifting of the body. The first maximum allowable pressure $P_{BMAX}$ is expressed by the following equation (36).

$$P_{BMAX}=M\cdot g\cdot D1/(A_B\cdot D3) \quad (36)$$

Further, the distance D1 is a constant, and similar to the excavation angle θ, the distances D2 through D5 are values determined according to the orientation of the excavation attachment, that is, the boom angle θ1, the arm angle θ2, and the bucket angle θ3. Specifically, the distance D2 is determined according to the boom angle θ1, the arm angle θ2, and the bucket angle θ3, the distance D3 is determined according to the boom angle θ1, the distance D4 is determined according to the bucket angle θ3, and the distance D5 is determined according to the arm angle θ2.

Accordingly, the maximum allowable pressure calculating unit 302C can calculate the first maximum allowable pressure $P_{BMAX}$ by using the boom angle θ1 detected by the orientation detecting unit 302B and the equation (36).

Further, the regeneration valve control unit 302D can prevent the lifting of the body of the shovel by maintaining the boom rod pressure $P_B$ at a given pressure that is less than or equal to the first maximum allowable pressure $P_{BMAX}$. Specifically, when the boom rod pressure $P_B$ reaches the given pressure, the regeneration valve control unit 302D decreases the boom rod pressure $P_B$ by increasing the flow rate of hydraulic oil flowing from the rod-side oil chamber 7R into the bottom-side oil chamber 7B. This is because a decrease in the boom rod pressure $P_B$ results in a decrease in the arm thrust $F_A$ as indicated by the equation (34)', and further results in a decrease in the excavation reaction force $F_R$ as indicated by the equation (32)', and also a decrease in the vertical component $F_{R1}$.

Further, the position of the center of rotation RC is determined based on the output of the turning angle sensor. For example, when the turning angle between the lower traveling body 1 and the upper turning body 3 is zero degrees, the rear end of a part of the lower traveling body 1 that comes into contact with the ground surface serves as the center of rotation RC. When the turning angle between the lower traveling body 1 and the upper turning body 3 is 180 degrees, the front end of a part of the lower traveling body 1 that comes into contact with the ground surface serves as the center of rotation RC. Further, when the turning angle between the lower traveling body 1 and the upper turning body 3 is 90 degrees or 270 degrees, the side end of a part of the lower-part traveling body 1 that comes into contact with the ground surface serves as the center of rotation RC.

Next, parameters related to control for preventing the dragging of the body of the shovel toward an excavation point will be described.

The relationship between forces that move the body of the shovel in the horizontal direction during excavation work is expressed by the following inequality (37):

$$\mu \cdot N \geq F_{R2} \quad (37)$$

In the above inequality, μ represents a static friction coefficient of the ground surface contacted by the shovel, N represents a normal force against the gravity M·g of the shovel, and $F_{R2}$ represents a horizontal component of the excavation reaction force $F_R$ that drags the shovel toward an excavation point. Furthermore, μ·N represents a maximum static friction force that causes the shovel to be stationary. When the horizontal component $F_{R2}$ of the excavation reaction force $F_R$ exceeds the maximum static friction force μ·N, the shovel is dragged toward the excavation point. The static friction coefficient μ may be a value preliminarily stored in the ROM or the like or dynamically calculated based on various types of information. In the fourth variation, the static friction coefficient μ is preliminarily stored and is selected by an operator via an input device (not illustrated). The operator selects a desired friction condition (a static friction coefficient) from multiple levels of friction conditions (static friction coefficients) in accordance with the ground surface that the shovel contacts.

The horizontal component $F_{R2}$ of the excavation reaction force $F_R$ is expressed by $F_{R2}=F_R$ sine, and the excavation reaction force $F_R$ is expressed by $F_R=F_A \cdot D5/D4$ from the equation (32)'. Accordingly, the inequality (37) is expressed by the following inequality (38).

$$\mu \cdot M \cdot g \geq F_A \cdot D5 \cdot \sin\theta / D4 \quad (38)$$

Further, the arm thrust $F_A$ is expressed by $F_A=P_A \cdot A_A - P_{A2} \cdot A_{A2}$, where the circular pressure receiving area of a piston that faces the bottom-side oil chamber 8B of the arm cylinder 8 is represented as an area $A_A$ as illustrated in the Y-Y cross-sectional view of FIG. 42, the pressure of hydraulic oil in the bottom-side oil chamber 8B is represented as an arm bottom pressure PA, the circular pressure receiving area of the piston that faces the rod-side oil chamber 8R of the arm cylinder 8 is represented as an area $A_{A2}$, and the pressure of hydraulic oil in the rod-side oil chamber 8R is represented as an arm rod pressure $P_{A2}$. However, because $P_A$ is much greater than $P_{A2}$, the arm thrust FA is expressed by $F_A=P_A \cdot A_A$. Accordingly, the inequality (38) is expressed by the following inequality (39).

$$P_A \leq \mu \cdot M \cdot g \cdot D4 / (A_A \cdot D5 \cdot \sin\theta) \quad (39)$$

When the right side and the left side of the inequality (39) are equal, the arm bottom pressure $P_A$ corresponds to a maximum allowable arm bottom pressure that can avoid the body being dragged toward an excavation point, that is, a maximum allowable arm bottom pressure (hereinafter referred to as a "second maximum allowable pressure") $P_{AMAX}$ used to prevent the body from being dragged toward an excavation point.

Based on the above-described relationships, the maximum allowable pressure calculating unit 302C uses the boom angle θ1, the arm angle θ2, and the bucket angle θ3 detected by the orientation detecting unit 302B and the inequality (39) to calculate the second maximum allowable pressure $P_{AMAX}$.

Further, the regeneration valve control unit 302D can prevent the body of the shovel from being dragged toward an excavation point by maintaining the arm bottom pressure $P_A$ at a given pressure that is less than or equal to the second maximum allowable pressure $P_{AMAX}$. Specifically, when the arm bottom pressure $P_A$ reaches the given pressure, the regeneration valve control unit 302D decreases the arm bottom pressure $P_A$ by decreasing the flow rate of hydraulic oil flowing from a first pump 14L into the bottom-side oil chamber 8B. In a case where a regeneration valve is provided in an oil passage that connects the rod-side oil chamber 8R to the bottom-side oil chamber 8B, the regeneration valve control unit 302D may decrease the arm bottom pressure $P_A$ by increasing the flow rate of hydraulic oil flowing from the bottom-side oil chamber 8B into the rod-side oil chamber 8R, when the arm bottom pressure $P_A$ reaches the given pressure. This is because a decrease in arm bottom pressure $P_A$ results in a decrease in the arm thrust $F_A$, and further results in a decrease in the horizontal component $F_{R2}$ of the excavation reaction force $F_R$.

Figure 43:
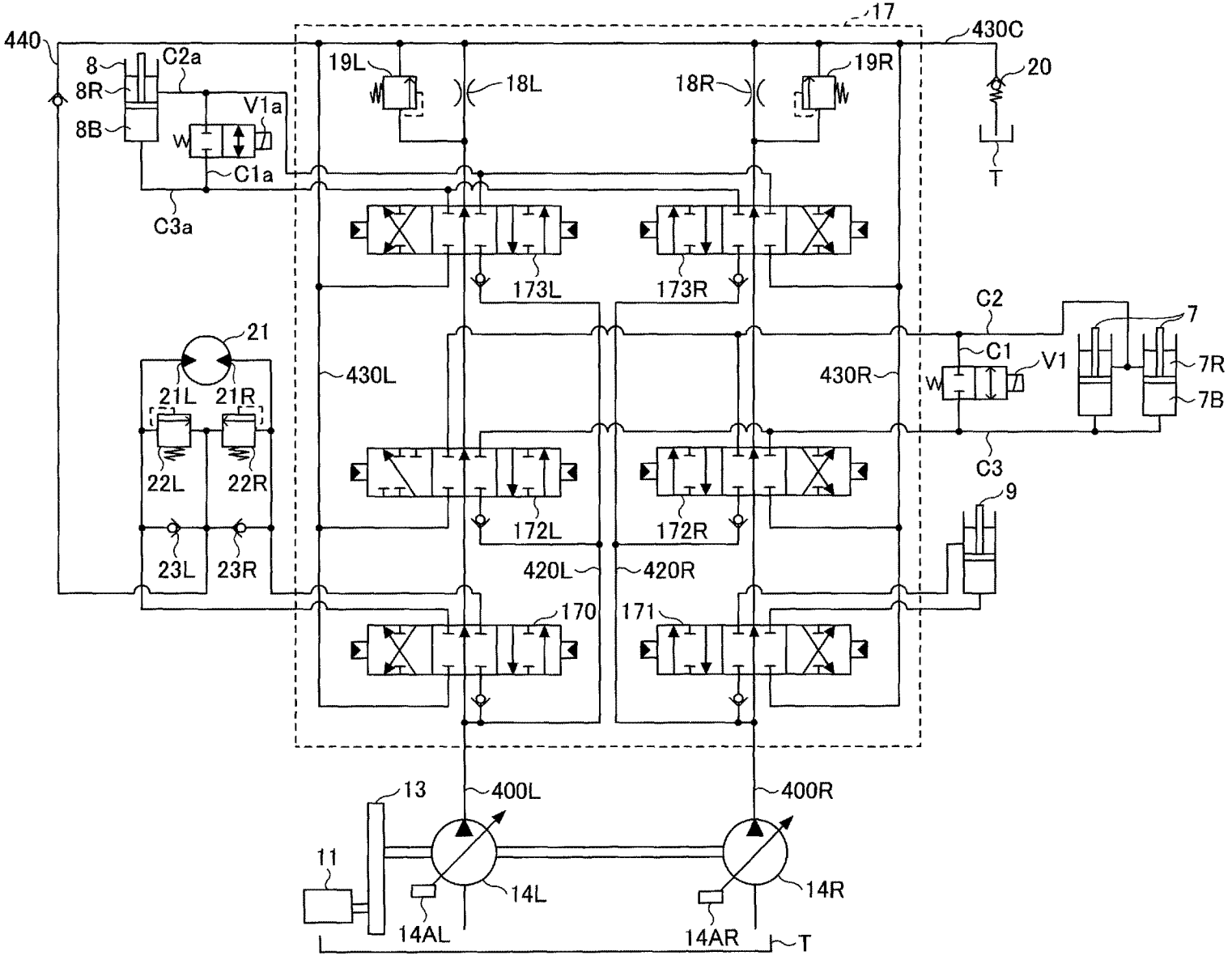
FIG. 43 is a drawing illustrating an example configuration of a hydraulic circuit installed in the shovel.

Next, referring to FIG. 43, an example configuration of a hydraulic circuit installed in the shovel of FIG. 1 will be described. FIG. 43 is a drawing illustrating an example configuration of a hydraulic circuit installed in the shovel. In the example of FIG. 43, the drive system includes the first pump 14L, a second pump 14R, the control valve 17, and hydraulic actuators. The hydraulic actuators include the boom cylinder 7, the arm cylinder 8, the bucket cylinder 9, and the turning hydraulic motor 21. In addition, the hydraulic actuators may include the traveling hydraulic motors 1L and 1R.

The turning hydraulic motor 21 is a hydraulic motor that turns the upper turning body 3. Ports 21L and 21R are connected to a hydraulic oil tank T via respective relief valves 22L and 22R, and are also connected to the hydraulic oil tank T via respective check valves 23L and 23R.

The first pump 14 sucks hydraulic oil from the hydraulic oil tank T and discharges the hydraulic oil. The first pump 14L is connected to a regulator 14AL. The regulator 14AL changes the inclination angle of a swash plate of the first pump 14L in accordance with a command from the controller 30, and controls a displacement volume (discharge flow rate per pump revolution). The same applies to a regulator 14AR for the second pump 14R. The first pump 14L and the second pump 14R correspond to the main pump 14 of FIG. 41, and the regulators 14AL and 14AR correspond to the regulator 14A of FIG. 41.

The first pump 14L and the second pump 14R circulate hydraulic oil into the hydraulic oil tank T through center bypass pipelines 400L and 400R, parallel pipelines 420L and 420R, and return pipelines 430L, 430R, and 430C.

The center bypass pipeline 400L is a hydraulic oil line that passes through flow rate control valves 170, 172L, and 173L provided within the control valve 17. The center bypass pipeline 400R is a hydraulic oil line that passes through flow rate control valves 171, 172R, and 173R provided within the control valve 17.

The parallel pipeline 420L is a hydraulic oil line that extends parallel to the center bypass pipeline 400L. When the flow of hydraulic oil passing through the center bypass pipeline 400L is limited or blocked by the flow rate control valve 170 or the flow rate control valve 172L, the parallel pipeline 420L supplies hydraulic oil to a further downstream flow rate control valve. The parallel pipeline 420R is a hydraulic oil line that extends parallel to the center bypass pipeline 400R. When the flow of hydraulic oil passing through the center bypass pipeline 400R is limited or blocked by the flow rate control valve 171 or the flow rate control valve 172R, the parallel pipeline 420 supplies hydraulic oil to a further downstream flow rate control valve.

The return pipeline 430L is a hydraulic oil line that extends parallel to the center bypass pipeline 400L. The return pipeline 430L causes hydraulic oil, passing through the flow rate control valves 170, 172L, and 173L from the hydraulic actuators, to be distributed to the return pipeline 430C. The return pipeline 430R is a hydraulic oil line that extends parallel to the center bypass pipeline 400R. The return pipeline 430R causes hydraulic oil, passing through the flow rate control valves 171, 172R, and 173R from the hydraulic actuators, to be distributed to the return pipeline 430C.

The center bypass pipelines 400L and 400R include negative control throttles 18L and 18R and relief valves 19L and 19R between the most downstream flow rate control valves 173L and 173R and the hydraulic oil tank T. The flow of hydraulic oil discharged from the first pump 14L and the second pump 14R is limited by the negative control throttles 18L and 18R. The negative control throttles 18L and 18R generate a control pressure (hereinafter referred to as a "negative control pressure") so as to control the regulators 14AL and 14AR. The relief valves 19L and 19R are opened to discharge hydraulic oil in the center bypass pipelines 400L and 400R into the hydraulic oil tank T, when the negative control pressure reaches a predetermined relief pressure.

A spring-type check valve 20 is provided at the most downflow part of the return pipeline 430C. The spring-type check valve 20 functions to increase the pressure of hydraulic oil in a pipeline 440 that connects the turning hydraulic motor 21 and the return pipeline 430C. With this configuration, hydraulic oil can be securely supplied to the suction-side ports of the turning hydraulic motor 21 during turning deceleration, thereby preventing cavitation.

The control valve 17 is a hydraulic control unit that controls a hydraulic drive system in the shovel. In the fourth variation, the control valve 17 is a cast component including the flow rate control valves 170, 171, 172L, 172R, 173L, and 173R, the center bypass pipelines 400L and 400R, the parallel pipelines 420L and 420R, and the return pipelines 430L and 430R.

The flow rate control valves 170, 171, 172L, 172R, 173L, and 173R are valves that control the direction and the flow rate of hydraulic oil flowing into and out of the hydraulic actuators. In the example of FIG. 43, each of the flow rate control valves 170, 171, 172L, 172R, 173L, and 173R is a three-port, three-position spool valve that operates with a pilot pressure generated by the operation device 26. The pilot pressure is supplied to either a right or a left pilot port of each of the flow rate control valves 170, 171, 172L, 172R, 173L, and 173R. The pilot pressure is generated in accordance with the amount of operation, and is supplied to a pilot port corresponding to the direction of operation (the angle of operation).

Specifically, the flow rate control valve 170 is a spool valve that controls the direction and the flow rate of hydraulic oil flowing into and out of the turning hydraulic motor 21. The flow rate control valve 171 is a spool valve that controls the direction and the flow rate of hydraulic oil flowing into and out of the bucket cylinder 9.

The flow rate control valves 172L and 172R are spool valves that control the direction and the flow rate of hydraulic oil flowing into and out of the boom cylinder 7. The flow rate control valves 173L and 173R are spool valves that control the direction and the flow rate of hydraulic oil flowing into and out of the arm cylinder 8.

The regeneration valve V1 is a valve that controls the flow rate by adjusting the size of the opening in accordance with a command from the controller 30, and is provided in the first oil passage C1. The first oil passage C1 connects a second oil passage C2 to a third oil passage C3. The second oil passage C2 connects the rod-side oil chamber 7R of the boom cylinder 7 to the flow rate control valves 172L and 172R. The third oil passage C3 connects the bottom-side oil chamber 7B of the boom cylinder 7 to the flow rate control valves 172L and 172R. In the example of FIG. 43, the regeneration valve V1 is a boom regeneration valve disposed outside of the control valve 17, and is also a one-port, two-position electromagnetic proportional valve that switches between communication and shutoff of the second oil passage C2 and the third oil passage C3. Specifically, when the regeneration valve V1 is at the first valve position, the regeneration valve V1 opens at the maximum level, and causes the second oil passage C2 to communicate with the third oil passage C3. When the regeneration valve V1 is at the second valve position, the regeneration valve V1 shuts off the communication between the second oil passage C2 and the third oil passage C3. Further, the regeneration valve V1 can remain at any position between the first valve position and the second valve position. The opening area of the regeneration valve V1 increases as the regeneration valve V1 approaches the first valve position. Similar to the flow rate control valve, the regeneration valve V1 may be provided inside of the control valve 17. In this case, the first oil passage C1 is also provided inside of the control valve 17.

The controller 30 outputs a command to the regeneration valve V1 in response to detecting that the boom rod pressure has reached a predetermined pressure, for example. In response to receiving the command, the regeneration valve V1 changes its position from the second valve position toward the first valve position, and causes the second oil passage C2 to communicate with the third oil passage C3.

In the example of FIG. 43, the regeneration valve V1 further includes an arm regeneration valve V1*a*. The arm regeneration valve V1*a* is an electromagnetic proportional valve that is provided in a first oil passage C1*a* connecting the rod-side oil chamber 8R and the bottom-side oil chamber 8B of the arm cylinder 8. The arm regeneration valve V1*a* controls the flow area of the first oil passage C1*a* in accordance with a control current from the controller 30, for example. The arm regeneration valve V1*a* allows the bidirectional flow of hydraulic oil between the rod-side oil chamber 8R and the bottom-side oil chamber 8B. Namely, the regeneration valve V1 does not include a check valve. Further, the arm regeneration valve V1*a* is provided outside of the control valve 17. Therefore, the arm regeneration valve V1*a* is controlled independently of the spool valves within the control valve 17.

Specifically, the first oil passage C1*a* connects a second oil passage C2*a* to a third oil passage C3*a*. The second oil passage C2*a* connects the rod-side oil chamber 8R of the arm cylinder 8 to the flow rate control valves 173L and 173R. The third oil passage C3*a* connects the bottom-side oil chamber 8B of the arm cylinder 8 to the flow rate control valves 173L and 173R. In the example of FIG. 43, the arm regeneration valve V1*a* is a one-port, two-position electromagnetic proportional valve that is capable of switching between communication and shutoff of the second oil passage C2*a* and the third oil passage C3*a*. Specifically, when the arm regeneration valve V1*a* is at the first valve position, the arm regeneration valve V1*a* opens at the maximum level, and causes the second oil passage C2*a* to communicate with the third oil passage C3*a*. When the arm regeneration valve V1*a* is at the second valve position, the arm regeneration valve V1*a* shuts off the communication between the second oil passage C2*a* and the third oil passage C3*a*. Further, the arm regeneration valve V1*a* can remain at any position between the first valve position and the second valve position. The opening area of the arm regeneration valve V1*a* increases as the arm regeneration valve V1*a* approaches the first valve position. Similar to the flow rate control valve, the arm regeneration valve V1*a* may be provided inside of the control valve 17. In this case, the first oil passage C1*a* is also provided inside of the control valve 17.

Figure 44:
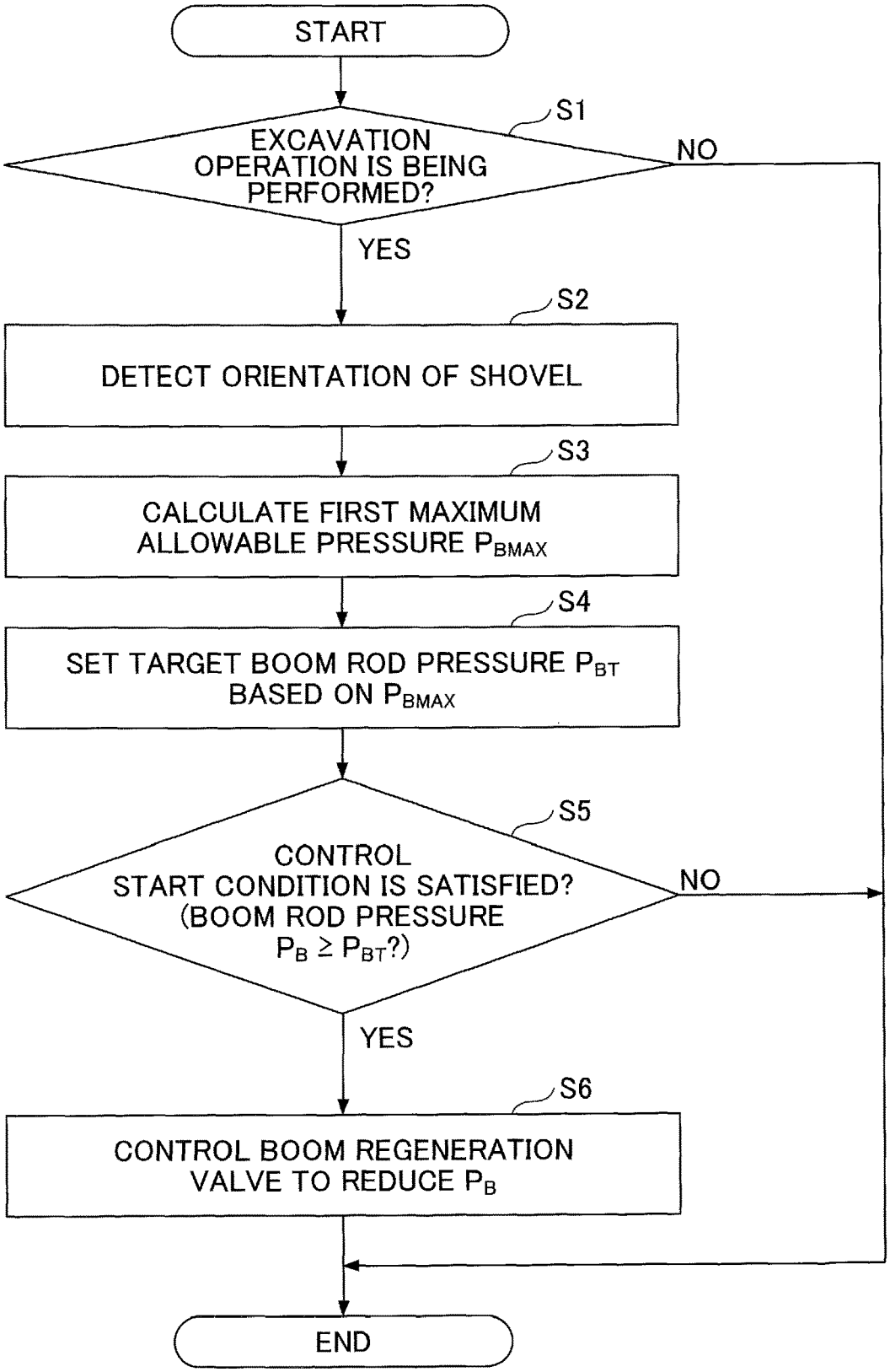
FIG. 44 is a flowchart illustrating a flow of a first support process.

Next, referring to FIG. 44, a process performed by the controller 30 to support excavation work while preventing the body of the shovel from being lifted (hereinafter referred to as a "first support process") will be described. FIG. 44 is a flowchart illustrating a flow of the first support process. The controller 30 repeatedly performs the first support process at predetermined intervals.

First, the excavation operation detecting unit 302A of the controller 30 determines whether an excavation operation is being performed (step S1).

For example, the excavation operation detecting unit 302A of the controller 30 detects whether an arm closing operation is being performed based on the output of the pressure sensor 29. If it is determined that the arm closing operation is being performed, the excavation operation detecting unit 302A calculates a difference between the arm bottom pressure and the arm rod pressure. If the calculated difference is a predetermined value or more, the excavation operation detecting unit 302A determines that the excavation operation is being performed (the arm excavation operation is being performed).

Alternatively, the controller 30 detects whether a boom raising operation is being performed based on the output of the pressure sensor 29. If it is determined that the boom raising operation is being performed, the excavation operation detecting unit 302A acquires the boom rod pressure. Further, the excavation operation detecting unit 302A calculates a difference between the arm bottom pressure and the arm rod pressure. If the acquired boom rod pressure is a predetermined value or more, and also the calculated difference is a predetermined value or more, the excavation operation detecting unit 302A determines that the excavation operation is being performed (the boom raising operation is being performed).

If the excavation operation detecting unit 302A determines that the excavation operation is not performed (no in step S1), the excavation operation detecting unit 302A ends the current first support process.

Conversely, if the excavation operation detecting unit 302A determines that the excavation operation is being performed (yes in step S1), the orientation detecting unit 302B detects the orientation of the shovel (step S2). Specifically, the orientation detecting unit 302B detects the boom angle θ1, the arm angle θ2, and the bucket angle θ3 based on the outputs of the arm angle sensor, the boom angle sensor, and the bucket angle sensor. Accordingly, the maximum allowable pressure calculating unit 302C of the controller 30 can obtain the distance between the line of action of a force exerted on the excavation attachment and a predetermined center of rotation.

Next, the maximum allowable pressure calculating unit 302C calculates the first maximum allowable pressure $P_{BMAX}$, based on detected values of the orientation detecting unit 302B (step S3). Specifically, the maximum allowable pressure calculating unit 302C uses the above-described equation (36) to calculate the first maximum allowable pressure $P_{BMAX}$.

Next, the maximum allowable pressure calculating unit 302C sets a given pressure that is less than or equal to the calculated first maximum allowable pressure $P_{BMAX}$ as a target boom rod pressure $P_{BT}$ (step S4). Specifically, the maximum allowable pressure calculating unit 302C sets a value obtained by subtracting a predetermined value from the first maximum allowable pressure $P_{BMAX}$ as the target boom cylinder pressure $P_{BT}$.

Next, the regeneration valve control unit 302D of the controller 30 determines whether a control start condition, which is a predetermined condition on the stability of the body of the shovel, is satisfied (step S5). For example, the regeneration valve control unit 302D determines that the control start condition is satisfied when the boom rod pressure $P_B$ has reached the target boom cylinder pressure $P_{BT}$. This is because it can be determined that the body of the shovel would be lifted if the boom rod pressure $P_B$ continued to rise.

If it is determined that the control start condition is satisfied (yes in step S5), for example, if the boom rod pressure $P_B$ has reached the target boom cylinder pressure $P_{BT}$, the regeneration valve control unit 302D controls the regeneration valve V1 (boom regeneration valve) to reduce the boom rod pressure $P_B$ (step S6). Specifically, the regeneration valve control unit 302D supplies a control current to the regeneration valve V1, so as to increase the opening area of the regeneration valve V1. This is to increase the flow area of the first oil passage C1. By causing hydraulic oil to flow from the rod-side oil chamber 7R into the bottom-side oil chamber 7B, the regeneration valve control unit 302D reduces the boom rod pressure $P_B$. At this time, the regeneration valve control unit 302D may perform feedback control of the boom rod pressure $P_B$ based on the output of the boom rod pressure sensor. As a result, the boom cylinder 7 extends, thus resulting in a decrease in the vertical component $F_{R1}$ of the excavation reaction force $F_R$. Accordingly, the body of the shovel is prevented from being lifted.

In step S5, if it is determined that the control start condition is not satisfied (no in step S5), for example, if the boom rod pressure $P_B$ remains below the target boom cylinder pressure $P_{BT}$, the regeneration valve control unit 302D ends the current first support process, without reducing the boom rod pressure $P_B$. This is because there is no possibility that the body of the shovel may be lifted.

For example, the shovel that supports a complex excavation operation while preventing the lifting of the body of the shovel is known (see Patent Document 1 described above). The shovel includes an electromagnetic proportional valve placed in a pilot line between a boom selector valve and a boom operation lever. The boom selector valve is a spool valve that controls the flow rate of the hydraulic oil flowing into and out of the boom cylinder. The electromagnetic proportional valve controls a pilot pressure, acting on a boom-raising pilot port of the boom selector valve, in accordance with a control current from the controller. Specifically, the electromagnetic proportional valve has a configuration in which the secondary-side pressure, acting on the boom-raising pilot port, becomes greater than the primary-side pressure as the control current from the controller increases.

In the shovel described in Patent Document 1, if the pressure of hydraulic oil reaches a predetermined threshold while a complex excavation operation that is a combination of a boom raising operation and an arm closing operation is being performed, a control current is supplied to the electromagnetic proportional valve so as to increase the pilot pressure acting on the boom-raising pilot port. By increasing the amount of hydraulic oil flowing from the rod-side oil chamber of the boom cylinder into the hydraulic oil tank, it is possible to reduce the pressure of the hydraulic oil in the rod-side oil chamber. As a result, the raising speed of the boom increases, and the vertical component of the excavation reaction force decrease. Thus, the body of the shovel is prevented from being lifted. Furthermore, by similar control, the body of the shovel is also prevented from being dragged toward an excavation point during excavation work.

However, the shovel in Patent Document 1 forcibly increases the raising speed of the boom 4 by increasing the pilot pressure, acting on the boom-raising pilot port during the complex excavation operation, so as to prevent the lifting of the body of the shovel. Therefore, the operator may feel discomfort depending on the raising speed of the boom 4.

Conversely, with the above-described configuration according to the fourth variation, it is possible for the controller 30 to prevent the body of the shovel from being lifted during complex excavation work without affecting a pilot pressure. Therefore, it is possible for the shovel to perform excavation work that makes efficient use of its body weight at a point immediately before the body of the shovel is lifted, while also causing less discomfort to the operator. Furthermore, work efficiency can be improved by eliminating the need to perform an operation for returning the lifted shovel to its original orientation, thereby also decreasing fuel consumption, preventing a failure of the body, and reducing the operator's operation burden.

Further, the controller 30 automatically controls the opening area of the regeneration valve V1 to reduce the boom rod pressure $P_B$. Namely, the controller 30 reduces the boom rod pressure $P_B$, independently of the operation of the boom operation lever by the operator. Therefore, it is not necessary for the operator to finely adjust the boom operation lever to prevent the lifting of the body of the shovel.

Further, the controller 30 moves hydraulic oil between the rod-side oil chamber 7R and the bottom-side oil chamber 7B. Therefore, it is possible to reduce the amount of hydraulic oil discharged into the hydraulic oil tank T in a useless manner, as compared to a configuration in which hydraulic oil is discharged from the rod-side oil chamber 7R into the hydraulic oil tank T via, for example, a relief valve.

Further, even if the regeneration valve V1 is left open due to an abnormal control current while the shovel is not in operation, the contraction of the boom cylinder 7 stops at the time when a force that contracts the boom cylinder 7 by the body weight of the attachment is balanced with a force that extends the boom cylinder 7. This is because hydraulic oil does not flow into anywhere other than the rod-side oil chamber 7R and the bottom-side oil chamber 7B. Therefore, excessive contraction of the boom cylinder 7 can be prevented, unlike a case in which an electromagnetic relief valve, provided in an oil passage that connects the bottom-side oil chamber 7B to the hydraulic oil tank T, is left open.

Figure 45:
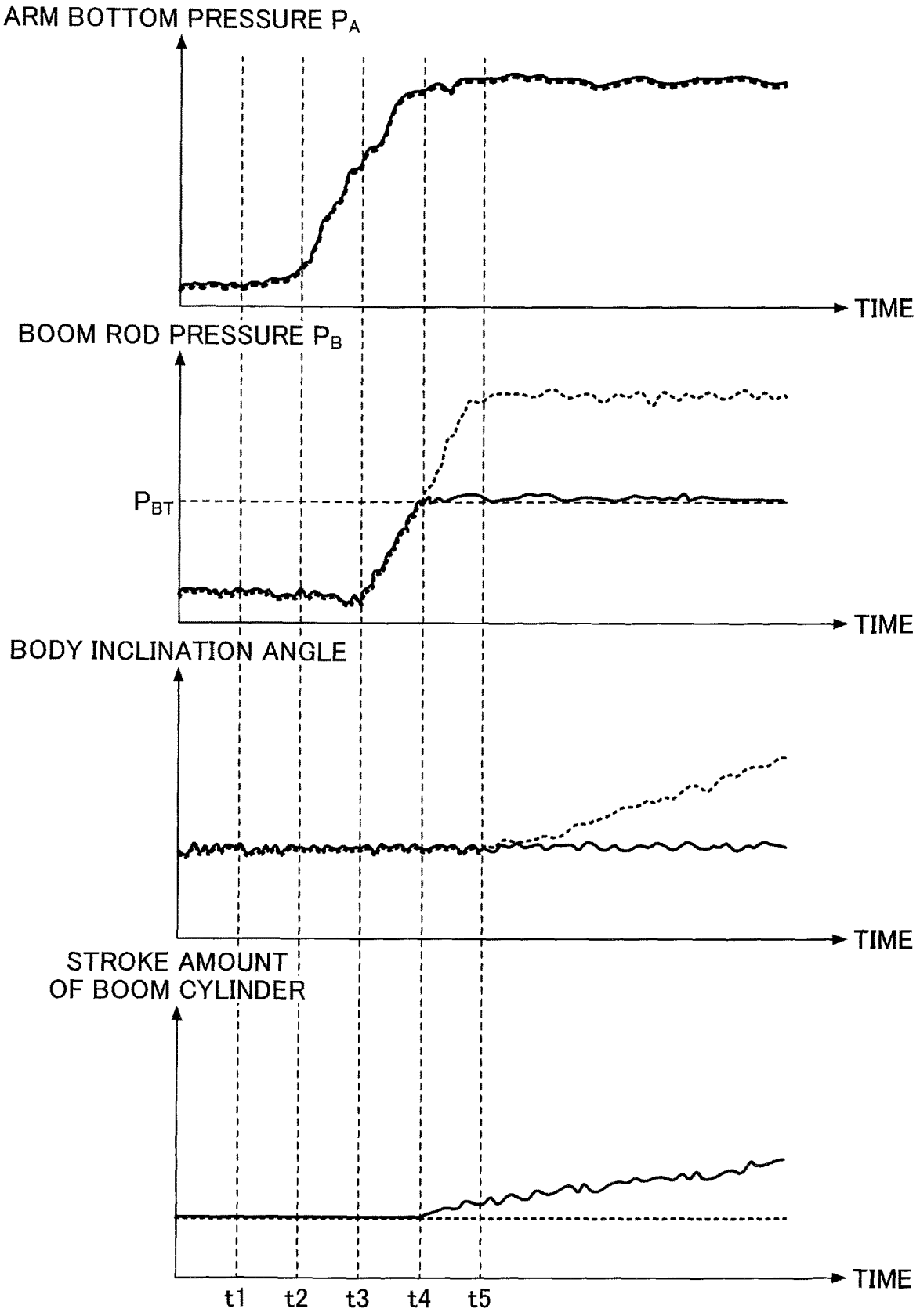
FIG. 45 is a drawing illustrating changes in physical quantities over time during arm excavation work.

Next, referring to FIG. 45, changes in physical quantities over time during arm excavation work will be described. FIG. 45 is a drawing illustrating changes in the arm bottom pressure $P_A$, the boom rod pressure $P_B$, the body inclination angle, and the stroke amount of the boom cylinder over time. Each continuous line in FIG. 45 indicates changes when the first support process is performed, and each dotted line in FIG. 45 indicates changes when the first support process is not performed. In the example of FIG. 45, the operator is performing arm excavation work by performing an arm closing operation only.

At a time t1, the bucket 6 comes into contact with the ground surface. At a time t2, the arm bottom pressure $P_A$ relatively rapidly increases. This is because the excavation load rapidly increases as excavation work progresses.

Thereafter, at a time t3 a little later than the rapid increase in the arm bottom pressure $P_A$, the boom rod pressure $P_B$ relatively rapidly increases, similar to the arm bottom pressure $P_A$.

Thereafter, at a time t4, upon the boom rod pressure $P_B$ reaching the target boom rod pressure $P_{BT}$, the controller 30 supplies a control current to the regeneration valve V1 so as to increase the opening area of the regeneration valve V1 when the first support process is used. Accordingly, the boom rod pressure $P_B$ is maintained at the target boom rod pressure $P_{BT}$, as indicated by the continuous line. At this time, the boom rod pressure $P_B$ is maintained at the target boom rod pressure $P_{BT}$ by increasing or decreasing the opening area of the regeneration valve V1 in accordance with the change in the boom rod pressure $P_B$. Specifically, the controller 30 increases the opening area of the regeneration valve V1 when the boom rod pressure $P_B$ exceeds the target boom rod pressure $P_{BT}$, and decreases the opening area of the regeneration valve V1 when the boom rod pressure $P_B$ drops below the target boom rod pressure $P_{BT}$.

Accordingly, the stroke amount of the boom cylinder starts to increase at the time t4, and relatively gradually increases thereafter. Namely, the boom 4 is gradually raised. When the arm 5 is closed, the excavation reaction force increases, and as a result, the boom rod pressure $P_B$ exceeds the target boom rod pressure $P_{BT}$. Each time the boom rod pressure $P_B$ exceeds the target boom rod pressure $P_{BT}$, the opening area of the regeneration valve V1 increases, thereby causing hydraulic oil to flow from the rod-side oil chamber 7R into the bottom-side oil chamber 7B.

Accordingly, the body inclination angle is maintained approximately the same and does not change largely. Namely, the body of the shovel is not lifted.

If the first support process is not used, the opening area of the regeneration valve V1 would not be increased even when the boom rod pressure $P_B$ reaches the target boom rod pressure $P_{BT}$. As a result, as indicated by the dotted line, the boom rod pressure $P_B$ would exceed the target boom rod pressure $P_{BT}$ and would continue to increase until the body of the shovel is lifted at a time t5. Once the shovel is lifted, a further increase in the boom rod pressure $P_B$ is reduced. This is because a further increase in excavation load is reduced by the lifting of the body.

Further, the stroke amount of the boom cylinder would be maintained the same even after the time t4, as indicated by the dotted line. Namely, the boom cylinder 7 would not be extended. In addition, as indicated by the dotted line, the body inclination angle would start to increase at the time t5 and would relatively gradually increase thereafter because of the lifting of the shovel.

Conversely, the controller 30 according to the fourth variation opens the regeneration valve V1 when the boom rod pressure $P_B$ reaches the target boom rod pressure $P_{BT}$. Accordingly, it is possible to prevent the body of the shovel from being lifted.

Further, the controller 30 can control the regeneration valve V1 independently of the operation related to the boom cylinder 7. Specifically, even when the operator is not operating the boom operation lever during arm excavation work, the controller 30 can open the regeneration valve V1 as necessary, so as to extend the boom cylinder and decrease the boom rod pressure. Thus, it is possible to prevent the body of the shovel from being lifted.

Figure 46:
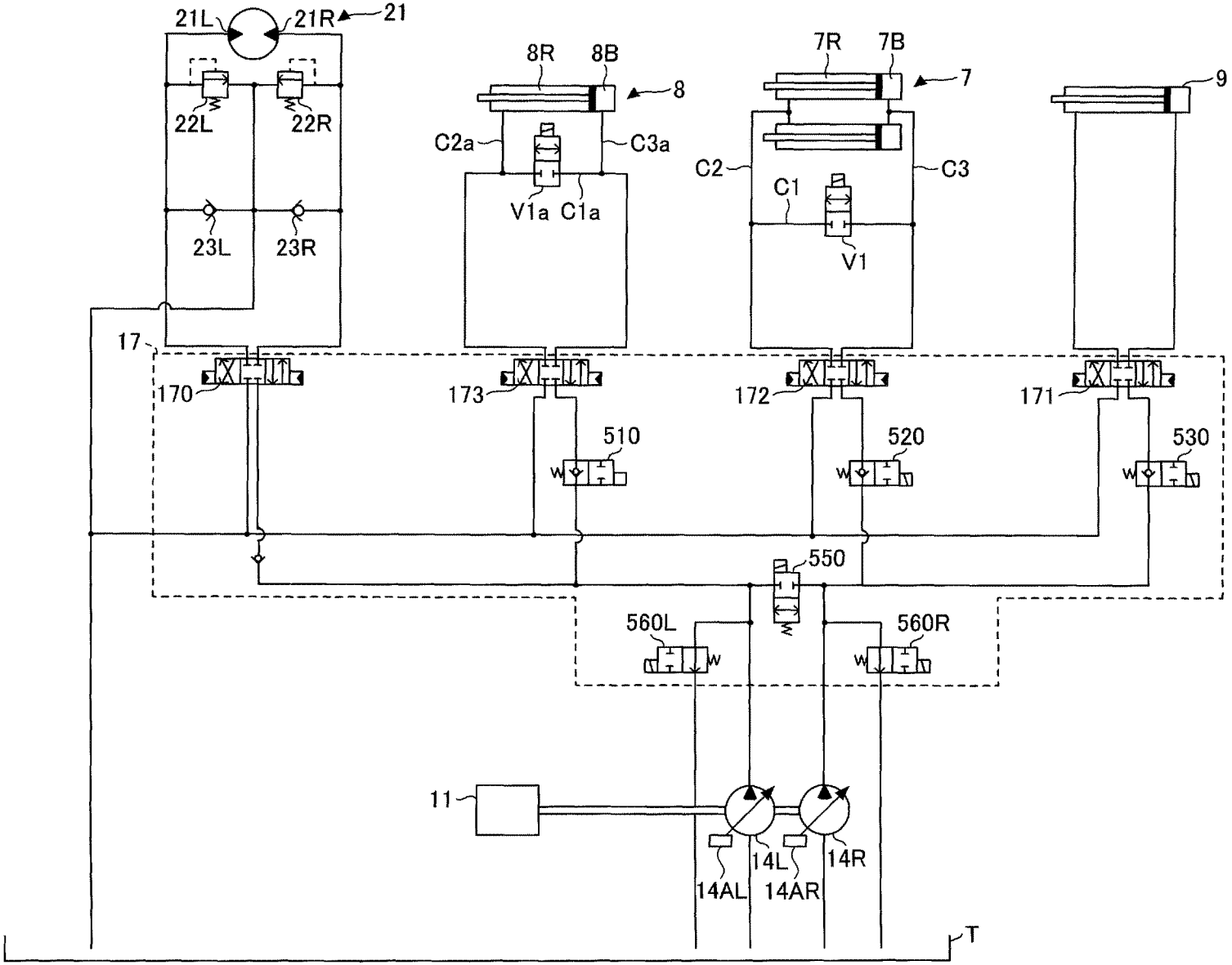
FIG. 46 is a drawing illustrating a configuration example of another hydraulic circuit installed in the shovel.

Next, referring to FIG. 46, a configuration example of another hydraulic circuit installed in the shovel of FIG. 1 will be described. FIG. 46 is a drawing illustrating a configuration example of another hydraulic circuit installed in the shovel of FIG. 1. The hydraulic circuit of FIG. 46 differs from the hydraulic circuit of FIG. 43, mainly in that the control valve 17 includes variable load check valves 510, 520, and 530, a converging valve 550, and unified bleed-off valves 560L and 560R; however, the hydraulic circuit of FIG. 46 is the same as the hydraulic circuit of FIG. 43 in other respects. Therefore, a description of common elements will not be provided, and only differences will be described.

The variable load check valves 510, 520, and 530 operate in accordance with commands from the controller 30. In the example of FIG. 46, the variable load check valves 510, 520, and 530 are one-port, two-position electromagnetic valves that are capable of switching communication and shutoff between the flow rate control valves 171 through 173 and one or both of the first pump 14L and the second pump 14R. Note that the variable load check valves 510, 520, and 530 include check valves that blocks the flow of hydraulic oil returning to the pump side. Specifically, when the variable load check valve 510 is at a first position, the variable load check valve 510 causes the flow rate control valve 173 to communicate with one or both of the first pump 14L and the second pump 14R. When the variable load check valve 510 is at a second position, the variable load check valve 510 shuts off the communication therebetween. The same applies to the variable load check valve 520 and the variable load check valve 530.

The converging valve 550 switches converging and non-converging of hydraulic oil discharged from the first pump 14L (hereinafter referred to as a "first hydraulic oil") and hydraulic oil discharged from the second pump 14R (hereinafter referred to as a "second hydraulic oil"). In the example of FIG. 46, the converging valve 550 is a one-port, two-position electromagnetic valve that operates in accordance with a command from the controller 30. Specifically, when the converging valve 550 is at a first position, the converging valve 550 causes coversing of the first hydraulic oil with the second hydraulic oil. When the converging valve 550 is at a second position, the converging valve 550 does not cause coversing of the first hydraulic oil with the second hydraulic oil.

The unified bleed-off valves 560L and 560R operate in accordance with commands from the controller 30. In the example of FIG. 46, the unified bleed-off valve 560L is a one-port, two-position electromagnetic valve that is capable of controlling the amount of the first hydraulic oil discharged into the hydraulic oil tank T. The same applies to the unified bleed-off valve 560R. With the above configuration, the unified bleed-off valves 560L and 560R enable a combined opening of related flow rate control valves of the flow rate control valves 170 through 173. Specifically, when the converging valve 550 is at the second position, the unified bleed-off valve 560L enables a combined opening of the flow rate control valve 170 and the flow rate control valve 173, and the unified bleed-off valve 560R enables a combined opening of the flow rate control valve 171 and the flow rate control valve 172. When the unified bleed-off valve 560L is at a first position, the unified bleed-off valve 560L serves as a variable throttle valve that controls the area of the combined opening of the flow rate control valve 170 and the flow rate control valve 173. When the unified bleed-off valve 560L is at a second position, the unified bleed-off valve 560L blocks the combined opening of the flow rate control valve 170 and the flow rate control valve 173. The same applies to the unified bleed-off valve 560R.

Each of the variable load check valves 510, 520, and 530, the converging valve 550, and the unified bleed-off valves 560L and 560R may be a spool valve driven by a pilot pressure.

Figure 47:
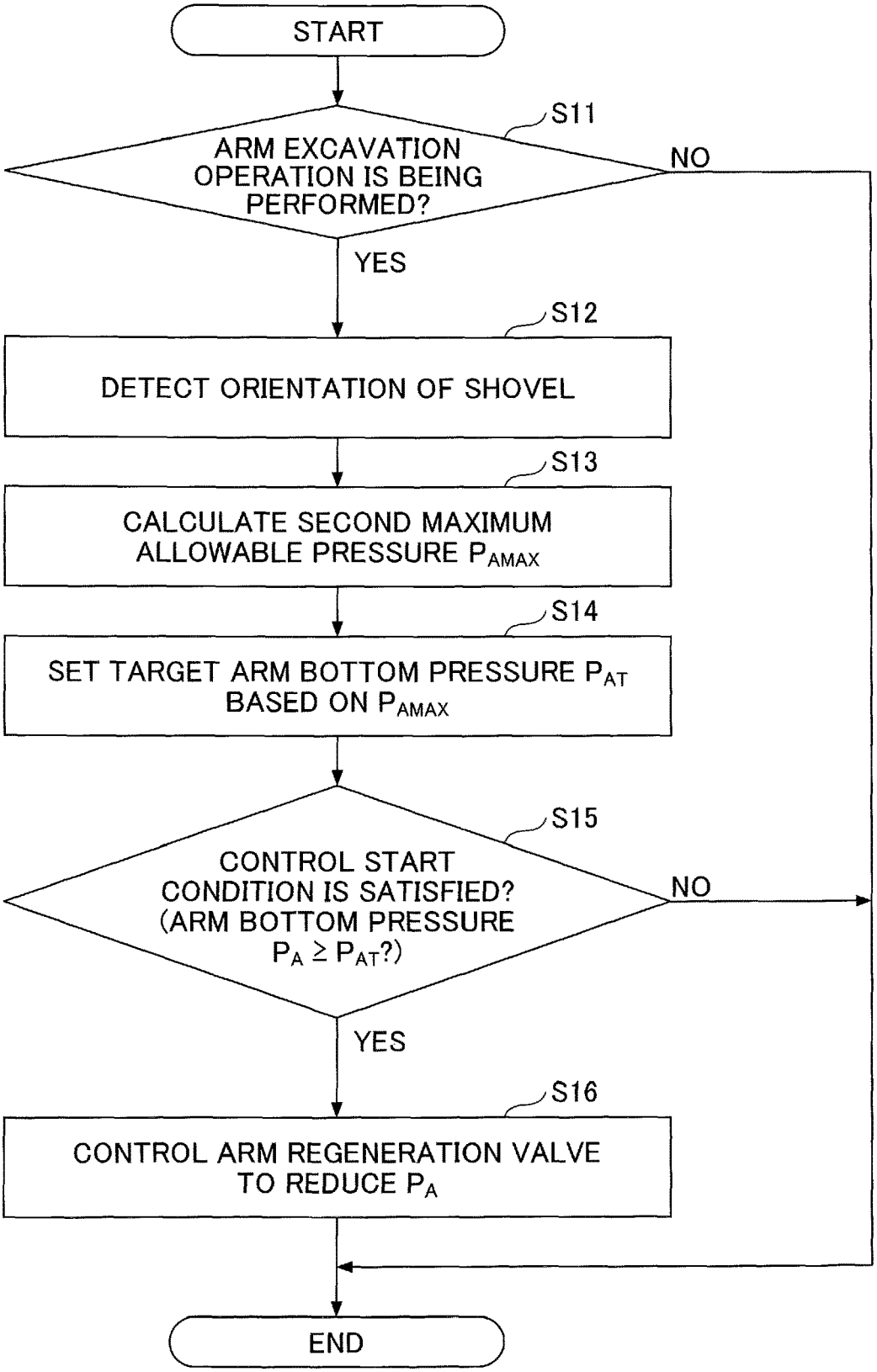
FIG. 47 is a flowchart illustrating a flow of a second support process.

Next, referring to FIG. 47, a process performed by the controller 30 to support arm excavation work while preventing the body of the shovel from being dragged toward an excavation point (hereinafter referred to as a "second support process") will be described. FIG. 47 is a flowchart illustrating a flow of the second support process. The controller 30 repeatedly performs the second support process at predetermined intervals.

First, the excavation operation detecting unit 302A of the controller 30 determines whether an arm excavation operation including an arm closing operation is being performed (step S11). Specifically, the excavation operation detecting unit 302A detects whether an arm closing operation is being performed based on the output of the pressure sensor 29. If it is determined that the arm closing operation is being performed, the excavation operation detecting unit 302A calculates a difference between the arm bottom pressure and the arm rod pressure. If the calculated difference is a predetermined value or more, the excavation operation detecting unit 302A determines that the arm excavation operation is being performed.

If the excavation operation detecting unit 302A determines that the arm excavation operation is not being performed (no in step S11), the excavation operation detecting unit 302A ends the current second support process.

Conversely, if the excavation operation detecting unit 302A determines that the arm excavation operation is being performed (yes in step S11), the orientation detecting unit 302B detects the orientation of the shovel (step S12).

Next, the maximum allowable pressure calculating unit 302C calculates the second maximum allowable pressure, based on the output of the orientation detecting unit 302B (step S13). Specifically, the maximum allowable pressure calculating unit 302C uses the above-described inequality (39) to calculate the second maximum allowable pressure $P_{AMAX}$.

Next, the maximum allowable pressure calculating unit 302C sets a given pressure that is less than or equal to the calculated second maximum allowable pressure $P_{AMAX}$ as a target arm bottom pressure $P_{AT}$ (step S14). Specifically, the maximum allowable pressure calculating unit 302C sets the second maximum allowable pressure $P_{AMAX}$ as the target arm bottom pressure $P_{AT}$.

Next, the regeneration valve control unit 302D of the controller 30 determines whether a control start condition, which is a predetermined condition on the stability of the body of the shovel, is satisfied (step S15). For example, the regeneration valve control unit 302D determines that the control start condition is satisfied when the arm bottom pressure $P_A$ has reached the target arm bottom pressure $P_{AT}$. This is because it can be determined that the body of the shovel would be dragged toward the excavation point if the arm bottom pressure $P_A$ continued to rise.

If it is determined that the control start condition is satisfied (yes in step S15), for example, if the arm bottom pressure $P_A$ has reached the target arm bottom pressure $P_{AT}$, the regeneration valve control unit 302D controls the arm regeneration valve V1*a* to reduce the difference between the arm bottom pressure $P_A$ and the arm rod pressure $P_{A2}$ (step S16). Specifically, the regeneration valve control unit 302D supplies a control current to the arm regeneration valve V1*a*, so as to open the arm regeneration valve V1*a* and increase the opening area. This is to increase the flow area of the first oil passage C1*a*. If the opening area of a cylinder/tank (CT) port of the flow rate control valve 173 is large, the regeneration valve control unit 302D causes hydraulic oil to flow out of the bottom-side oil chamber 8B into the tank, so as to reduce the arm bottom pressure $P_A$. As a result, the extension of the arm cylinder 8 is suppressed, thereby decreasing or eliminating the horizontal component $F_{R2}$ of the excavation reaction force $F_R$. Accordingly, the body of the shovel is prevented from being dragged toward the excavation point.

Further, even if the opening area of the CT port of the flow rate control valve 173 is small, the regeneration valve control unit 302D increases the arm rod pressure $P_{A2}$ and decreases the difference between the arm bottom pressure $P_A$ and the arm rod pressure $P_{A2}$ by causing hydraulic oil to flow into the rod-side oil chamber 8R. As a result, the extension of the arm cylinder 8 is suppressed, thereby decreasing or eliminating the horizontal component $F_{R2}$ of the excavation reaction force $F_R$. Accordingly, the body of the shovel is prevented from being dragged toward the excavation point.

In the above manner, hydraulic oil discharged from the arm cylinder 8 is supplied to an oil chamber located on the side opposite to the discharge side of the arm cylinder 8 or is discharged into the tank, in accordance with the size of the opening of the cylinder/tank port of the flow rate control valve 173. As a result, the extension of the arm cylinder 8 is suppressed or stopped, thereby preventing the body of the shovel from being dragged toward the excavation point.

If it is determined that the control start condition is not satisfied (no in step S15), for example, if the arm bottom pressure $P_A$ remains below the target arm bottom pressure $P_{AT}$, the regeneration valve control unit 302D ends the current second support process, without reducing the arm bottom pressure PA. This is because there is no possibility that the body of the shovel may be dragged.

With the above configuration, it is possible for the controller 30 to prevent the body of the shovel from being dragged toward an excavation point during arm excavation work without affecting a pilot pressure. Therefore, it is possible for the shovel to perform arm excavation work that makes efficient use of its body weight at a point immediately before the body of the shovel is dragged. Furthermore, work efficiency can be improved by eliminating the need to perform an operation for returning the dragged shovel to its original orientation, thereby also decreasing fuel consumption, preventing a failure of the body, and reducing the operator's operation burden.

Further, the controller 30 moves hydraulic oil between the rod-side oil chamber 8R and the bottom-side oil chamber 8B. Therefore, it is possible to reduce a pressure loss occurring in a pipeline or the like, as compared to a configuration in which hydraulic oil is discharged from the bottom-side oil chamber 8B into the hydraulic oil tank T via, for example, a relief valve. Further, even if the arm regeneration valve V1*a* is left open, the extension and contraction of the arm cylinder 8 stops at the time when a force that extends the arm cylinder 8 is balanced with a force that contracts the arm cylinder 8. Thus, the arm cylinder 8 is not excessively extended or contracted.

Figure 48:
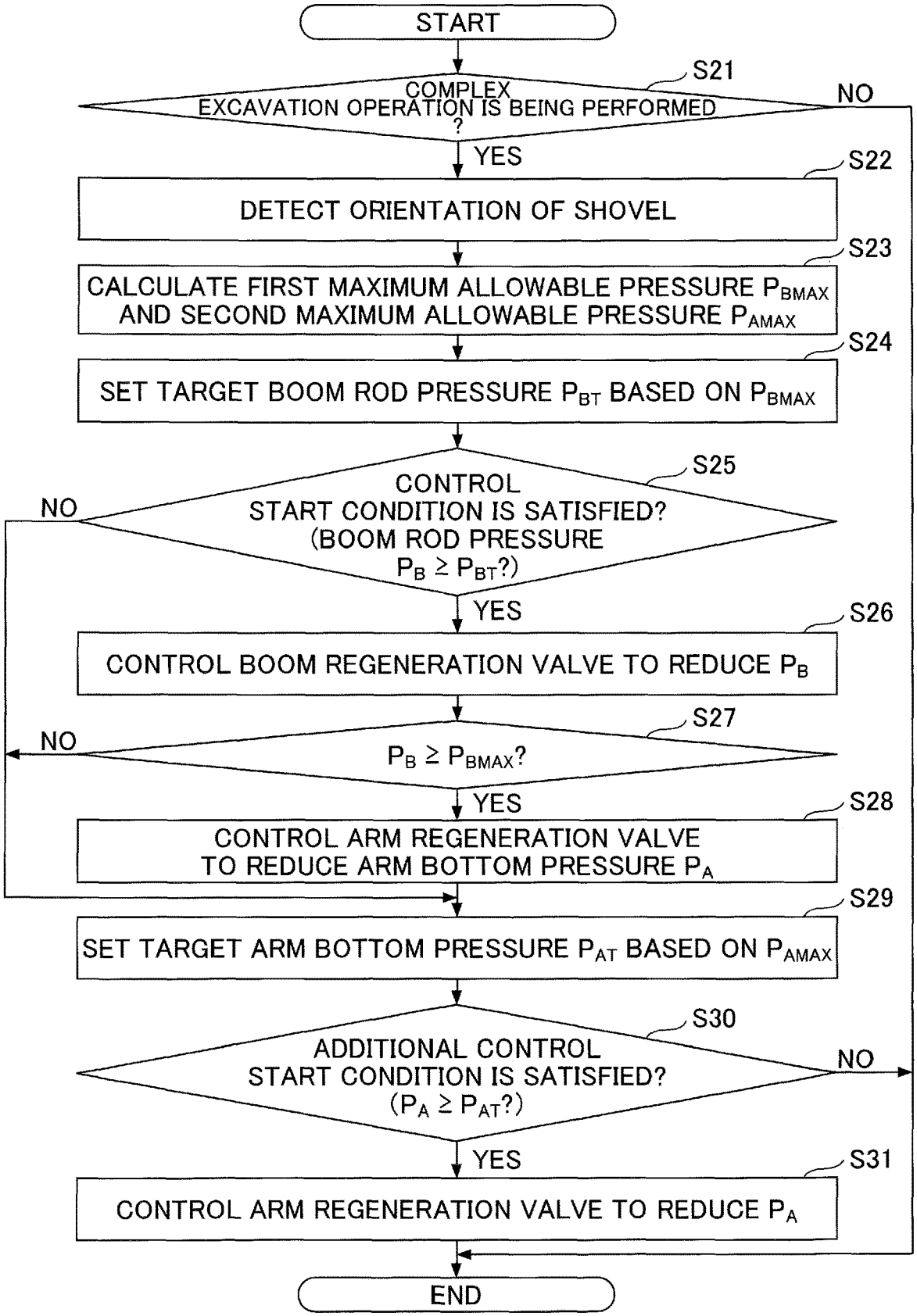
FIG. 48 is a flowchart illustrating a flow of a third support process.

Next, referring to FIG. 48, a process performed by the controller 30 of the shovel having the hydraulic circuit of FIG. 46 to support excavation work, while preventing the body of the shovel from being dragged toward an excavation point (hereinafter referred to as a "third support process") will be described. FIG. 48 is a flowchart illustrating a flow of the third support process. The controller 30 repeatedly performs the third support process at predetermined intervals.

First, the excavation operation detecting unit 302A of the controller 30 determines whether a complex excavation operation including a boom raising operation and an arm closing operation is being performed (step S21). Specifically, the excavation operation detecting unit 302A detects whether a boom raising operation is being performed based on the output of the pressure sensor 29. If it is determined that the boom raising operation is being performed, the excavation operation detecting unit 302A obtains the boom rod pressure. Further, the excavation operation detecting unit 302A calculates a difference between the arm bottom pressure and the arm rod pressure. Then, if the obtained boom rod pressure is a predetermined value or more and the calculated difference is a predetermined value or more, the excavation operation detecting unit 302A determines that the complex excavation operation is being performed.

If the excavation operation detecting unit 302A determines that the complex excavation operation is not being performed (no in step S21), the excavation operation detecting unit 302A ends the this time third support process.

Conversely, if the excavation operation detecting unit 302A determines that the complex excavation operation is being performed (yes in step S21), the orientation detecting unit 302B detects the orientation of the shovel (step S22).

Next, the maximum allowable pressure calculating unit 302C calculates the first maximum allowable pressure and the second maximum allowable pressure, based on detected values of the orientation detecting unit 302B (step S23). Specifically, the maximum allowable pressure calculating unit 302C uses the above-described equation (36) to calculate the first maximum allowable pressure $P_{BMAX}$ and uses the above-described inequality (39) to calculate the second maximum allowable pressure $P_{AMAX}$.

Next, the maximum allowable pressure calculating unit 302C sets a given pressure that is less than or equal to the calculated first maximum allowable pressure $P_{BMAX}$ as a target boom rod pressure $P_{BT}$ (step S24).

Next, the regeneration valve control unit 302D of the controller 30 determines whether a control start condition, which is a predetermined condition on the stability of the body of the shovel, is satisfied (step S25). For example, the regeneration valve control unit 302D determines that the control start condition is satisfied when the boom rod pressure $P_B$ has reached the target boom rod pressure $P_{BT}$. In this step, whether the control start condition is satisfied is determined based on the boom rod pressure $P_B$. However, whether the control start condition is satisfied may be determined based on whether the magnitude of the vertical component of the excavation reaction force satisfies a predetermined condition. In this manner, determination in preventing lifting may be made based on parameters contributing to the vertical component.

If it is determined that the control start condition is satisfied (yes in step S25), for example, if the boom rod pressure $P_B$ has reached the target boom rod pressure $P_{BT}$, the regeneration valve control unit 302D controls the regeneration valve V1 (boom regeneration valve) to reduce the boom rod pressure $P_B$ (step S26). Specifically, the regeneration valve control unit 302D supplies a control current to the regeneration valve V1, so as to open the regeneration valve V1 and increase the opening area. This is to increase the flow area of the first oil passage C1. By causing hydraulic oil to flow out of the rod-side oil chamber 7R, the regeneration valve control unit 302D reduces the boom rod pressure $P_B$. As a result, the boom cylinder 7 extends, thereby decreasing the vertical component $F_{R1}$ of the excavation reaction force $F_R$. Accordingly, the body of the shovel is prevented from being lifted.

Thereafter, the regeneration valve control unit 302D of the controller 30 continues to monitor the boom rod pressure $P_B$. If the boom rod pressure $P_B$ further increases regardless of the increased opening area of the regeneration valve V1, and has reached the first maximum allowable pressure $P_{BMAX}$ (yes in step S27), the regeneration valve control unit 302D controls the arm regeneration valve V1*a* to reduce the arm bottom pressure $P_A$ (step S28). Specifically, the regeneration valve control unit 302D supplies a control current to the arm regeneration valve V1*a*, so as to open the arm regeneration valve V1*a* and increase the opening area. This is to increase the flow area of the first oil passage C1*a*. By causing hydraulic oil to flow out of the bottom-side oil chamber 8B, the regeneration valve control unit 302D reduces the arm bottom pressure $P_A$. As a result, the extension of the arm cylinder 8 is suppressed or stopped, thereby decreasing or eliminating the vertical component $F_{R1}$ of the excavation reaction force $F_R$. Accordingly, the body of the shovel is prevented from being lifted.

In step S25, if it is determined that the control start condition is not satisfied (no in step S25), for example, if the boom rod pressure $P_B$ remains below the target boom rod pressure $P_{BT}$, the controller 30 causes the process to proceed to step S29, without reducing the boom rod pressure $P_B$. This is because there is no possibility that the body of the shovel may be lifted.

Similarly, in step S27, if the boom rod pressure $P_B$ remains below the first maximum allowable pressure $P_{BMAX}$ (no in step S27), the controller 30 causes the process to proceed to step S29, without reducing the arm bottom pressure $P_A$. This is because there is no possibility that the body of the shovel may be lifted.

Next, in step S29, the maximum allowable pressure calculating unit 302C sets a given pressure that is less than or equal to the calculated second maximum allowable pressure $P_{AMAX}$ as a target arm bottom pressure $P_{AT}$. Specifically, the maximum allowable pressure calculating unit 302C sets the second maximum allowable pressure $P_{AMAX}$ as the target arm bottom pressure $P_{AT}$.

Thereafter, the regeneration valve control unit 302D of the controller 30 determines whether an additional control start condition is satisfied (step S30). For example, the regeneration valve control unit 302D determines that the additional control start condition is satisfied when the arm bottom pressure $P_A$ has reached the target arm bottom pressure $P_{AT}$.

If it is determined that the additional control start condition is satisfied (yes in step S30), for example, if the arm bottom pressure $P_A$ has reached the target arm bottom pressure $P_{AT}$, the regeneration valve control unit 302D controls the arm regeneration valve V1*a* to reduce the difference between the arm bottom pressure $P_A$ and the arm rod pressure $P_{A2}$, thereby reducing the arm thrust $F_A$ (step S31). Specifically, the regeneration valve control unit 302D supplies a control current to the arm regeneration valve V1*a*, so as to open the arm regeneration valve V1*a* and increase the opening area. This is to increase the flow area of the first oil passage C1*a*. By causing hydraulic oil to flow out of the bottom-side oil chamber 8B, the regeneration valve control unit 302D reduces the arm bottom pressure $P_A$. As a result, the extension of the arm cylinder 8 is suppressed or stopped, thereby decreasing or eliminating the horizontal component $F_{R2}$ of the excavation reaction force $F_R$. Accordingly, the body of the shovel is prevented from being dragged toward an excavation point.

Further, if the arm rod pressure $P_{A2}$ has reached the target arm rod pressure $P_{AT}$ at the time of the contraction of the arm cylinder 8, the regeneration valve control unit 302D controls the arm regeneration valve V1 to reduce the difference between the arm bottom pressure $P_A$ and the arm rod pressure $P_{A2}$, thereby reducing the arm thrust $F_A$. In this case, it is possible to prevent the shovel from being dragged even when the arm 5 is rotated in the opening direction. In this step, whether the control start condition is satisfied is determined based on the arm rod pressure $P_{A2}$ or the arm bottom pressure $P_A$. However, whether the control start condition is satisfied may be determined based on whether the magnitude of the horizontal component of the excavation reaction force satisfies a predetermined condition. In this manner, determination in preventing dragging may be made based on parameters contributing to the horizontal component.

In step S30, if it is determined that the additional control start condition is not satisfied (no in step S30), for example, if the arm bottom pressure $P_A$ remains below the target arm bottom pressure $P_{AT}$, the controller 30 ends the current third support process, without reducing the arm bottom pressure $P_A$. This is because there is no possibility that the body of the shovel may be dragged.

A series of steps S24 through S28 for preventing the lifting of the shovel and a series of steps S29 through S31 for preventing the dragging of the shovel are performed in any order. Therefore, the two series of steps may be performed concurrently. Alternatively, the series of steps for preventing the dragging of the shovel may be performed prior to the series of steps for preventing the lifting of the shovel.

With the above configuration, it is possible for the controller 30 to prevent the body of the shovel from being lifted or dragged toward an excavation point during complex excavation operation without affecting a pilot pressure. Therefore, it is possible for the shovel to perform complex excavation operation that makes efficient use of its body weight at a point immediately before the body of the shovel is lifted or dragged. Furthermore, work efficiency can be improved by eliminating the need to perform an operation for returning the lifted or dragged shovel to its original orientation, thereby also decreasing fuel consumption, preventing a failure of the body, and reducing the operator's operation burden.

In the above-described fourth variation, the maximum allowable pressure calculating unit 302C and the regeneration valve control unit 302D perform calculation based on the assumption that the ground surface contacted by the shovel is a flat surface; however, the fourth variation is not limited thereto. In the above-described fourth variation, even if the ground surface contacted by the shovel is an inclined surface, calculation may be properly performed by additionally taking into account the output of the inclination angle sensor.

Further, in the above-described fourth variation, the controller 30 may be configured to prevent the lifting of the body of the shovel during a bucket closing operation. In this case, the controller 30 opens the regeneration valve V1 when the boom rod pressure has exceeded the target boom rod pressure $P_{BT}$.

Further, the controller 30 may be configured to prevent the lifting of the body of the shovel during a complex excavation operation including a bucket closing operation and a boom raising operation. In this case, the controller 30 opens the regeneration valve V1 when the boom rod pressure has exceeded the target boom rod pressure $P_{BT}$. Further, the controller 30 opens a bucket regeneration valve provided in a first oil passage that connects the rod-side oil chamber to the bottom-side oil chamber of the bucket cylinder 9 when the boom rod pressure has reached the first maximum allowable pressure $P_{BMAX}$. In this manner, the controller 30 may prevent the lifting of the body of the shovel during a complex excavation operation including a bucket closing operation and a boom raising operation. Similarly, the controller 30 may use the bucket regeneration valve to prevent the dragging of the body of the shovel.

Further, in the above-described fourth variation, the regeneration valve V1 is used to cause hydraulic oil to flow out of the rod-side oil chamber 7R, but may be used to cause hydraulic oil to flow out of the bottom-side oil chamber 7B. Further, the arm regeneration valve V1*a* is used to cause hydraulic oil to flow out of the bottom-side oil chamber 8B, but may be used to cause hydraulic oil to flow out of the rod-side oil chamber 8R. In other words, the controller 30 may open the arm regeneration valve V1*a*, and cause hydraulic oil to flow from the rod-side oil chamber 8R into the bottom-side oil chamber 8B of the arm cylinder 8 or to flow from the bottom-side oil chamber 8B into the rod-side oil chamber 8R in accordance with the weight of the attachment. The same applies to the bucket regeneration valve.

Further, in the above-described fourth variation, hydraulic cylinders such as the boom cylinder 7 and the arm cylinder 8 are moved by hydraulic oil that is discharged by the engine-driven main pump 14; however, the hydraulic cylinders may be moved by hydraulic oil that is discharged by a hydraulic pump driven by an electric motor.

Further, in the above-described fourth variation, regardless of whether an unintended movement such as the dragging or lifting of the body of the shovel has occurred, the controller 30 performs control that minimizes the dragging or lifting of the body of the shovel. However, the controller 30 may, of course, determine the occurrence of an unintended movement. Namely, the controller 30 may perform control that minimizes the dragging or lifting of the body of the shovel when the occurrence of the dragging or lifting of the body of the shovel is determined by the determination methods (see FIG. 19A through FIG. 26B).

Further, the above-described configuration according to the fourth variation may be installed in any other construction machine such as a forklift or a loader that use hydraulic cylinders for raising and lowering operations.

The following clauses are further disclosed with respect to the above-described fourth variation.

(1) A shovel includes:

a traveling body;

a turning body turnably mounted on the traveling body;

an attachment attached to the turning body;

a hydraulic actuator configured to drive a work element constituting the attachment;

a first oil passage that connects a rod-side oil chamber to a bottom-side oil chamber of a hydraulic cylinder, the hydraulic cylinder serving as the hydraulic actuator, a regeneration valve disposed in the first oil passage; and a control unit configured to control the regeneration valve, based on whether a predetermined condition on stability of a body of the shovel is satisfied.

(2) The shovel according to (1), further includes:

a flow rate control valve configured to control a flow rate of hydraulic oil that flows into and out of the hydraulic cylinder;

a second oil passage that connects the rod-side oil chamber of the hydraulic cylinder to the flow rate control valve; and a third oil passage that connects the bottom-side oil chamber of the hydraulic cylinder to the flow rate control valve, wherein the first oil passage connects the second oil passage to the third oil passage.

(3) The shovel according to (1) or (2), wherein the hydraulic cylinder is a boom cylinder, and the control unit opens the regeneration valve so as to cause hydraulic oil to flow from the rod-side oil chamber into the bottom-side oil chamber of the boom cylinder.

(4) The shovel according to any one of (1) to (3), wherein the control unit controls the regeneration valve independently of an operation related to the hydraulic cylinder.

(5) The shovel according to (1) or (2), wherein the hydraulic cylinder is an arm cylinder, and the control unit opens the regeneration valve so as to cause hydraulic oil to flow from the rod-side oil chamber into the bottom-side oil chamber of the arm cylinder or from the bottom-side oil chamber into the rod-side oil chamber of the arm cylinder in accordance with weight of the attachment.

(6) The shovel according to (1), wherein the regeneration valve is disposed between a flow rate control valve and the hydraulic cylinder, the flow rate control valve being configured to control a flow rate of hydraulic oil that flows into and out of the hydraulic cylinder.

(7) The shovel according to (2), wherein hydraulic oil discharged from an oil chamber on one side of the hydraulic cylinder is supplied to an oil chamber located on another side opposite to the one side of the hydraulic cylinder, or is discharged into a tank, in accordance with a size of an opening of a cylinder/tank port of the flow rate control valve.

Further, the present invention is not limited to these embodiments, but various variations and modifications may be made to the described subject matter without departing from the scope of the present invention.

What is claimed is:

1. A shovel comprising:

a traveling body;

a turning body turnably mounted on the traveling body;

an attachment attached to the turning body;

a hydraulic actuator configured to drive the attachment; and a hardware processor, wherein the hardware processor is configured to control the hydraulic actuator to minimize a change in orientation of the traveling body or of the turning body, in response to determining that an overturning moment to turn over the traveling body or the turning body generated by a change in, moment caused by an aerial movement of the attachment has exceeded a predetermined threshold.

2. The shovel according to claim 1, further comprising:

a hydraulic pump configured to be driven by a predetermined power source to supply hydraulic oil to the hydraulic actuator, wherein the hardware processor is configured to control a hydraulic pressure of the hydraulic actuator by controlling the hydraulic pump or the power source.

3. The shovel according to claim 1, further comprising:

a first oil passage that connects a rod-side oil chamber to a bottom-side oil chamber of a hydraulic cylinder, the hydraulic cylinder serving as the hydraulic actuator; and a regeneration valve disposed in the first oil passage, wherein the hardware processor is configured to control the regeneration valve, based on whether a predetermined condition on stability of a body of the shovel is satisfied.

4. The shovel according to claim 3, further comprising:

a flow rate control valve configured to control a flow rate of hydraulic oil that flows into and out of the hydraulic cylinder;

a second oil passage that connects the rod-side oil chamber of the hydraulic cylinder to the flow rate control valve; and a third oil passage that connects, the bottom-side oil chamber of the hydraulic cylinder to the flow rate control valve, wherein the first oil passage connects the second oil passage to the third oil passage.

5. The shovel according to claim 3, wherein the hydraulic cylinder is a boom cylinder, and the hardware processor is configured to open the regeneration valve so as to cause hydraulic oil to flow from the rod-side oil chamber into the bottom-side oil chamber of the boom cylinder.

6. The shovel according to claim 3, wherein the hydraulic cylinder is an arm cylinder, and the hardware processor is configured to open the regeneration valve so as to cause hydraulic oil to flow from the rod-side oil chamber into the bottom-side oil chamber of the arm cylinder or from the bottom-side oil chamber into the rod-side oil chamber of the arm cylinder in accordance with weight of the attachment.

7. The shovel according to claim 3, wherein the hardware processor is configured to control the regeneration valve independently of an operation related to the hydraulic cylinder.

8. The shovel according to claim 1, wherein the hardware processor is further configured to determine whether a predetermined unintended movement occurs, and correct the movement of the attachment when determining that the predetermined unintended movement has occurred.

9. The shovel according to claim 8, further comprising:

a detector attached to the turning body or the attachment and configured to detect a relative position of a fixed reference object around the shovel with respect to one of the turning body and the attachment, wherein the hardware processor is configured to determine whether the unintended movement occurs, based on a change in the detected relative position of the reference object around the shovel with respect to the one of the turning body and the attachment.

10. A shovel comprising:

a traveling body;

a turning body turnably mounted on the traveling body;

an attachment attached to the turning body;

a hydraulic actuator configured to drive the attachment;

a hardware processor;

a control valve configured to control a movement of the hydraulic actuator in accordance with an operation by an operator;

a holding valve disposed in an oil passage between the control valve and the hydraulic actuator to hold hydraulic oil of the hydraulic actuator; and a releasing device configured to, release the hydraulic oil of the hydraulic actuator held by the holding valve, in accordance with an operating state of the attachment, wherein the hardware processor is configured to control the hydraulic actuator to minimize a change in orientation of the traveling body or of the turning body, in response to a change in moment caused by an aerial movement of the attachment, and wherein the hardware processor is configured to control a hydraulic pressure of the hydraulic actuator by controlling the releasing device so as to release the hydraulic oil held by the holding valve, regardless of the operating state of the attachment.

11. A shovel comprising:

a traveling body;

a turning body turnably mounted on the traveling body;

an attachment attached to the turning body, the attachment including a boom and an arm;

a boom cylinder and an arm cylinder configured to drive the boom and the arm, respectively, the boom cylinder and the arm cylinder each including a rod-side oil chamber and a bottom-side oil chamber;

an oil passage connecting the rod-side oil chamber and the bottom-side oil chamber;

a regeneration valve disposed in the oil passage and configured to allow a bidirectional flow of hydraulic oil between the rod-side oil chamber and the bottom-side oil chamber; and a hardware processor configured to control at least one of the boom cylinder and the arm cylinder by controlling the regeneration valve to minimize a change in orientation of the traveling body or of the turning body, in response to a change in moment caused by an aerial movement of the attachment, the hardware processor being configured to control the regeneration valve based on whether a predetermined condition on stability of a body of the shovel is satisfied.

* * * * *